US009038524B2

(12) United States Patent
Jebsen et al.

(10) Patent No.: US 9,038,524 B2
(45) Date of Patent: May 26, 2015

(54) FIREARM WITH ENHANCED RECOIL AND CONTROL CHARACTERS

(75) Inventors: Jan Henrik Jebsen, Nyon (CH); Renaud Kerbrat, Nyon (CH); Klaus Jenny, Nyon (CH)

(73) Assignee: KRISS SYSTEMS SA, Nyon (CH)

( * ) Notice: Subject to any disclaimer, the term of this patent is extended or adjusted under 35 U.S.C. 154(b) by 0 days.

(21) Appl. No.: 10/454,778

(22) Filed: Jun. 5, 2003

(65) Prior Publication Data

US 2004/0069137 A1 Apr. 15, 2004

Related U.S. Application Data

(60) Provisional application No. 60/459,969, filed on Apr. 4, 2003.

(30) Foreign Application Priority Data

| | | |
|---|---|---|
| Jun. 7, 2002 | (CH) | 975/02 |
| Jul. 31, 2002 | (CH) | 1343/02 |
| Apr. 15, 2003 | (CH) | 679/03 |

(51) Int. Cl.

| | |
|---|---|
| ***F41A 3/04*** | (2006.01) |
| ***F41A 3/34*** | (2006.01) |
| ***F41A 3/84*** | (2006.01) |
| ***F41A 3/56*** | (2006.01) |
| ***F41A 5/12*** | (2006.01) |

(52) U.S. Cl.

CPC ... *F41A 3/84* (2013.01); *F41A 3/04* (2013.01); *F41A 3/34* (2013.01); *F41A 3/56* (2013.01); *F41A 5/12* (2013.01)

(58) Field of Classification Search

CPC ..... F41A 3/04; F41A 3/34; F41A 5/12
USPC ..... 42/28, 29, 34, 35; 89/171, 172, 173
See application file for complete search history.

(56) References Cited

U.S. PATENT DOCUMENTS

| | | | | |
|---|---|---|---|---|
| 574,189 | A * | 12/1896 | Carr | 89/144 |
| 1,452,123 | A | 4/1923 | McCrudden | |
| 1,457,961 | A * | 6/1923 | Browning | 89/145 |
| 1,464,864 | A * | 8/1923 | Browning | 89/184 |
| 1,497,096 | A | 6/1924 | Eriksen | |

(Continued)

FOREIGN PATENT DOCUMENTS

| | | |
|---|---|---|
| BE | 351672 | 6/1928 |
| CH | 43050 | 4/1909 |

(Continued)

OTHER PUBLICATIONS

Mercury Recoil Suppressor from http://www.mercuryrecoil.com.

(Continued)

*Primary Examiner* — Bret Hayes
(74) *Attorney, Agent, or Firm* — David Kulik

(57) ABSTRACT

The invention comprises an improved recoil control device comprising a bolt head and an inertia block for use in a variety of firearms. In one embodiment, the bolt head and inertia block are articulated so that the displacement of the bolt head results in a force component outside the firing axis of the barrel of the firearm. The device can be incorporated into firearms of a variety of sizes and configurations to produce recoil reduction and/or weight reduction advantages.

23 Claims, 55 Drawing Sheets

(56) References Cited

U.S. PATENT DOCUMENTS

| | | | | | |
|---|---|---|---|---|---|
| 1,835,715 | A | | 12/1931 | McCoy | |
| 2,365,188 | A | | 12/1944 | Gorton | |
| 2,476,232 | A | | 7/1949 | Williams | |
| 3,000,268 | A | * | 9/1961 | Robinson | 89/189 |
| 3,251,270 | A | | 5/1966 | Seifried | |
| 3,489,060 | A | | 1/1970 | Marocchi | |
| 3,554,077 | A | | 1/1971 | Schlapia, Jr. | |
| 3,568,565 | A | * | 3/1971 | Swieskowski | 89/198 |
| 3,580,132 | A | | 5/1971 | Vartanian | |
| 3,641,867 | A | | 2/1972 | Junker | |
| 3,650,060 | A | | 3/1972 | Schubert | |
| 3,661,049 | A | * | 5/1972 | Perrine | 89/189 |
| 3,683,534 | A | | 8/1972 | Davis | |
| 3,783,739 | A | * | 1/1974 | Perrine | 89/189 |
| 4,088,057 | A | | 5/1978 | Nasypany | |
| 4,112,605 | A | | 9/1978 | Staub | |
| 4,126,077 | A | | 11/1978 | Quesnel | |
| 4,164,825 | A | | 8/1979 | Hutchison | |
| 4,167,890 | A | * | 9/1979 | Adams | 89/189 |
| 4,172,408 | A | * | 10/1979 | Ayler et al. | 89/7 |
| 4,183,282 | A | * | 1/1980 | Perrine | 89/189 |
| 4,279,091 | A | | 7/1981 | Edwards | |
| 4,301,712 | A | | 11/1981 | Cristina | |
| 4,369,759 | A | * | 1/1983 | Gerstenberger et al. | 124/68 |
| 4,391,180 | A | | 7/1983 | Koine | |
| 4,398,116 | A | * | 8/1983 | Lewis | 310/334 |
| 4,439,943 | A | | 4/1984 | Brakhage | |
| 4,447,975 | A | | 5/1984 | Ljutic | |
| 4,492,050 | A | | 1/1985 | Kagehiro | |
| 4,503,632 | A | | 3/1985 | Cuevas | |
| 4,506,589 | A | * | 3/1985 | Junker et al. | 89/190 |
| 4,514,921 | A | | 5/1985 | Burkleca | |
| H0000211 | H | * | 2/1987 | Vanderbeck | 42/17 |
| 4,719,841 | A | | 1/1988 | Perrine | |
| 4,769,937 | A | | 9/1988 | Gregory et al. | |
| 4,840,107 | A | | 6/1989 | Weldon | |
| 4,867,038 | A | | 9/1989 | Metz | |
| 4,910,904 | A | | 3/1990 | Rose | |
| 4,974,493 | A | | 12/1990 | Yeffman | |
| 4,986,018 | A | | 1/1991 | McDonald, Jr. | |
| 5,031,348 | A | | 7/1991 | Carey | |
| 5,069,110 | A | | 12/1991 | Menck | |
| 5,138,931 | A | | 8/1992 | Brookshire | |
| 5,343,649 | A | | 9/1994 | Petrovich | |
| 5,519,957 | A | | 5/1996 | Iannetta | |
| 5,524,374 | A | | 6/1996 | Gernstein | |
| 5,581,046 | A | | 12/1996 | Weldle et al. | |
| 5,585,590 | A | | 12/1996 | Ducolon | |
| 5,614,691 | A | * | 3/1997 | Taylor | 89/128 |
| 5,669,173 | A | | 9/1997 | Rodney, Jr. | |
| 5,678,345 | A | | 10/1997 | Gnade | |
| 5,682,007 | A | | 10/1997 | Dobbins | |
| 5,722,195 | A | | 3/1998 | Bentley et al. | |
| 5,758,447 | A | | 6/1998 | Venetz | |
| 5,811,720 | A | | 9/1998 | Quinnell et al. | |
| 5,844,162 | A | | 12/1998 | Renner | |
| 5,909,002 | A | | 6/1999 | Atchisson | |
| 5,911,173 | A | | 6/1999 | Westrom | |
| 5,952,602 | A | | 9/1999 | Gussalli Beretta | |
| 5,979,098 | A | | 11/1999 | Griggs | |
| 5,983,549 | A | | 11/1999 | Battaglia | |
| 6,044,748 | A | | 4/2000 | Westrom | |
| 6,055,760 | A | | 5/2000 | Cuson et al. | |
| 6,079,138 | A | | 6/2000 | Meaker | |
| 6,079,311 | A | | 6/2000 | O'Quinn et al. | |
| 6,196,108 | B1 | | 3/2001 | Murello | |
| 6,234,058 | B1 | | 5/2001 | Morgado | |
| 6,243,978 | B1 | | 6/2001 | Vignaroli et al. | |
| 6,269,727 | B1 | | 8/2001 | Nigge | |
| 6,305,115 | B1 | | 10/2001 | Cook | |
| 6,343,536 | B1 | | 2/2002 | Rossier et al. | |
| 6,357,157 | B1 | | 3/2002 | Constant et al. | |
| 6,418,833 | B1 | | 7/2002 | Hajjar | |
| 6,532,876 | B1 | | 3/2003 | Ramirez et al. | |
| 7,201,094 | B2 | | 4/2007 | Jebsen et al. | |
| 2002/0053156 | A1 | | 5/2002 | McCarthy | |
| 2002/0139241 | A1 | | 10/2002 | Butler | |
| 2003/0051600 | A1 | | 3/2003 | Breuer et al. | |
| 2003/0056639 | A1 | | 3/2003 | Giza | |
| 2000/4025680 | | | 2/2004 | Jebsen et al. | |
| 2004/0069138 | A1 | | 4/2004 | Jebsen et al. | |

FOREIGN PATENT DOCUMENTS

| | | |
|---|---|---|
| DE | 211229 | 6/1909 |
| FR | 969669 | 12/1950 |
| FR | 1193803 | 11/1959 |
| WO | WO 03/104737 A1 | 12/2003 |
| WO | WO 03/104738 A1 | 12/2003 |
| WO | WO 03/104739 A1 | 12/2003 |

OTHER PUBLICATIONS

Sprinco Recoil Reduction Guide Rods from http://aps.3av.com/about.htm.

Benelli website information from http://www.benelliusa.com.

International Search Report in PCT/CH03/00363.

International Search Report for PCT/US08/000336 filed Jan. 10, 2008 and Written Opinion dated Oct. 22, 2008.

* cited by examiner

FIREARM WITH ENHANCED RECOIL AND CONTROL CHARACTERS

RELATED APPLICATIONS

This application claims priority to U.S. Provisional Application No. 60/459,969, filed Apr. 4, 2003, which is incorporated by reference in its entirety. This application also claims priority to Swiss Application Nos. 0975/02, filed Jun. 7, 2002, 1343/02, filed Jul. 31, 2002, and 0679/03, filed Apr. 15, 2003, which are incorporated by reference in their entirety.

FIELD OF INVENTION

This invention relates to small and heavy caliber firearms and cannons as well as to improved methods and devices for reducing the consequences of recoil and improving performance in firearms and cannons. In a particular embodiment, the device relates to the control or management of the recoil forces for semiautomatic or automatic firearms.

BACKGROUND FOR AND INTRODUCTION TO THE INVENTION

Historically, firearms were built to be loaded and fired mechanically. Even today, many heavy caliber guns and cannons are loaded by hand or individually loaded. For automatic weapons, the rapid firing of successive cartridges induces various side effects that prove detrimental both to accuracy and effectiveness. Traditionally, a gun was considered to work like a heat engine, in which about thirty percent of the energy developed by the propellant powder is dissipated as heat, forty percent as muzzle blast and recoil, and only the remaining thirty percent was effectively used to propel the bullet out of the barrel. Successive designs of automatic weapons tried to make use of the vast amount of wasted energy to help make the automatic cycling operate better. Three general systems were used. Hiram Maxim was the first to use recoil forces to mechanize the ejection and loading actions in a machine gun, Browning put the muzzle blast to effective use, and Bergman devised the simple blowback action. Thus, the three basic ways of obtaining an automatic operation were developed from the use of recoil, gas, or blowback actuation.

Later applications of the blowback operation used either simple blowback or assisted blowback, with or without locked, delayed, hesitation or retarded blowback, and even blowback with advanced primer ignition. Gas operation leads to the use of long and short-stroke pistons and even, in more modem weapons, direct gas action, where the derived gas directly activates a bolt carrier in which an adequate recess is managed. Recoil operation traditionally provided the locking mechanism of the bolt to the barrel so that they can slide together under the thrust of the pressure when firing, either under a short or long recoil operation and with or without muzzle boosters or recoil intensifiers.

Throughout these improvements, a main issue was safety. Therefore, all systems were engineered to ensure an accurate duration of locking the breech to the barrel until the gas pressure falls to a safe level once the projectile has exited the barrel. The main breech locking systems used either separate revolving chambers, the rotation of which provides an adequate duration of protection, or toggle systems, rotating bolts, tilting breech blocks, lug systems, or even non-ramming breech blocks. A common but unsatisfactory feature among all theses mechanisms is that they do not prevent the undesirable side effects during automatic firing, which accounts for the adverse effects on accuracy and ease of use.

Thus, the mechanisms found on current firearms, although reliable and widely employed, nevertheless suffer from a number of deficiencies. For example, some mechanisms increase the length of the housing of the breech, resulting in interior clutter and increased weight. The amplitude of recoil is relatively critical due to its effect on accuracy, and the existing mechanisms fail to provide a satisfactory or optimum reduction in recoil, which permits the resulting upward movement of the barrel. More particularly, the direction of the recoil forces generally coincides with the longitudinal axis of the gun barrel. The gun barrel is generally located above the shoulder in a person firing a rifle or above the hand in a handgun, and more precisely above the gap between the thumb and index finger of a person firing a handgun. This configuration generates a moment that causes the upward jerking of the gun familiar to every user. Heavy caliber firearms and cannons experience the same upward forces upon firing, which often results in heavy strains on the mounting or emplacement apparatus. For these and other reasons, improvements in the design and operation of small and heavy caliber firearms and cannons are desired in the art.

The innovative approaches taken here make a more effective use of the available energy and, in particular, recycle, as much as practicable, the wasted energy by departing from the traditional and historical mechanisms. In one aspect, this invention provides new solutions, mechanisms, and systems for operating the firing action of a firearm and allows revolutionary changes in the use and ergonomics applicable to firearm design and control.

Taking into account all these adverse or secondary effects that impede the use of all firearms, and in particular automatic firearms, in which energy is essentially wasted beyond that necessary for propelling the projectile, the present approach is new and innovative. In general and in one aspect, the invention is aimed at addressing the design of a new firearm by taking advantage of available energy to help operate the firearm and consequently minimize and/or compensate for the adverse effects and improve control. A first innovation is the deliberate use and control of energy to address all the adverse effects during operation. This allows one to conceive of a new firearm design and implementation. This new approach also allows a firearm designer to address concerns and constraints as part of a whole rather than as individual problems, so as to take into account the advantages of an interface between firearm components during its operation. Considering the operation as a whole, as this invention exemplifies, allows completely new concepts and expands the universe of designs, configurations, and mechanisms possible for firearms.

SUMMARY OF THE INVENTION

The present invention addresses the problems and disadvantages associated with conventional firearms and weapon systems and provides improved devices for reducing recoil effects in a variety of firearms, cannons, and systems. Whether for handguns, rifles, pistols, machine pistols, military rifles, or cannons, one aspect of the invention is to reduce the amplitude or consequences of recoil and/or eliminate, for all practical purposes, the weapon's reactive upward jerking. The invention also facilitates the design and production of a more compact weapon and/or allows substantial reductions in the weight of the frame, which results in many new design possibilities and improvements in ergonomics. Thus, incorporating one or more of the many aspects of the invention into a firearm improves accuracy and/or reduces the total weight.

One of the fundamental principles of the present invention is the transfer of mechanical recoil forces to a direction outside of the longitudinal axis of the gun barrel. As can be seen in each of the exemplary embodiments disclosed herein, the transfer of forces disperses or dissipates recoil forces and thereby reduces the moment responsible for the upward jerking characteristic of conventional firearms. The mechanism that transfers forces can be oriented to counteract the recoil forces along the longitudinal axis of the gun barrel to effectively eliminate or compensate for the upward jerking of the weapon. For example, a pair of inertia blocks of substantially equal mass can be oriented such that their respective movements in response to firing will be synchronized, equal in magnitude, and with corresponding but opposite components of momentum oriented outside the longitudinal axis of the barrel. The net effect is that the opposite movement or displacement of the inertia blocks first absorbs the recoil forces and prevents the weapon from being pushed rearward. Second, the lateral momentum of one moving inertia block cancels the other, thereby inducing no net lateral force or even agitation of the firearm. Thus, the portion of the recoil forces beyond those used to operate the novel mechanisms or system of the invention is transferred in a direction outside the longitudinal axis of the barrel and effectively disposed of by being cancelled out, thereby significantly reducing or even eliminating the component of recoil forces along the longitudinal axis of the barrel that is responsible for the reactive jerking of the weapon when fired. One of skill in the art will recognize that the embodiments disclosed herein are exemplary and that one or more of the foregoing principles can be applied in many variations to firearms of various calibers and applications.

In one embodiment, the device according to the invention is based on an arrangement of articulated parts constituting a mobile breech. The nature of the assembly allows displacement of at least one of the parts in the assembly, which acts as an inertia block, in a movement that alternates out of and into alignment with the longitudinal axis of the barrel. This action is contrary to the action of conventional breech locking mechanisms in which the whole breech moves in translation true to the axis of the barrel.

A novel aspect of this new mechanism originates in the transmission of forces and energy from the action of recoil to the inertia block in the instant immediately following percussion by means of an impulse occurring in a direction other than along the axis of the gun barrel, ideally perpendicular to that axis, with the bolt head checked in its movement by a locking mechanism. To enhance the transfer of energy to the inertia block, and thus to induce its greater movement, the mechanism is engineered to produce a slight time-lapse (or phase displacement) in the initial movements of the inertia block and/or the bolt head through a delay in release of the locking mechanism. Accordingly, in one embodiment, the inertia block of mass M is activated, rotating with an initial velocity Vm, its momentum running through a number of movements. Once the inertia block is in motion, the locking mechanism (the locking cylinder or spool in chambered position with the bolt or bolt head) unlocks to liberate the bolt head. The continuing trajectory of the inertia block then compels a translated displacement of the bolt head towards the rear of the weapon due to the nature of the means of its linkage with the inertia block. Continuing its rotation to maximum lateral extension, the inertia block encounters resistance due a mechanism for energy recuperation, ideally one of elastic counter-stress or a spring, which deflects the inertia block to fold itself again laterally on the gun. The nature of the linkage of the inertia block with the bolt head drives the latter forward, compelling insertion of a round in the firing chamber by conventional technique. Arrival of the inertia block at the end of its re-folding activates the locking mechanism, which secures the bolt head in firing position.

According to a preferred embodiment of this invention, a firearm or recoil control device or mechanism is composed of two like inertia blocks set symmetrically about the axis of the gun barrel. Each inertia block is linked to the bolt head in a similar fashion. Movement of the two inertia blocks is synchronized. Their respective rotation is complementary and mutually opposed. In this configuration, absorption of recoil is considerably enhanced.

This invention allows several parameters to be varied, notably the ratio between the masses of the inertia blocks and the mass of the bolt head, the ratio of the angle of extension of the deployed or extended inertia block(s) to the axis of the gun barrel, and/or the delay in the initation or activation of movement in the locking cylinder or spool, or the delay in the initiation or activation of movement of the inertia blocks. The terms locking spool and locking cylinder are used interchangeably.

In one particular embodiment of the present invention, a recoil control device for use in a firearm comprises a bolt head configured to alternate between a forward position and a rearward position in response to the firing of one or more cartridges and an inertia block connected to the bolt head such that said bolt head imparts an impulse to the inertia block as it alternates between the forward position and the rearward position. The impulse imparted to the inertia block may have a component lateral or perpendicular to the firing axis of the barrel of the firearm. Alternately, the movement of the inertia block may have a component lateral to or perpendicular to the firing axis of the barrel of the firearm. In either case, the lateral transfer of momentum substantially reduces the reactive recoil forces.

In another particular embodiment, the invention comprises a mobile breech made up of articulated parts including an inertia block and a bolt head. In this embodiment, the action of the mobile breech is unconventional in that it causes the inertia block to alternate out of and into alignment with the longitudinal axis of the barrel. This is contrary to the action of conventional mechanisms in which the parts that compose a mobile breech move in translation along the longitudinal axis of the barrel. The present invention transfers the recoil forces generated by firing to the inertia block, M, by means of a bolt head, m, moving backward at an initial velocity, $v_i$. In a particular aspect of the invention, for example, this transfer of recoil forces from the bolt head to the inertia block is preferably made using corresponding angled surfaces of the bolt head and the inertia block. An impulse transferred to the inertia block translates to a force in a direction other than along the longitudinal axis of the gun barrel thanks first to the configuration of the contact surfaces, and second to the articulated parts connecting to the inertia block, and third the path that guides the movement of the inertia block. The inertia block is thus imparted with a momentum, $Mv_M$, and the velocity vector, $v_M$, has a component parallel to the longitudinal axis of the gun barrel, oriented toward the back or front of the weapon, while the other component is oriented in a lateral direction from the axis of the gun barrel, either below or above the weapon.

Thus, the mobile breech comprises an inertia block that operates to transfer momentum or forces generated by the firing of one or more cartridges or rounds of ammunition to a direction outside of the longitudinal axis of the gun barrel. An a more basic aspect, the inertia block is a component part of a firearm, or more particularly a mobile breech, that moves in response to the force of firing and/or moves in response to the movement of a bolt head. The inertia block or masses allows for the absorption of recoil forces and directs those forces in the form of momentum in a direction outside the longitudinal axis of the barrel. Throughout this disclosure, the use of the term "inertia block" can refer either to a single or to multiple parts or masses. The component masses of the inertia blocks may optionally serve additional functions, such as providing armor protection to or housing components for gun or cannon emplacements equipped with the present invention. Furthermore, the terms "bolt" and "bolt head" are used interchangeably.

In a system where the bolt head absorbs the recoil forces directly through contact with the spent casing of the cartridge, the bolt head is imparted with a rearward momentum along the longitudinal axis of the barrel. When the inertia block moves in response to the movement of the bolt head, the bolt head impulsively strikes the inertia block, either directly or through a linkage, and the momentum of the bolt head is then transferred to the inertia block. The bolt head is typically of significantly smaller mass than the inertia block or blocks. Because of the relative masses of the bolt head and inertia block, the inertia block will move with a different velocity than the bolt head.

An aspect of the present invention is the use of inertia block guides to constrain the movement that the inertia block follows to a direction other than along the longitudinal axis of the barrel, thereby transferring the recoil forces out of the axis of the gun barrel and reducing the reactive jerking described above. Alternately, the initial impulse on the inertia block or blocks may be driven not by direct mechanical connection to the bolt head, but by a gas injection system. In that case, the expanding gases created by the firing of one or more cartridges are used to pressurize a gas injection system and the pressure is selectively applied to the inertia block or blocks to cause their movement in a direction other than along the longitudinal axis of the barrel. In any embodiment, the inertia block or blocks serve the same basic function—to absorb recoil forces and/or re-direct recoil forces out of the longitudinal axis of the barrel.

The path of the inertia block in response to the recoil impulse leaves the longitudinal axis of the gun barrel, thereby translating recoil forces out of this axis. Part of the space occupied by the inertia block during its back and forth trajectory can be located below the axis of the gun barrel, while the rest of the trajectory of the inertia block in its alternating action, as well as the corresponding part of the breech block, can be situated above the barrel axis.

The inertia block can move along a path defined by its guide. The guide can be a slot in a part of the firearm, or can be a rod or articulated part, or any other component designed to allow the inertia block to move back and forth from a loaded position to an end point of its movement. An inertia block guide can be configured so that the movement of the inertia block in response to the impulse can comprise a rotation or can be one of pure translation or the movement can be more complex in nature. In other words, there can be a direct connection possible between the bolt head and the inertia block that causes the movement of the inertia block to move along its guide, or there can be a simple linkage, such as a pin rod, or there can be more complex linkages, such as multiple rods and/or articulated parts. In a preferred embodiment, the displacement of the inertia block is an alternating pivot movement around a pivot. The inertia block's movement in turn governs the movement of the bolt head and/or vice versa, due to the manner of their linkage.

In one aspect, a phase displacement can be achieved by engineering the linkage between bolt head and inertia block with a slight play, for example in the longitudinal direction. In another aspect, the phase displacement can be achieved through a delay in the direct contact of the bolt head with the inertia block enabled by the shape or configuration of the contact surfaces. The degree of phase displacement is a matter of design option, but some phase displacement is preferred.

The recoil moment can be further controlled or managed through the positioning of the barrel of the weapon relative to the grip or stock of the weapon. For example, a conventional handgun grip can be placed behind a breech block of the present invention. In certain embodiments of the invention, the axis of the barrel is not found above the grip, as it is conventionally in handguns, but in front of it, typically at mid-height or at two-thirds the height of the grip. Preferably, the gun barrel axis is in line with the forearm of the person aiming the gun and not above it, the effect of which is to eliminate the upward jerking characteristic of the recoil response of conventional guns. However, one can design embodiments of the invention where the barrel can be placed below the grip or stock, above the grip or stock, or at any height relative to the grip or the stock. In combination with the use of one or more inertia blocks, a number of improvements in design, weight, accuracy, and recoil characteristics are possible.

The recoil control device's components can be advantageously prepared with comparatively large parts or large diameter spindles or rods, which simplifies manufacture. This advantage of the present invention greatly improves the reliability in service and the resistance to jamming by sand, mud, and other environmental contaminants and simplifies cleaning and dismantling of the firearm.

The mechanisms and aspects of the invention can be used to complement or improve existing or conventional firearms and can be combined with various arrangements, attachments, and combinations, including without limitation internal release systems, loading systems, ejection systems, gas injection systems, recoil reduction systems, muzzle brakes, sighting systems, tripods, mounting systems, and firing mechanisms.

In one general aspect, the invention comprises an improved and novel recoil control device for use in a firearm, such as a semiautomatic or automatic firearm, in which, for example, a bolt head is configured to alternate between a forward position and a rearward position in response to the firing of one or more cartridges; and an inertia block is connected to the bolt head such that the bolt head imparts an impulse to the inertia block as it alternates between its forward position and its rearward position, the impulse having a component, or force distribution or vectorial force component, lateral to the firing axis of the barrel of the firearm. The force transferred to the inertia block can be in any one of several directions and the inertia block can therefore traverse one of a variety of paths from the impulse imparted through the bolt head, including, but not limited to: a downward sloping, straight path toward the anterior of the firearm; a path comprising a rotation; a curved or curvi-linear path; a path extending outward from the barrel; a path moving inward toward the barrel; and a path crossing over the barrel. The path chosen relates to the design characteristics of the firearm desired.

Similarly, the inertia block or mass appropriate for a particular firearm relates to the design characteristics of the firearm. In one embodiment, the inertia block comprises a sloped or angled surface, or a leading sloped surface, that can be contacted by the bolt head to transmit the impulse from firing. In other embodiments, the inertia block comprises a part or parts that reciprocates between two or more positions and moves in response to the impulse from the bolt head. Multiple inertia blocks can also be used so that they move together in response to the bolt head. In another preferred embodiment, the recoil control device of the present invention can be incorporated into heavy caliber firearm and cannon mechanisms. For example, a heavy caliber rifle, such as a vehicle-mounted rifle or portable rifle of between 0.50 caliber and 105 mm, or even higher as in a 155 mm cannon, can be produced with an inertia block to translate forces out of the axis of the barrel.

The transfer of the impulse of percussion from the bolt head to the inertia block can be through direct contact between the two parts or through a simple or even a complex linkage. In one embodiment, one or more pin and rod assemblies are used. In another embodiment, a pin connected to the bolt head moves within a slot connected to the inertia block. In other embodiments, one or more reciprocating rods connect the bolt head to the inertia block.

For most firearms of the invention, the inertia block and bolt head are designed to automatically return to their resting or chambered position. A variety of mechanisms can be used to move the bolt head and/or inertia block in the return path. A preferred embodiment employs a spring operably connected to or contacting the inertia block, which can be referred to as the return spring. A variety of spring types can be adapted for this purpose. Alternative return or recovery mechanisms can be designed by one of skill in the art.

The recoil control device can be manifested as in one of the numerous Figures accompanying this disclosure. Also, numerous embodiments and alternatives are disclosed in the accompanying claims. In another aspect, the invention provides a method for making a recoil control device of the invention and/or incorporating into a firearm a recoil control device comprising one or more inertia blocks operably connected to a bolt head, or moving in response to other forces, in order to move in a manner that directs momentum outside of the longitudinal axis of the barrel.

Other embodiments and advantages of the invention are set forth in part in the description that follows and, in part, will be obvious from this description, or may be learned from the practice of the invention.

BRIEF DESCRIPTION OF THE DRAWINGS

For a more complete understanding of the invention and some advantages thereof, reference is now made to the following descriptions taken in connection with the accompanying drawings in which:

FIG. 43 also shows a trigger (507) and trigger mechanisms connecting the trigger action to the firing mechanism. In this view, hammer (502) has been cocked, for example, by pulling manual cocking lever (520), and a cartridge is chambered.

FIG. 44 shows a cartridge chambered and the hammer (502) cocked.

FIG. 45 shows the configuration of parts just after firing, where bolt (501) has moved onto secondary sloped surface (512) of slider (510), and slider has begun movement downward.

FIG. 46 shows the configuration of parts at the end (518) of the slider movement downward. The spent cartridge case is ejected.

FIG. 47 shows the slider (707) before firing, positioned above the barrel and in front of the bolt (701).

FIG. 48 shows the slider at the end of its movement and positioned to be returned by return device (708).

FIGS. 52 and 53 show the movement in response to the percussion, where a bolt head and rod act upon the downward sliding inertia block. FIGS. 53 and 54 show the ejection of the spent cartridge and compression of the return spring as the sliding inertia block moves. FIG. 55 shows the end of the downward movement of the inertia block. FIG. 56 shows the reciprocating inertia block returning to the loaded position through the action of the compressed return spring, and where the bolt head catches and begins to chamber a fresh round. FIG. 57 shows the inertia block and bolt head near its completed return. FIG. 58 again shows the loaded cartridge and bolt head and inertia block in complete rest or passive attitude.

FIG. 61 shows, in longitudinal cutaway, the loading of a semiautomatic or automatic handgun, as the cartridge is in position to be chambered.

FIG. 62 shows the firearm of FIG. 61 in closed or loaded configuration, a cartridge chambered.

FIG. 63 shows the firearm of FIG. 61 after firing, the bolt head at the beginning of its backward, recoil movement.

FIG. 64 shows the firearm of FIG. 61 with inertia block (slider) at the end of its movement, the spent cartridge being ejected.

FIG. 65 shows the firearm of FIG. 61 during the return movement of the mobile breech and the loading of the next cartridge from the magazine.

FIG. 66 shows the firearm of FIG. 61, with the loading cycle concluded, ready to fire.

FIG. 67 shows, in longitudinal cutaway, a device with a cartridge (D) chambered.

FIG. 68 shows the embodiment of FIG. 67 at the moment of firing.

FIG. 69 shows the embodiment of FIG. 67 at the end of the movement, the spent cartridge case being ejected. The slider surface shown here (208*a*) depicts an additional embodiment, for example, to allow a phase displacement. As explained herein, the surface or surfaces of the slider that contact the bolt or are linked to the movement of the bolt can be selected from a number of angles, shapes, and combinations of angles and shapes.

DETAILED DESCRIPTION OF THE INVENTION

Figure 1:
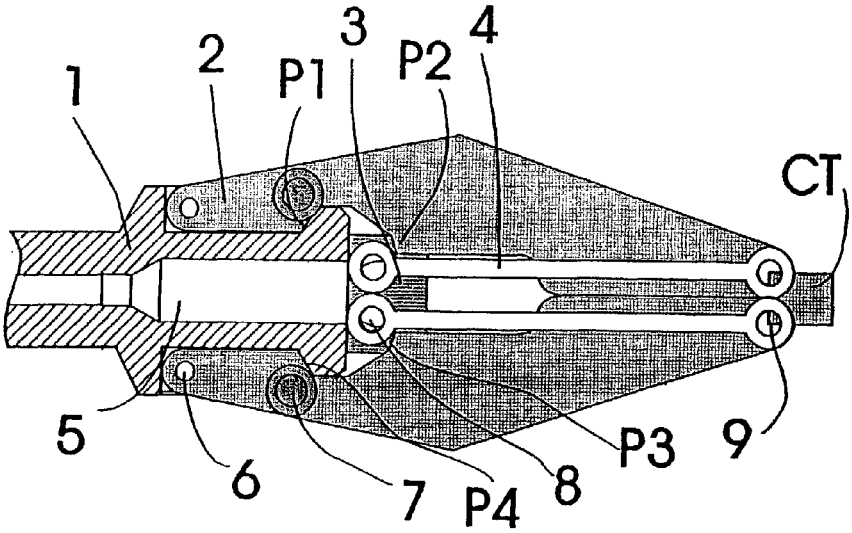
FIG. 1 shows a preferred embodiment of the recoil control device at complete rest or in passive attitude. The device comprises two inertia blocks and can be used in particular with a heavy automatic firearm.

Whether for smaller caliber handguns or rifles, in other words pistols, machine pistols and assault rifles, or for the preferred embodiments of heavy caliber rifles, machine guns, or cannons, the present invention advantageously reduces the consequences of recoil and/or eliminates, for all practical purposes, the weapon's reactive jerking and permits a more compact and lighter weapon for a given caliber ammunition.

Where heavy firearms are concerned, for example, machine guns and cannons, notably machine guns for land, watercraft, or airborne platforms, the present invention enables a lighter frame for the weapon and a more compact and therefore more stowable or containable weapon. This allows moveable weapon systems to store more ammunition per sortie. Further, this invention enables a simplified construction for the base by diminishing the recoil tendency and dampening the stress acting upon the platform as a whole. This is especially advantageous when composite materials are used for the vehicles or craft carrying the weapons.

In one particular embodiment, the invention comprises a mobile breech made up of connected parts that comprise an inertia block and a bolt head. In this embodiment, the action of the mobile breech is unconventional in that it causes the inertia block to alternate out of and into alignment with the longitudinal axis of the barrel. This is contrary to the action of conventional mechanisms in which the parts making up a mobile breech move in translation along the axis of the barrel. The present invention translates forces generated by the recoil to the inertia block, M, in the instant following firing. This transfer of recoil forces from the bolt head, m, moving backward at an initial velocity, $v_i$, to the inertia block is preferably made via contact between corresponding angled surfaces of the bolt head and inertia block. The impulse transferred to the inertia block translates to a force in a direction other than along the axis of the gun barrel. The configuration of the contact surfaces allows the articulated parts to guide the inertia block. The inertia block is thus imparted with a momentum, $Mv_M$, and the velocity vector, $v_M$, has a component parallel to the axis of the gun, toward the back of the weapon, and a component perpendicular to the axis of the gun.

Terms such as "under," "over," "in front of," "the back of the gun," or "behind," "anterior," "posterior," or "transverse," are used here as somebody firing a gun would understand them, which is by reference to the longitudinal or firing axis of the barrel when the gun is held in the usual horizontal attitude. Furthermore, "firearm" as used here encompasses handguns, pistols, heavy caliber guns, rifles, sniper rifles, guns with automatic and semiautomatic action, mountable and portable cannons, cannons mounted on aircraft or naval vessels, cannons mounted on armored personnel carriers or other armored vehicles, and machine guns or cannons mounted on armored or non-armored vehicles or vessels. Also, a force component perpendicular to or lateral to the longitudinal axis of the barrel refers to a vectorial component or part of a force or momentum vector directed outside the longitudinal axis of the barrel.

Inertia block guides can be configured so that the movement of the inertia block in response to the impulse can be one of pure translation or more complex in nature. The inertia block's movement, in turn, governs the movement of the bolt head or vice versa, due to the manner of their linkage.

In one aspect, the present invention in particular allows two parameters to be varied: the ratio between the mass of the inertia block and the bolt head, and the angle between movement of the inertia block and the axis of the-gun. Control or variance of such variables is not typical of present firearms technology. The recoil control device notably enables construction of automatic firearms of particular compactness for their caliber.

The positioning of the barrel of the weapon relative to the grip or stock of the weapon can effectively allow one to manage part of the recoil moment. For example, a conventional handgun grip can be placed behind a breech block of the present invention. In one embodiment of this invention, the barrel is not found above the grip, as it is conventionally in handguns, but in front of it, preferably at mid-height or at two-thirds the height of the grip. Preferably, the gun barrel axis is in line with the forearm of the person aiming the gun and not above it, the effect of which is to eliminate the upward jerking characteristic of the recoil response of conventional guns.

Other characteristics and advantages of the invention will be apparent to those skilled in the art from the description of embodiments designed specifically for handguns and of embodiments designed for heavy automatic weapons and cannons.

Exemplary Small Caliber Firearms and Handguns

The following discussion addresses optional features and design factors one of ordinary skill in the art may employ in producing a smaller caliber firearm. Nothing in this discussion should be taken as a limitation to the scope of the invention and the parameters defined here are merely examples of the many embodiments possible. While the optional features and design factors of the smaller caliber firearm noted here can also be used with heavy caliber firearms, typical firing conditions may make the discussion below more appropriate for smaller caliber firearms.

A variety of configurations can be used to produce a recoil control device in small caliber firearms. As noted above, the preferred embodiment comprises a bolt head operably linked to an inertia block so that the bolt head imparts an impulse to the inertia block upon firing the firearm. In the small caliber embodiment, the inertia block can be referred to as a "slider" since it can be designed and produced as a sliding mechanism that travels in a fixed path. The selection of the weight, shape, and path of the slider will depend on a number of design factors, including, but not necessarily limited to: the desired placement of the barrel relative to the handgrip or stock, the part of the frame that is stabilized by a person firing the firearm, or the part of the frame connecting the firearm to a tripod or other support device; the degree of recoil reduction or counteracting of the upward jerking recoil forces desired; the barrel length; the weight of the bolt head; the weight of the firearm; the presence or absence of a muzzle brake; and, of course, the ammunition used in the firearm. One of skill in the art can routinely measure the recoil characteristics of any selected design in order to modify one or more of the design factors noted here to achieve a particular result.

For any particular path for the slider, for example, the weight can be designed to effectively eliminate the upward jerking recoil forces. In a simple and preferred design, a single slider with a slider path is chosen, where the slider path forms a straight line downward from the barrel at a certain angle (referred to as β in FIG. 60, for example) relative to the longitudinal axis of the barrel, in preferred embodiments for a 0.45 caliber firearm set between 30 and 36 degrees. A second angle (referred to as α in FIG. 59, for example) is formed by the slider path and the sloped surface of the slider that initially contacts the backward-moving bolt or linkage to the bolt. This angle can be varied to select an optimum firing rate of the firearm. In an embodiment of the Figures, an oblique slot is designed to accept a transverse spindle or pin that connects the bolt head to the slider to impulsively transfer the recoil forces in a direction lateral to the longitudinal axis of the barrel. The optimum value for this second angle depends primarily on the caliber of firearm chosen. Angles less than six degrees result in mechanical limitations to the unassisted movement of the slider in reaction to the bolt head. Angles greater than 45 degrees will reduce the effectiveness of the counteracting forces that control the upward jerking movement, but can be selected nonetheless. An angle ranging from about 36 to about 37 degrees allows a firing rate of approximately 900 rounds per minute with 0.45 caliber ammunition. Preferred ranges of this angle can be selected from about 20 degrees to about 45 degrees. As noted herein, the slider can comprise a double-angle configuration, so that an initial angled surface contacts the bolt or linkage to the bolt, while a second angled surface contacts the bolt or bolt linkage for a majority of the contact area. It is the angle of the initial angled or sloped surface that is used to calculate the angle $\alpha$ (alpha) in the invention. Generally, one will select a higher angle (i.e. an angle closer to a perpendicular line from the gun barrel) of this initial angle of the slider with a high energy round. Some rounds, for example 9 mm rounds, may not use a double-angle configuration in the slider or may use an initial angle that is parallel or close to parallel to the gun barrel in order to generate more speed to transfer recoil energy from the bolt to the slider. The shape of the surface or surfaces of the slider can also vary, so that rounded areas, angled surfaces, or combinations of the two, for example, can be selected. Thus, depending on desired product features, a straight slider path and an unassisted slider movement, a preferred angle can be selected from an angle greater than 6 degrees to an angle of less than about 40 or about 45 degrees. As described below, a double-angled slider with two slopes in the slot of the slider alternatively can be used to allow the designer to vary the rate of fire and to reduce the mass of the slider for a given caliber ammunition. Also, a decreased weight of the bolt can increase firing rate.

Preferably, the slider path is concealed within the body of the firearm in a part or mechanism that can be referred to as a "guide," "receiver," or "path." Whether or not concealed, the guide can be designed so that the slider can be fit into the slider path and linked to the bolt head by hand, to facilitate cleaning and maintenance of the firearm. While not required, a linking part can be used to translate the impulse from the percussion of a chambered round from the bolt head to the slider. A simple pin and/or rod can be used, for example. Preferably, some play in the movement of the slider can be designed in either the selection of the linking part or its connection to the slider or the bolt head. This play can facilitate the rapid removal of spent rounds and/or loading of new rounds. The recoil spring can also be selected for a particular slider weight and rate of fire characteristics desired. One of skill in the art can determine the type of spring configuration or slider return device for a particular embodiment.

Of course, a firearm incorporating or using the devices or methods of the invention can also be combined with any known firearm modification or control devices or systems available. For example, a counterpoise system can be used, a muzzle brake, recoil pads, and gas injection systems can be incorporated into a design, either individually or in any combination. In comparison to alternative or previous recoil control devices, such as the counterpoise or any of a number of spring systems on handguns and rifles, the recoil control mechanism of this invention provide vastly improved characteristics. A direct comparison of the upward movement of the end of the gun barrel after firing a high powered 0.45 caliber round shows that the firearm incorporating the invention results in very little or no measurable upward movement. This result is also demonstrated by the pattern of rounds into a target in automatic firing, where there is no upward drift when the mechanisms or methods of the invention are used. A conventional firearm displays marked and measurable upward movement of the barrel on firing. Existing recoil control devices can perhaps reduce recoil to a level equivalent to a muzzle brake. The improvement afforded by the devices and methods of the invention are significantly greater. For example, about a 50% reduction in recoil as measured by upward movement of the barrel, or about 50-60% reduction, or about 60-70% reduction, or about 70-80% reduction, or about 80-90% reduction, and even, depending on the design, a 90-100% reduction in upward movement upon firing.

Exemplary Heavy Caliber Firearms

The following discussion addresses optional features and design factors one of skill in the art may employ in producing a heavy caliber firearm. Nothing in this discussion should be taken as a limitation to the scope of the invention and the parameters defined are merely examples of the many embodiments possible. While the optional features and design factors of the smaller caliber firearm noted above can be used with heavy caliber firearms, typical firing conditions may make the discussion below more appropriate for heavy caliber firearms.

As the size of the ammunition increases, the percussive forces and momentum generated will also increase. Thus, the optimum weight of the bolt head and inertia block will similarly increase. One design option noted in the Figures for large caliber firearms and cannons is the use of multiple inertia blocks. These inertia blocks can be connected to the same bolt head, or each connected to a separate bolt head. The one or more guides, in particular pivot guides or pivot pins, for the inertia block(s) can be configured to move back and forth in a number of directions. In preferred embodiments, the movement traverses the longitudinal axis of the gun barrel by placement of the inertia block above the gun barrel. In another preferred embodiment, the movement of the inertia blocks extends out from the side of the gun barrel.

The initial impulse on the inertia block can be imparted by the use of gas pressure from the barrel, commonly referred to as gas injection. The expanding gases created by firing of one or more cartridges are used to pressurize a gas injection system and the pressure is selectively applied to the inertia block or blocks to cause their movement in a direction other than along the longitudinal axis of the barrel. The gas injection components can also be combined with a muzzle brake to control the pressure build-up in the gas injection system and -to further address the recoil forces.

Preferably a pair of inertia blocks of substantially equal mass are oriented such that their respective movements in response to firing will be synchronized, equal in magnitude, and with corresponding but opposite components of momentum perpendicular to the longitudinal axis of the barrel. The net effect is for the perpendicular components of the momentum of the inertia blocks to cancel each other and to impose no net lateral force or agitation on the weapon. Thus, a portion of the recoil forces are transferred in a direction perpendicular to the longitudinal axis of the barrel and effectively cancelled out, thereby significantly reducing or even eliminating the component of recoil forces along the longitudinal axis of the barrel that are responsible for the reactive jerking of the weapon. The longitudinal component of the momentum of the inertia blocks can be directed forward along the axis of the barrel to counteract any residual recoil forces in the longitudinal direction. In the present invention, the mass of the inertia blocks and the magnitude of their displacement can be varied to optimally reduce the reactive jerking of the weapon as well as to vary the firing rate of the weapon.

Exemplary Embodiments in the Figures

Whether for handguns or rifles, in other words pistols, machine pistols and assault rifles, the present invention advantageously reduces the consequences of recoil and/or eliminates, for all practical purposes, a weapon's reactive jerking and permits a more compact weapon for a given caliber ammunition.

Where heavy firearms are concerned, for example machine guns and cannons, notably machine guns for land, water craft, or airborne platforms, the present invention enables a lighter frame for the weapon and a more compact and therefore more stowable or containable weapon. This allows moveable weapon systems to store more ammunition per sortie. Further, this invention enables a simplified construction for the base by diminishing the recoil tendency and dampening the stress acting upon the platform as a whole.

In one particular embodiment, the invention comprises a mobile breech made up of connected parts that comprise an inertia block and a bolt head. In this embodiment, the action of the mobile breech is unconventional in that it causes the inertia block to alternate out of and into alignment with the longitudinal axis of the barrel. This is contrary to the action of conventional mechanisms in which the parts making up a mobile breech move in translation along the axis of the barrel. The present invention translates forces generated by the recoil to the inertia block, M, by means of a bolt head, m, moving backward at an initial velocity, $v_i$, in the instant following firing. This transfer of recoil forces from the bolt head to the inertia block is preferably made via contact between corresponding angled surfaces of the bolt head and inertia block. The impulse transferred to the inertia block translates to a force in a direction other than along the axis of the gun barrel. The configuration of the contact surfaces allows the articulated parts to guide the inertia block. The inertia block is thus imparted with a momentum, $Mv_M$, and the velocity vector, $v_M$, has a component parallel to the axis of the gun, toward the back of the weapon, and a component perpendicular to the axis of the gun.

Terms such as "under," "over," "in front of," "the back of the gun," or "behind," "anterior," "posterior," "downward," "upward," or "transverse," are used here as somebody firing a gun would understand them, which is by reference to the longitudinal or firing axis of the barrel when the gun is held in the usual horizontal attitude. Furthermore, "firearm" as used here encompasses handguns, pistols, heavy caliber guns, rifles, sniper rifles, guns with automatic and semiautomatic action, mountable and portable cannons, cannons mounted on aircraft or naval vessels, cannons mounted on armored personnel carriers or other armored vehicles, and machine guns or cannons mounted on armored or non-armored vehicles or vessels. Also, a force component perpendicular to or lateral to the longitudinal axis of the barrel refers to a vectorial component or part of a force or momentum vector directed outside the longitudinal axis of the barrel.

Inertia block guides can be configured so that the movement of the inertia block in response to the impulse can be one of pure translation or more complex in nature. The inertia block's movement in turn governs the movement of the bolt head or vice versa, due to the manner of their linkage.

In one aspect, the present invention in particular allows two parameters to be varied: the ratio between the mass of the inertia block and the bolt head, and the angle between movement of the inertia block and the axis of the gun. As discussed more particularly below, the angles formed by parts of the mobile breech can be manipulated to optimize recoil reduction, firing rate, and other operational characteristics in a variety of firearm styles and sizes. Control or variance of such factors is not typical of present firearms technology. The recoil control device notably enables construction of automatic firearms of particular compactness for their caliber.

As shown in some of the embodiments of the Figures, the trajectory of the inertia block leaves the longitudinal axis of the gun barrel. In one of many optional configurations, part of the space occupied by the inertia block during its back-and-forth trajectory is located below the gun barrel, while the rest of the trajectory described by the inertia block in its alternating action, as well as the corresponding part of the breech block, is situated above the barrel axis.

The positioning of the barrel of the weapon relative to the grip or stock of the weapon can effectively allow one to manage part of the recoil moment. For example, a conventional handgun grip can be placed behind a breech block of the present invention. In one embodiment of this invention, the barrel is not found above the grip, as it is conventionally in handguns, but in front of it, preferably at mid-height or at two-thirds the height of the grip. Preferably, the middle of the gun barrel axis is in line with the middle of the forearm of the person aiming the gun and not above it, the effect of which is to eliminate the upward jerking characteristic of the recoil response of conventional guns. As described in this invention, the placement of the barrel relative to the height of a grip, if a handgrip is used, can vary, but it is preferably placed at about 5% to about 95% of the height of the grip, or about 40% to about 80%, or about 50% to about 70%, or about 60% to about 70%. As stated herein, any particular configuration of the axis of the barrel relative to the grip or stock can be selected.

For semiautomatic or automatic handguns and/or rifles, the present invention preferably uses the handgrip as part of the housing for the inertia block and return device or spring, and this arrangement. substantially eliminates the upward jerking of the gun from recoil. However, as shown in the Figures and described here, embodiments of the invention encompass heavy and light machine guns and cannons as well as handguns. Thus, handgrips are not required.

Other characteristics and advantages of the invention will be apparent to those skilled in the art from the description of embodiments designed specifically for handguns and of embodiments designed for heavy automatic weapons and cannons.

FIG. 1 shows the rear of a gun barrel (1) and chamber (5). The bolt head (3) is in contact with the rear opening of the barrel.

Figure 2:
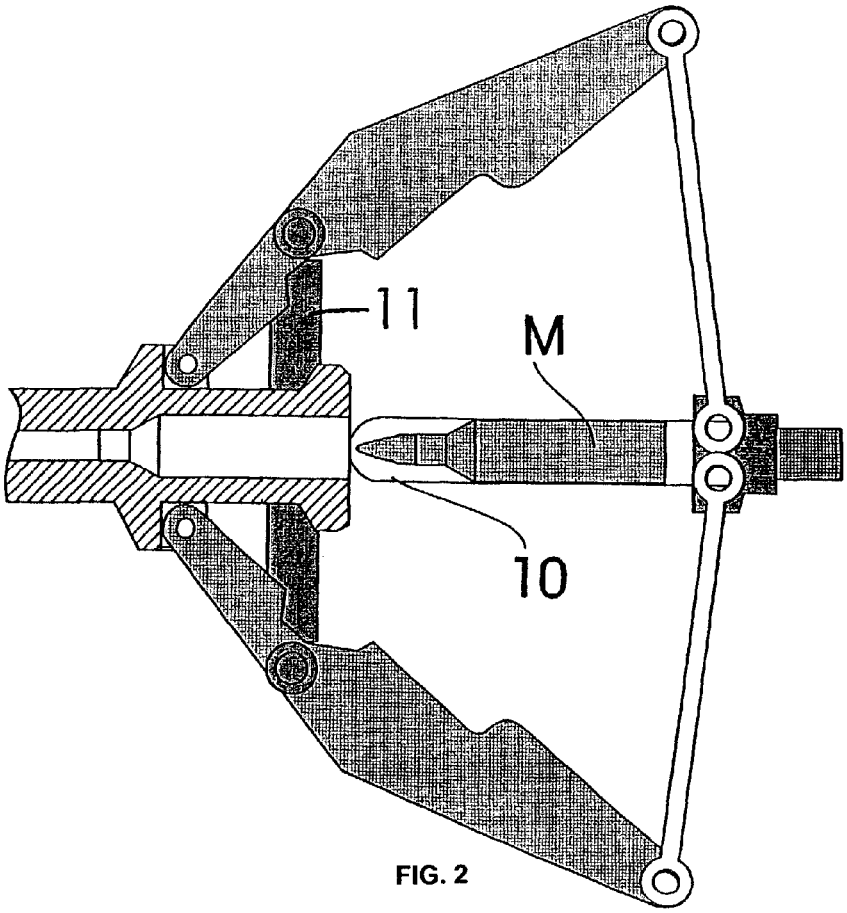
FIG. 2 shows the embodiment of FIG. 1 retracted, near the point of loading a cartridge.

FIGS. 1 and 2 show two pin rods (4), each articulated at one end to bolt head (3) by means of one of two spindles (8) oriented perpendicular to the longitudinal axis of the barrel. Each of the two pin rods (4) is articulated at its opposite end by means of a transverse spindle (9) with a first end of one of two inertia blocks (2) placed symmetrically in relation to the axis of the barrel.

As illustrated in FIGS. 1 and 2, each of the inertia blocks are articulated at their opposite ends to the chamber (5) via one of two transverse spindles (6).

The spindles (6) preferably are flexibly connected via elastic joints. Alternately, spindles (6) may be articulated with the chamber by placement in an oblong groove parallel to the axis of the barrel, which allows the spindles a limited translation in the longitudinal direction to facilitate the motion of the inertia blocks.

As shown in FIG. 1, the bolt head (3) preferably has two sloped surface portions (P3), oblique to the axis of the barrel, which are in contact with two conjugated surface portions (P2) on the inertia blocks with corresponding slopes. Each of the inertia blocks (2) preferably presents a second portion of its surface at slope (P1), which comes into contact with a portion of the surface of the gun barrel's chamber (5) affording a conjugated slope (P4), which results in a ramp providing the means for the inertia block to move out of the axis of the barrel.

Each inertia block (2) preferably bears a rotational axis about spindle (6), which is linked with a recovery mechanism (11) at spindle (7). The recovery mechanism is preferably a spring as shown, for example, in FIG. 2.

Figure 4:
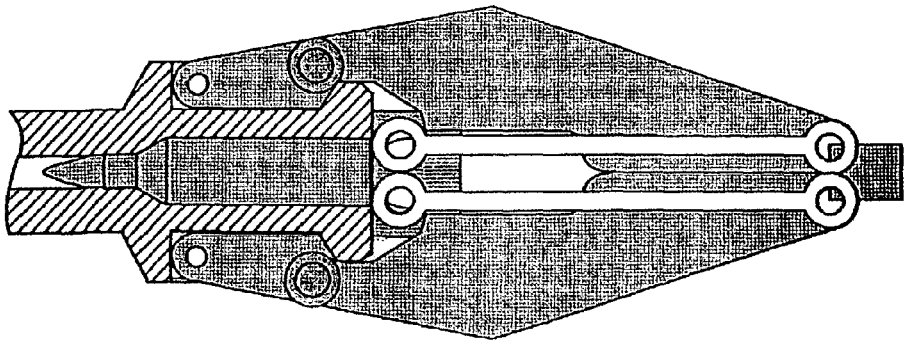
FIG. 4 shows the embodiment of FIG. 1 in a closed position with cartridge chambered.
Figure 5:
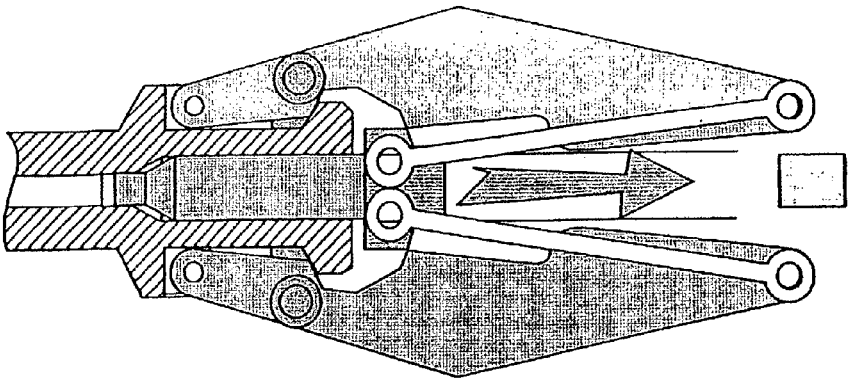
FIG. 5 shows the embodiment of FIG. 1 after firing at the start of backward movement of the bolt head.
Figure 6:
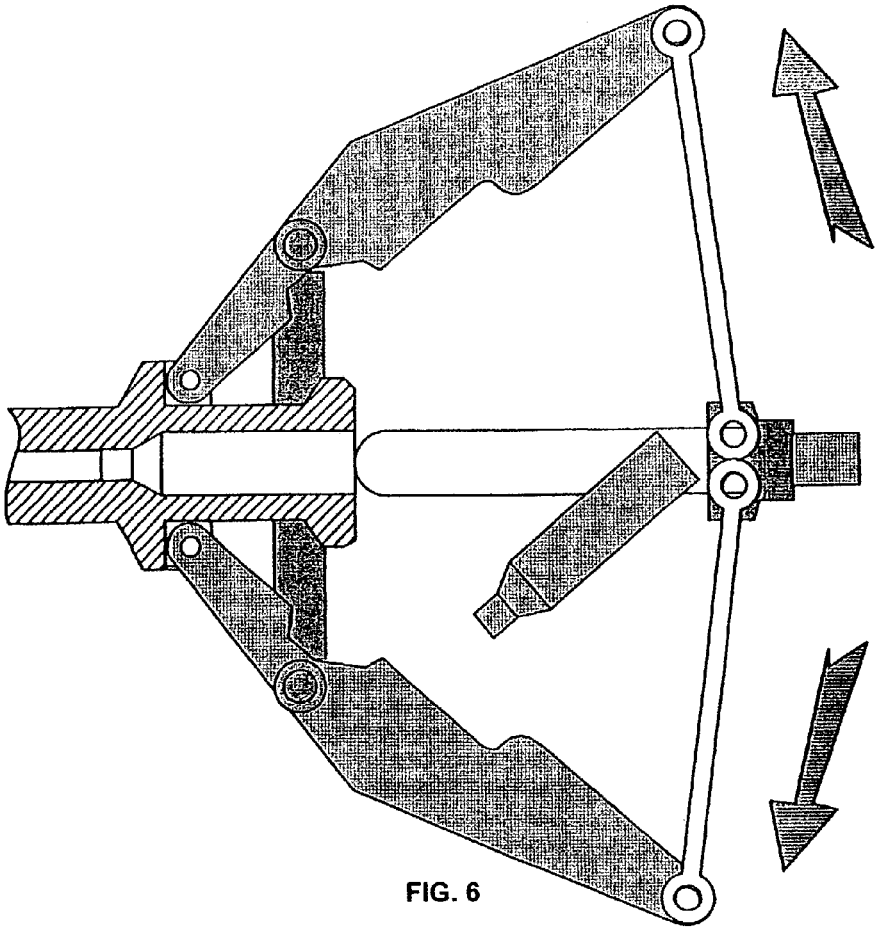
FIG. 6 shows the embodiment of FIG. 1 at the end of its movement backward, spent cartridge being ejected.

FIG. 4 shows a cartridge in the chamber ready to fire. The firing mechanism itself is not shown for simplicity. Immediately after firing, the bolt head (3) is forced backward by the base of the cartridge M, as shown in FIG. 5. The slopes (P3) at the bolt head (3) push the two inertia blocks (2) having slopes (P2). The blocks themselves exert force through slopes (P1) acting in contact with slopes (P4) on the chamber of barrel (1). Under the foregoing forces, the inertia blocks (2) translate slightly backwards, within the limit of play of the spindles (6), as seen in FIG. 5. This translation combines with and leads to two divergent rotational movements about the same spindles (6), as shown in FIG. 6. The outward motion of inertia blocks (2) forces a backward translation of bolt head (3) along the axis of the barrel via pin rods (4), which leads to the ejection of the exploded shell. Pin rods (4) function to pull and push the bolt head (3) in an alternating movement fundamental to the mechanism. The spindles (9) of the pin rods (4) preferably are attached to inertia blocks (2) via flexible joints or in oblong grooves to facilitate function appropriate to ammunition diameter. A longitudinal guide-track (10), which lines-up, as shown in FIG. 2, with the opening of an ammunition clip or magazine, completes the guidance of the bolt head (3).

The mechanism for extracting and ejecting the empty cartridge case M, not shown, may be of any design known in the art. An electromechanical or electropneumatic or other suitable triggering mechanism, CT, to govern the triggering or blocking functions, may be positioned at the rear extremity of the track for the bolt head. When the bolt head (3) reaches the end of its rearward movement, the mechanism is in the open position as shown in FIGS. 6 and 2. The pin rods (4) are in mechanical opposition, inducing a blocking of the movement, the return spring (11) being under tension. The bolt head is thus restrained from returning to the pre-firing position under the influence of recovery mechanism (11). Release of the mechanism is governed by an impulse generated by triggering mechanism CT that may consist of no more than a simple force exerted for a few millimeters at the back of the bolt head (3) in order to displace pin rods (4) forward from their locked position. Once the pin rods (4) are unlocked, the inward force exerted on inertia blocks (2) by the recovery mechanism acts through pin rods (4) to move the bolt head forward towards its pre-firing position.

FIG. 2 shows the succeeding cartridge at the point of being loaded.

Figure 3:
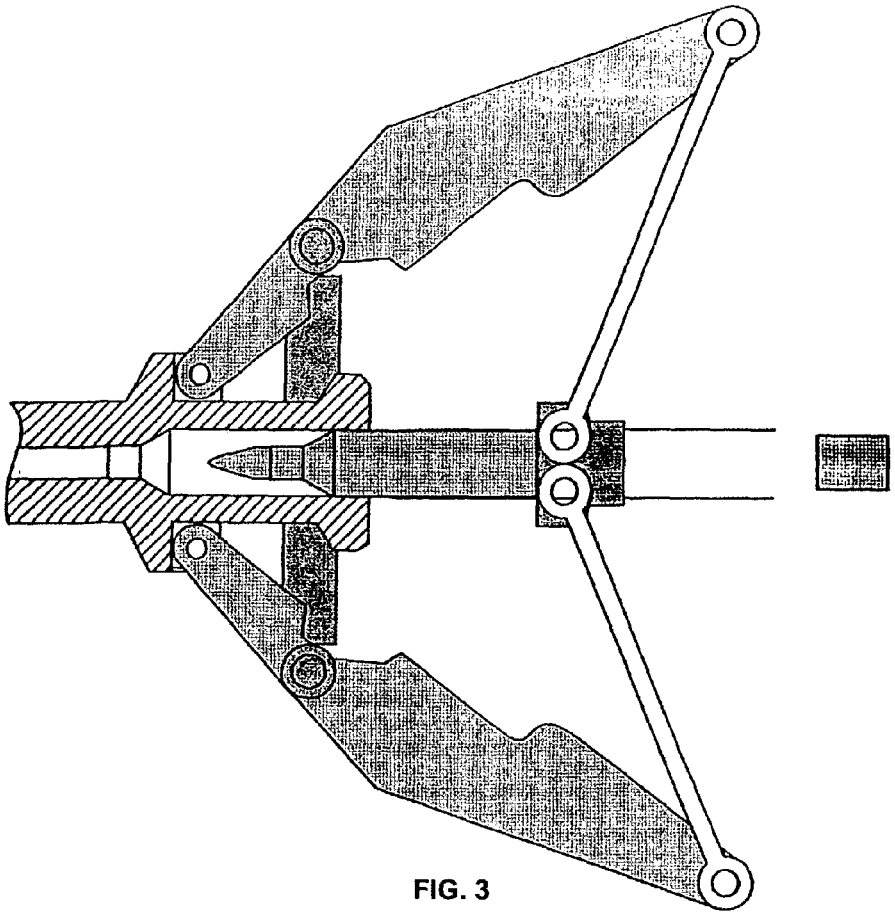
FIG. 3 shows the embodiment of FIG. 1 in the process of loading a cartridge.

FIG. 3 shows the return forward of the bolt head under spring tension. Its movement, in the usual manner, pulls the cartridge into the chamber as shown in FIGS. 3 and 4.

The triggering mechanism CT for the return movement forward of the bolt head enables precise, efficient control of the firing rate. Similarly, once propelled by the initial impulse given by the bolt head, the inertia blocks (2) pivot about the spindles (6), linked with the chamber (5).

A further advantage of the present invention is derived from the simplicity of its design, which reduces weight. The embodiment of FIGS. 1-6 further enables a considerable weight reduction by rendering superfluous most of the parts customary to the frame of a gun, which, in conventional blowback mechanisms, provide for guidance. It facilitates thus a "frameless" heavy weapon, which, for certain firearms, notably those on airplanes, provides a considerable benefit.

It should also be noted, as in FIGS. 2 to 6, that the flexing of the inertia blocks occurs in symmetry, with the inertia blocks in counter-torque and synchronized, to prevent agitation of the gun frame.

Figure 7:
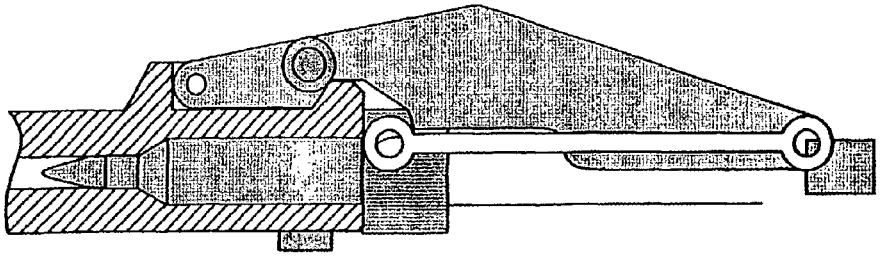
FIG. 7 shows another preferred embodiment of the recoil control device, in this case with a mechanism having only one inertia block.

FIG. 7 shows another preferred embodiment of the recoil control device. Here, the mobile breech has only one inertia block (2) and only one pin rod (4) attached to the bolt head (3). The linkages for bolt head, pin rod, inertia block and rear section of the gun barrel are identical to the embodiment of FIGS. 1-6. The action is also the same except that the return spring acting on the inertia block is fixed at its other extremity to the back of the barrel and not to a second block. This variant is suitable for a military rifle and machine gun. The recoil control device is placed in the weapon so that the inertia block rotates vertically. The inertia block therefore extends downward in response to the firing of a round to counteract recoil forces. Alternately, the gas injection system described above can be applied to a single inertia block system.

Figure 8:
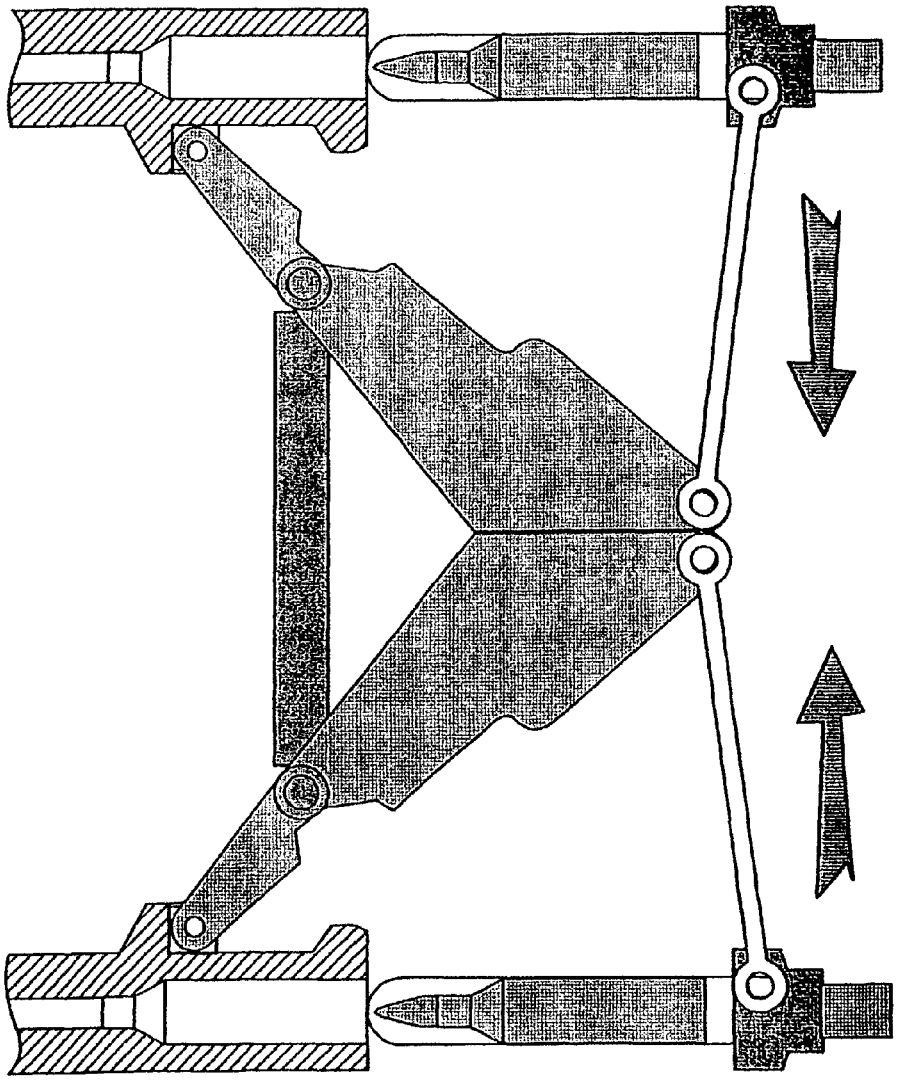
FIG. 8 shows another preferred embodiment of the recoil control device, the mechanism engineered for a twin-barreled gun.

FIG. 8 shows another preferred embodiment of the recoil control device, in this case applied to a twin-headed firearm. Each of the barrels has a moment control mechanism substantially similar to the one shown in FIG. 7. Movement by the two inertia blocks following firing is one toward the other, and they are linked by a common reset spring that, in this variant, resists compression instead of extension. Synchronization for the firing of the two barrels is achieved by unified electromagnetic control of the two triggering mechanisms CT.

Figure 9:
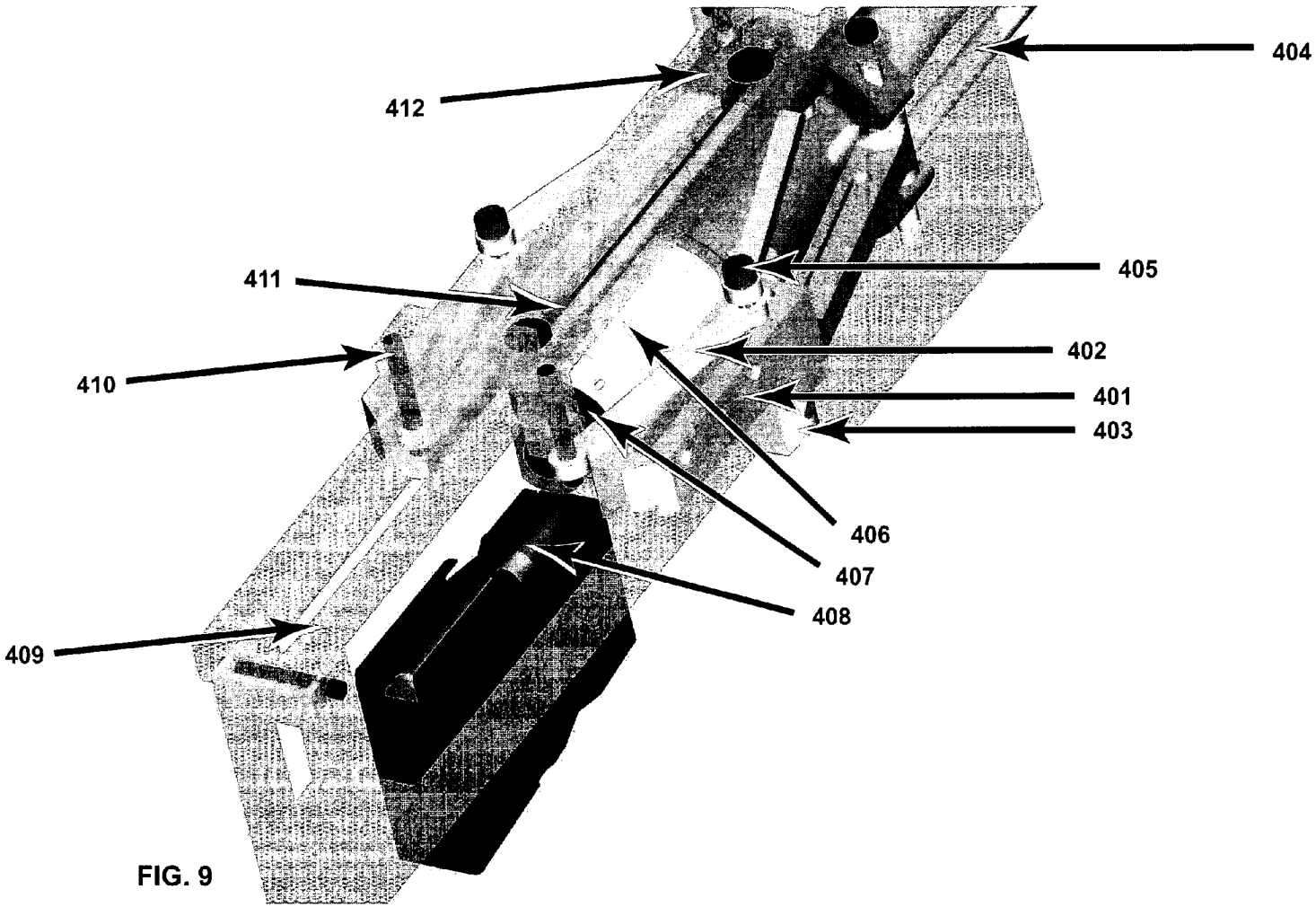
FIG. 9 shows another preferred embodiment of a single barrel firearm equipped with the recoil control device of the present invention with gas injection in breech closed position.
Figure 10:
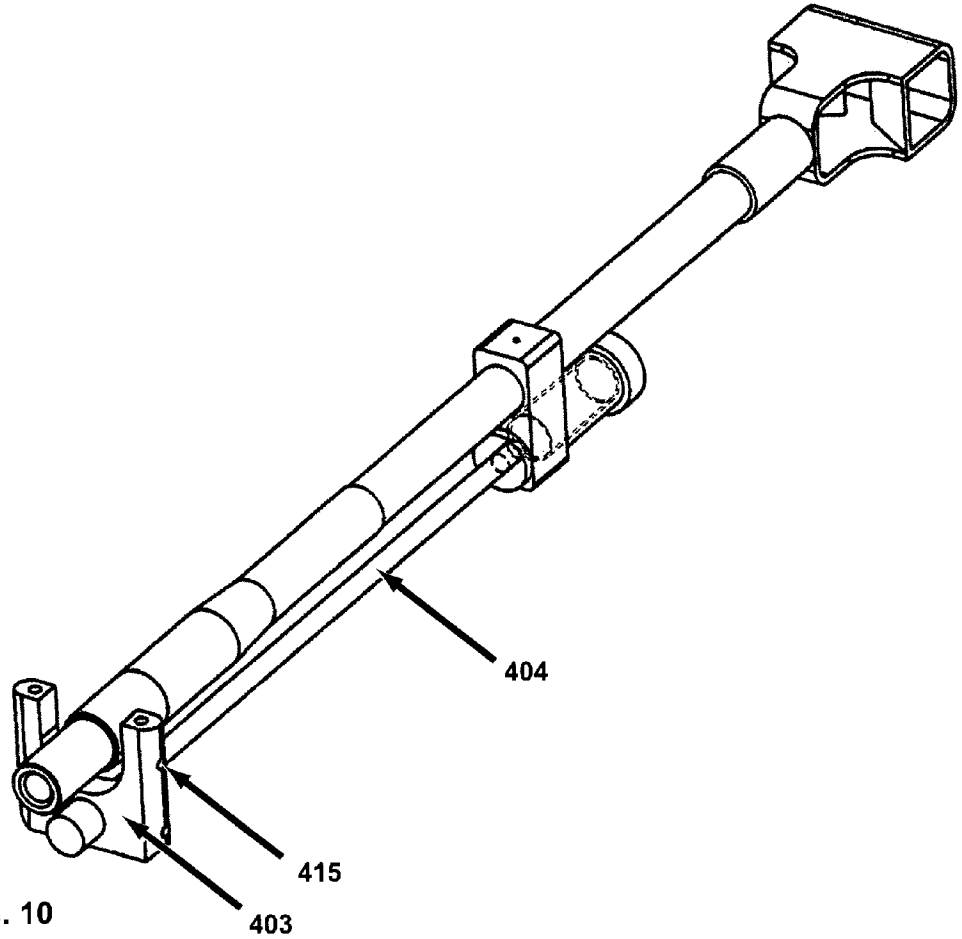
FIG. 10 shows the gas injection system of the embodiment of FIG. 9.
Figure 11:
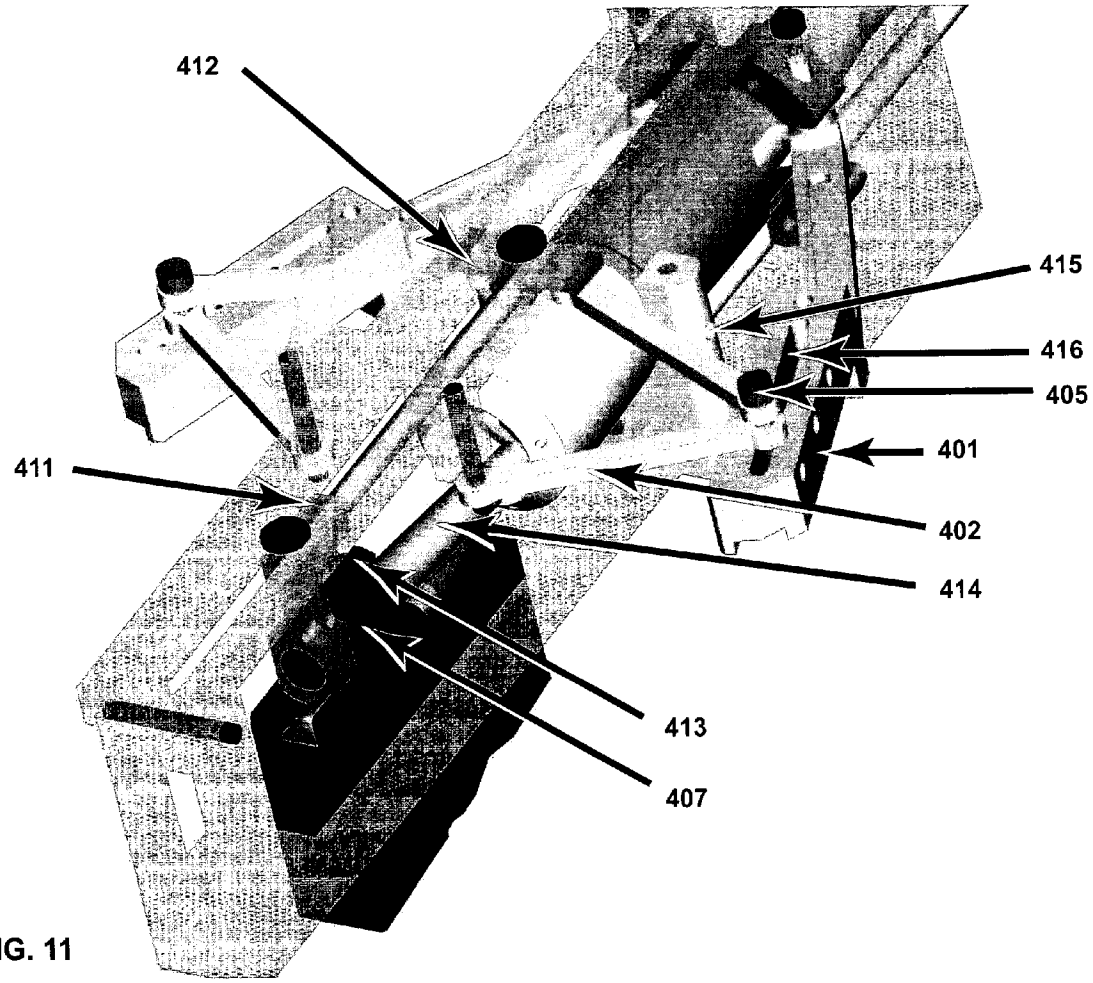
FIG. 11 shows the embodiment of FIG. 9 with a spent cartridge being ejected.

FIGS. 9-12 show a partial cutaway view of an optional heavy caliber embodiment. Here, inertia masses (401) are placed on each side of the locking cylinder (406), where cartridge is chambered. In FIG. 9, cartridge is chambered and firearm is loaded. As firing mechanism (not shown here) fires a round, gas from the barrel returns through the gas injection system and tube (404) and gas distributor (403). FIG. 10 shows a simplified view of the parts of the gas injection system for the embodiment of FIG. 9. An aperture (415) directs gas against inertia masses (401) to initiate outward movement. Rods (402) connecting inertia masses to the transporter assembly at front (412) and back (411), cause the transporter assembly to move back. The transporter assembly moves back and forth along top rail (409) during operation and is linked to bolt head (407). Cams on the locking cylinder (not shown) are contacted by one of inertia mass (401) to rotate the locking cylinder and release bolt (407) from locking cylinder (406). The locking cylinder may also be characterized as a locking spool and the terms are used interchangeably herein. Pins (410) link rods (402) to top rail (409). As the inertia masses continue their outward movement, locking cylinder (406) rotates 1/7 of a turn to release the bolt and cartridge case. Pins (405) allow rods (402) to slide through slots (416) in inertia masses. The inertia masses continue outward movement to maximum extension of the rods linking them to the bolt head (407) to cause extraction of cartridge case (414) through an automatic ejector (not shown). Movement of inertia masses, controlled through rods and transporter assembly, redirects recoil forces and diminishes recoil amplitude. Rods (402) move through a position perpendicular to the longitudinal axis of the barrel. A return spring or device (not shown) forces the movement of the bolt head forward, causing pins (405) in slots (416) to force inertia masses back inward. A cam (413) on the bolt head engages the next cartridge from magazine (417) as the bolt moves forward. As the inertia masses continue moving inward, the cartridge is placed into locking cylinder. A cam on the locking cylinder (not shown) is contacted by an inward moving inertia mass, causing the locking cylinder to rotate and align cams on the locking cylinder to cams (413) on the bolt. The bolt moves into its forward-most position and the inertia masses continue inward movement. The next round is now chambered and ready to fire.

FIG. 9 shows the round fully chambered, the bolt head (407) in the forward position, and the locking cylinder (406) in the locked position. In this embodiment, the direct transfer of recoil forces from the bolt head via the linkages to the inertia block does not control the movement of the inertia blocks. Rather, the bolt head is initially locked in the breech-closed position by a breech locking mechanism (406). After firing of the chambered round, the bullet is forced along the barrel by the expanding gases from firing. The bolt head's initial translation backward is partly caused by the recoil force generated by the firing of the round, under gas compression, to the degree that such pressure and the corresponding energy have not been diverted by the gas induction system to induce movement of the inertia masses. Essentially, however, the bolt head's translation is driven by the rotation of inertia blocks and the pin rod connections.

Unlike the embodiment of FIGS. 1-6, the cartridge is initially restrained from aftward movement along the axis of the barrel by the breech locking mechanism (406). As a result, the exhaust gases will generate a considerable pressure in the barrel (to a maximum of approximately 6,000 bars for a 0.50 caliber cartridge). These gases will pressurize the gas injection system through gas tube (404), which optionally can be isolated from the barrel to retain the gas pressure and to permit its use to move the inertia blocks. Gas pressure preferably is applied to each of the two inertia blocks to start them rotating substantially simultaneously in opposing directions with a component perpendicular to the axis of the gun barrel and outward from the gun barrel. The gas pressure applied to the inertia blocks is preferably between about 300 and about 400 bars. This effectively redirects the recoil forces generated by the expanding gases in a direction transverse to the axis of the barrel as described above.

The bolt (407) preferably is connected to a transporter assembly that travels along a top tray/guide (409), which constrains the back and forth movement of the bolt head in response to the firing of one or more cartridges to be substantially in line with the longitudinal axis of the barrel. Each inertia block (401) is connected to the transporter assembly (407) by a rod (402). In this embodiment, each rod (402) is connected to the inertia blocks (401) by a transverse spindle, which slides in a slot (416) in inertia blocks (401). Each inertia block preferably also is connected to the frame of the weapon by a second rod.

Figure 12:
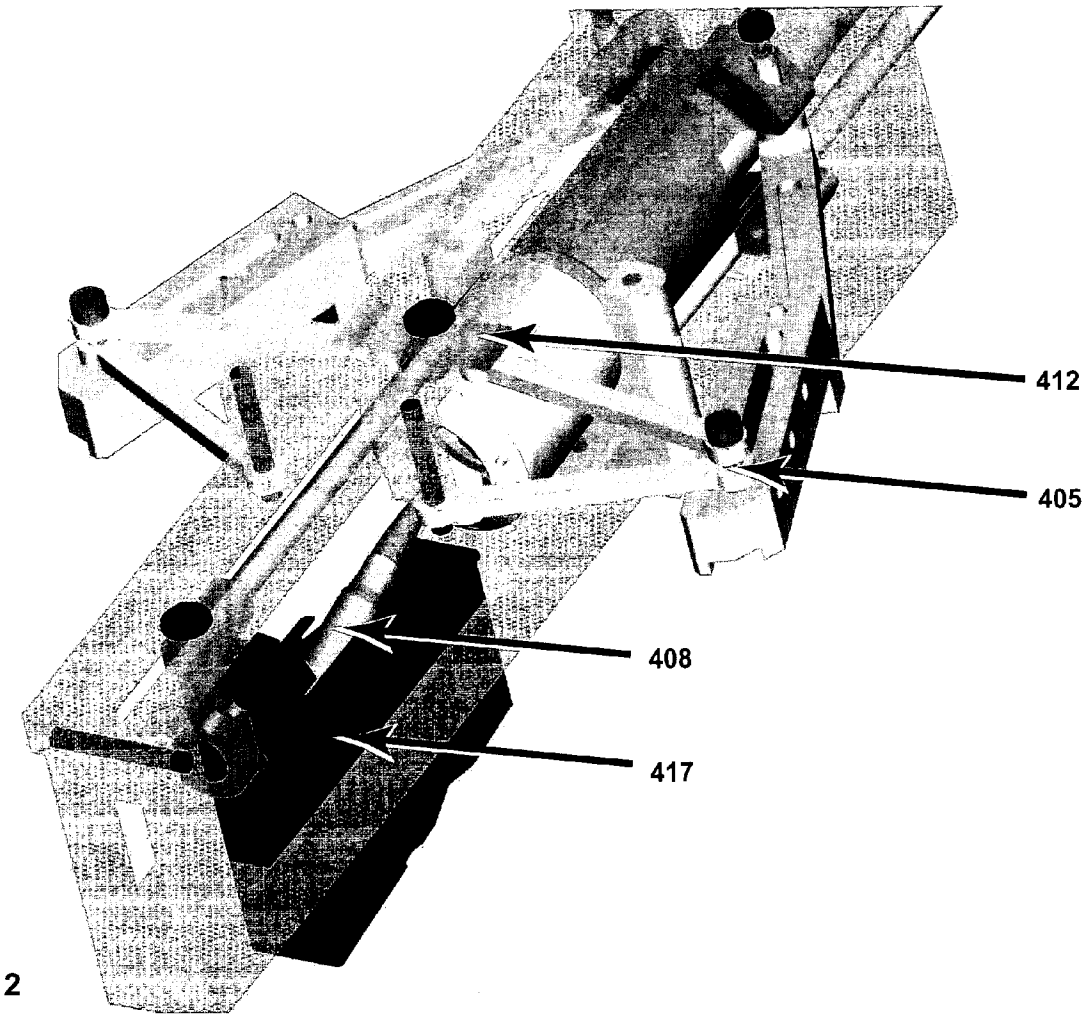
FIG. 12 shows the embodiment of FIG. 9 with a new round being chambered.

FIG. 12 shows the embodiment of FIG. 9 with a new cartridge being chambered. As the bolt head (407) chambers a fresh cartridge, the inertia blocks are forced inward by a recovery mechanism, not shown, which restores the bolt head (407) to its forward position. As the inertia blocks (401) move inward, they cause the breech locking mechanism to rotate to the locked position.

Figure 13:
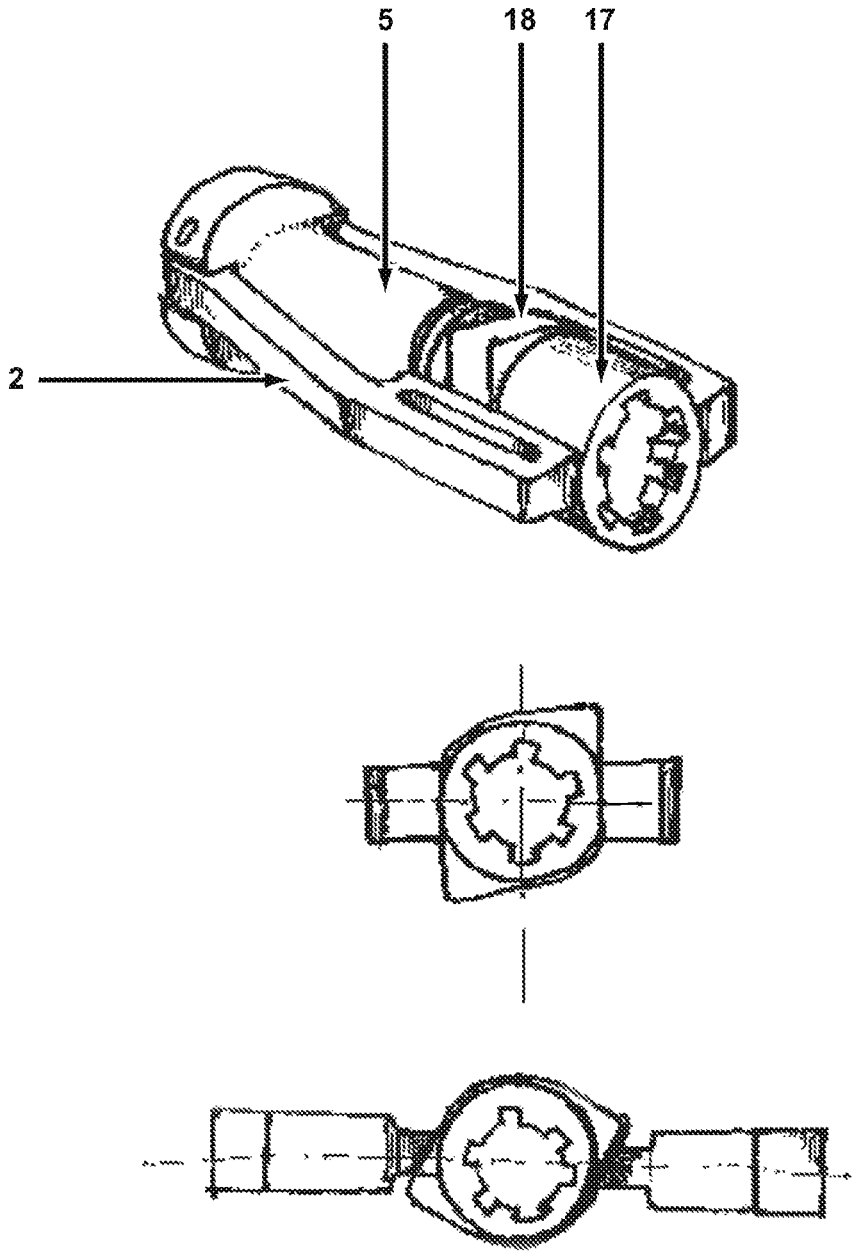
FIG. 13 shows a preferred embodiment of a breech locking mechanism for use with the embodiment of FIG. 9.
Figure 18:
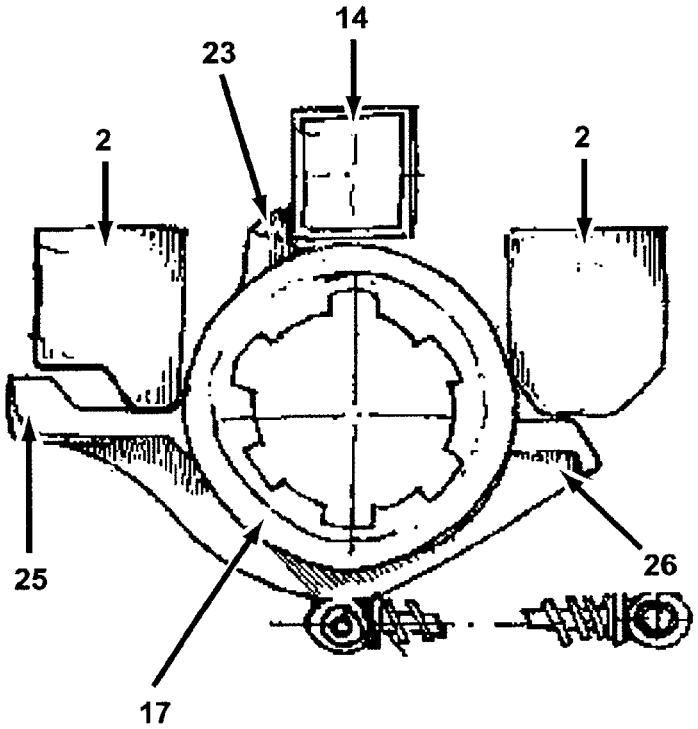
FIG. 18 show another preferred embodiment of a breech locking mechanism for use with the embodiment of FIG. 9.
Figure 18:
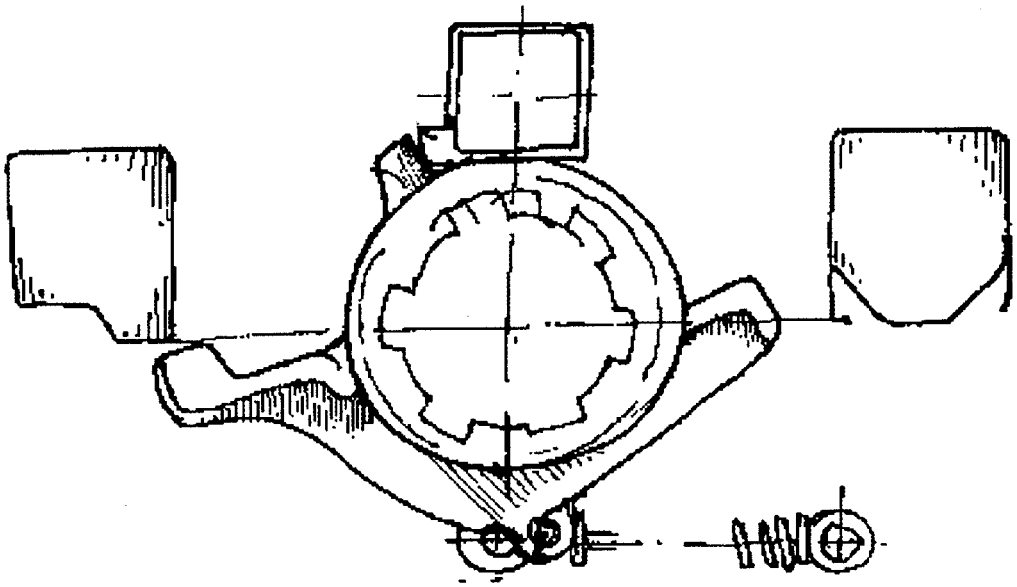

FIG. 13 shows a preferred embodiment of a breech locking mechanism for use with the embodiment of FIG. 9. In this embodiment, the breech locking mechanism comprises a locking spool (17) and a cam (18). The locking spool (17) preferably is a generally cylindrical tube with tenons for engaging corresponding tenons on bolt head (3) when in the locked position. To lock the breech locking mechanism, the locking spool is rotated to align the tenons on the locking spool with corresponding tenons on bolt head (3). The locking spool (17) preferably has 7 tenons and is preferably rotated 1/7 of one turn to engage the corresponding tenons of the bolt head (3). The locking rotation of the locking spool is initiated when the inertia blocks (2) are forced inward by the recovery mechanism (11). As the inertia blocks (2) move inward, the transporter assembly (14), as shown in FIG. 18, moves forward under the influence of its linkage to inertia blocks (2) via pin rods (4). The locking spool is in the unlocked position, permitting the bolt head (3) to move forward and the tenons on bolt head (3) to slide between the tenons on locking spool (17) as the bolt head (3) approaches its forward position. As the inertia blocks (2) are returned to their pre-firing position, they strike extensions of cam (18) forcing it, and locking spool (17), to rotate 1/7 of one turn to the locked position.

Figure 14:
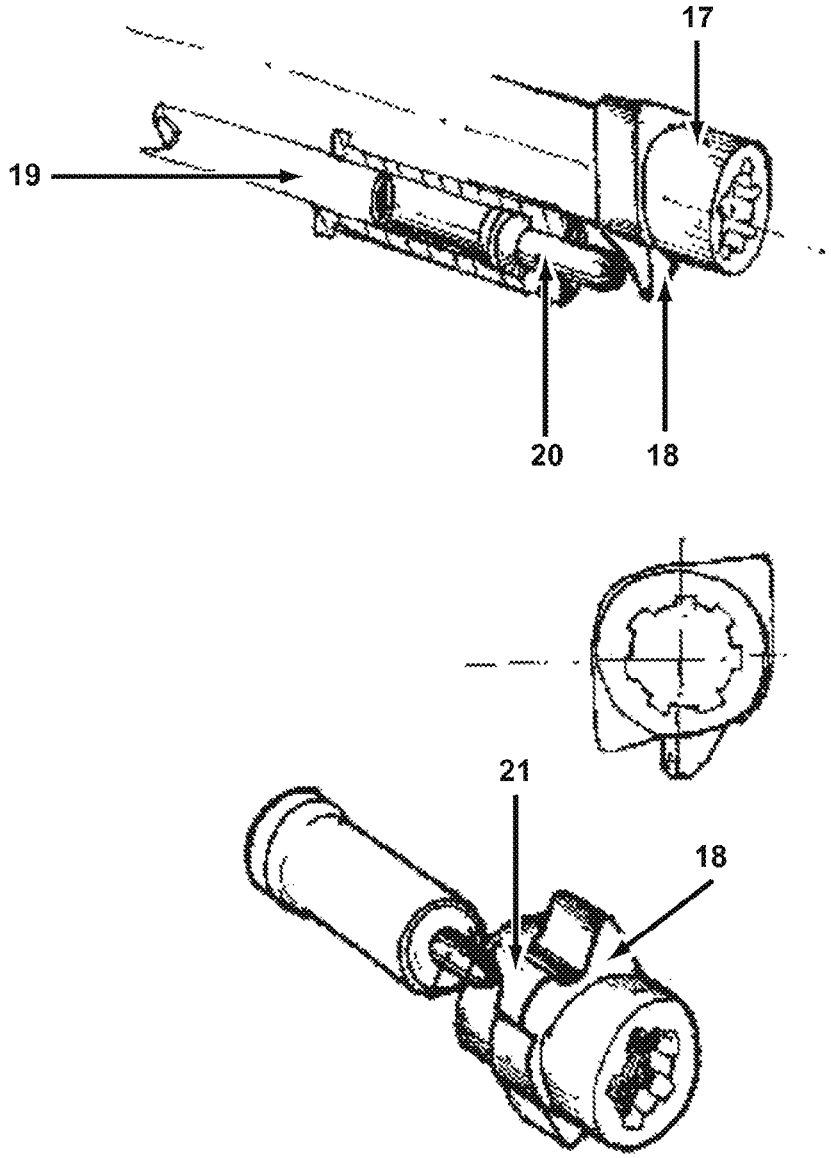
FIG. 14 shows a gas injection system for actuating the breech locking mechanism of the embodiment of FIG. 13.

When a round is fired, the expanding gases of firing pressurize the barrel and gas injection mechanism including gas tube (19), as shown in FIG. 14. This forces forcing piston (20) to strike opening cam (21), rotating locking spool 1/7 of a turn to unlock the locking spool and to permit the bolt head to move backward. The rotating cams (18) provide an impulse to inertia blocks (2), pushing them outward as shown in the bottom diagram of FIG. 13. This causes a lateral transfer of momentum out of the longitudinal axis of the barrel. As described for the embodiment of FIGS. 1-6, the inertia blocks are preferably of substantially equal mass and imparted with substantially equivalent components of lateral momentum, which tend to cancel each other to prevent undesirable agitation of the weapon. The outward movement of inertia blocks (2) causes the transporter assembly to force the bolt head backward, to eject the spent cartridge, and to chamber a fresh round, as shown in FIGS. 9-12.

Figure 15:
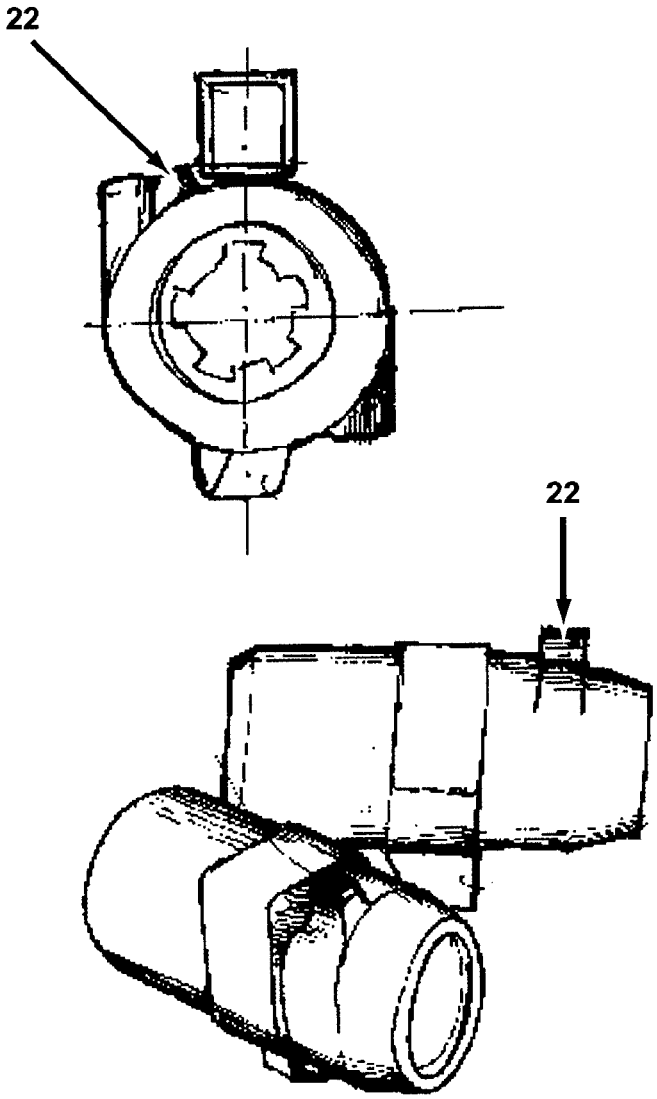
FIG. 15 shows the breech locking mechanism of FIG. 13 including the transporter assembly and an optional cocking catch.
Figure 16:
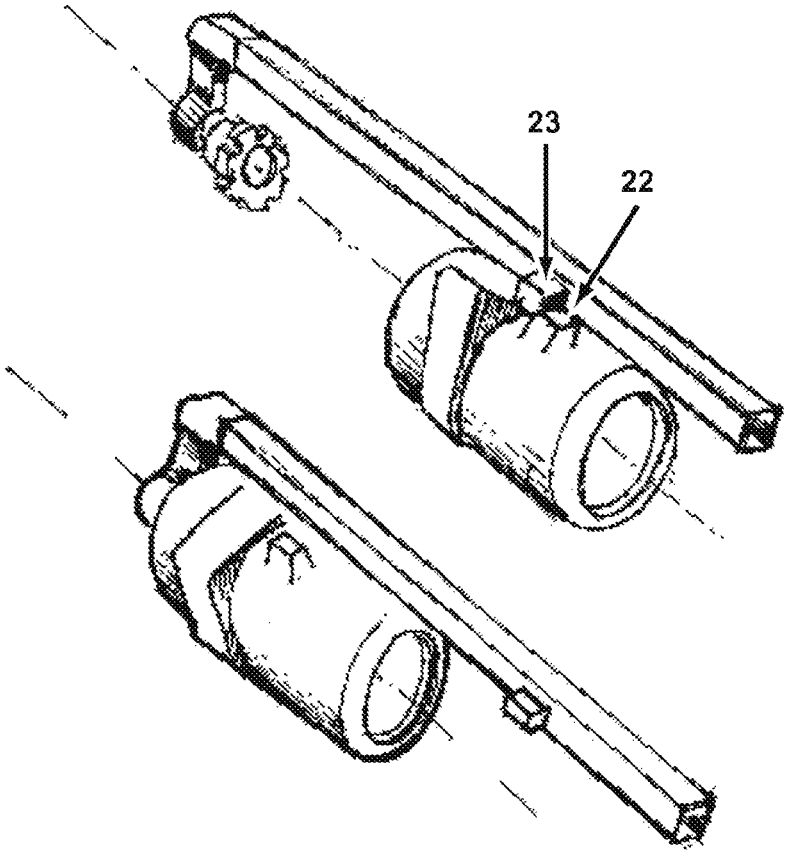
FIG. 16 shows the motion of the bolt head and transporter assembly in conjunction with the breech locking mechanism and the cocking catch.

FIG. 15 shows the breech locking mechanism of FIG. 13, including the transporter assembly and an optional cocking catch (22). When the transporter assembly is in its rearward position, the cocking catch (22) engages tenon (23) to hold the bolt head in its rearward position, as shown in FIG. 16.

Figure 17:
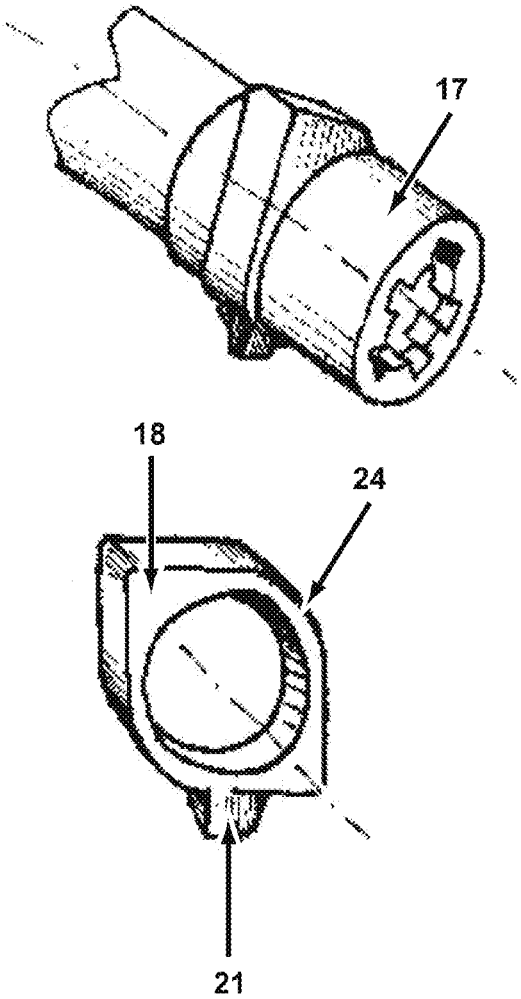
FIG. 17 shows another embodiment of a breech locking device for use with the embodiment of FIG. 9.

FIG. 17 shows an expanded view of the breech locking mechanism of FIG. 13. The locking cam may be part of an unlocking ring (24). This unlocking ring may include both the opening cam (21) to unlock the breech locking mechanism and opening cams (18) to provide an impulse to the inertia blocks (2) to transfer recoil forces out of the axis of the barrel and to provide the motive force for the ejection and loading cycle through linkages with the transporter assembly (14).

FIG. 18 shows another preferred embodiment for a breech locking mechanism for use with the embodiment of FIG. 9. In this embodiment, the gas pressure from the gas injection system is applied to the inertia blocks (2) to transfer a momentum impulse with a lateral component to the inertia blocks (2). As the inertia blocks (2) rotate outward from the barrel in a fashion similar to that described for the embodiment of FIGS. 1-6, at least one inertia block (or a tenon or element of the inertia block) will impinge on unlocking cam (25) extending from at least one side of the breech locking mechanism, causing the locking spool (17) to rotate to an unlocked position. The rotational displacement of the locking spool (17) is preferably 1/7 of a full revolution. The rotational displacement can vary from approximately 1/7 of a full revolution, depending on the spacing of the locking spool tenons and/or cams or tenons on the bolt. The arrangement or design of tenons and cams that interact between the inertia block and the locking spool (or locking cylinder) can vary. In one embodiment, for example, when the inertia block (or tenon or protrusion on the inertia block) has moved approximately 10-15 mm, it strikes the unlocking cam on the locking spool and knocks it upward. This causes the locking spool to rotate approximately 1/7 of a rotation, which causes the tenons on the locking spool to move out of alignment with the tenons on the bolt, thereby unlocking the breech locking mechanism and permitting the aftward movement of the bolt.

It should be noted that by this point in the firing cycle the bullet has left the barrel on the way to its target and the barrel is effectively depressurized prior to unlocking the breech locking mechanism. With the breech locking mechanism in the unlocked position, the bolt head (3) is permitted to move in a backward direction along the axis of the gun barrel guided by transporter assembly (14). The inertia blocks (2) are connected to the transporter assembly (14) that ensures that any aftward movement of the bolt head (3) is substantially along the axis of the barrel. The inertia blocks (2) are connected to the transporter assembly by linkages such that when the inertia blocks are forced outward by the gas pressure from the gas injection system, the transporter assembly (14) will be moved backward along the axis of the gun barrel through the linkages. This backward movement will cause the bolt head (3) also to move backward, bringing along with it the spent cartridge, which is then ejected in conventional fashion. Once the inertia blocks (2) reach their outermost position, the recoil control device is in the open position as described above wherein the rods or linkages are in mechanical opposition blocking the recovery mechanism or return spring (11) from returning the mechanism to the pre-firing position. Optionally, the cocking catch (23) may be engaged at this point to hold the mechanism in the open position. Similar to the embodiment of FIGS. 1-6, an impulse is required to release the mechanism and to allow the return springs (11) to draw the inertia blocks (2) inward toward the barrel and thereby to force the transporter assembly (14) forward, causing the bolt head (3) to chamber the next round in conventional fashion. The impulse may be provided by any electromechanical or electropneumatic triggering mechanism as described above. For example, the triggering mechanism may be a solenoid, which can be selectively energized to control the firing rate of the weapon. After the bullet is chambered, the continued inward motion of the inertia blocks impinges on the locking cam (26) of the breech locking mechanism, causing locking spool (17) to rotate into the locked position in preparation for firing of the next round.

Figure 19:
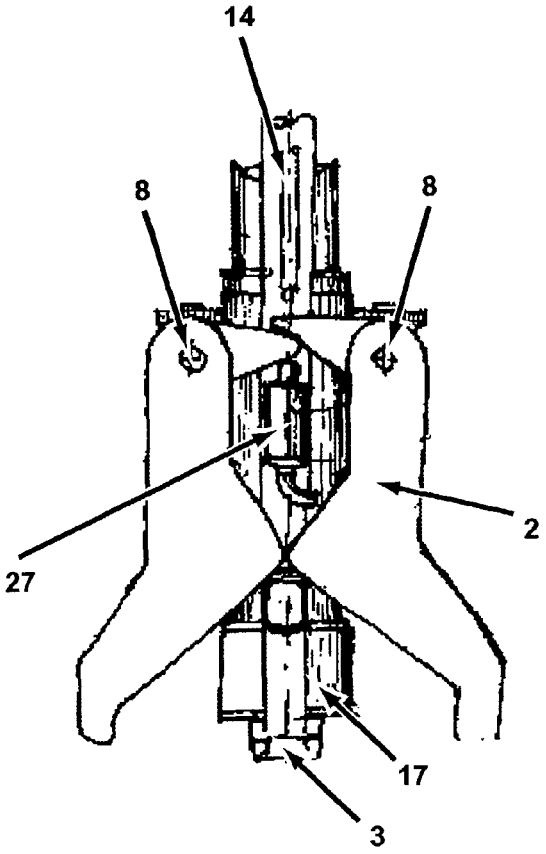
FIG. 19 shows another embodiment of a single barrel firearm of the present invention.

FIG. 19 shows another embodiment of a single barrel firearm of the present invention. The inertia blocks (2) are of a different shape from the embodiment of FIG. 9, and rotate inward towards the twin barrels about transverse spindles (8) in response to an impulse delivered by forcing piston (27). The forcing piston is driven by gas pressure from gas injection system, which is pressurized by the expanding gases of firing. Similar to the embodiment of FIG. 9, the inertia blocks (2) of this embodiment have roughly equivalent masses and receive substantially equivalent momentum impulses from the forcing piston (27). Thus, the inertia blocks (2) are imparted with nearly equivalent lateral components of momentum leading to approximately zero net lateral momentum on the firearm to prevent agitation of the firearm during firing.

Figure 20:
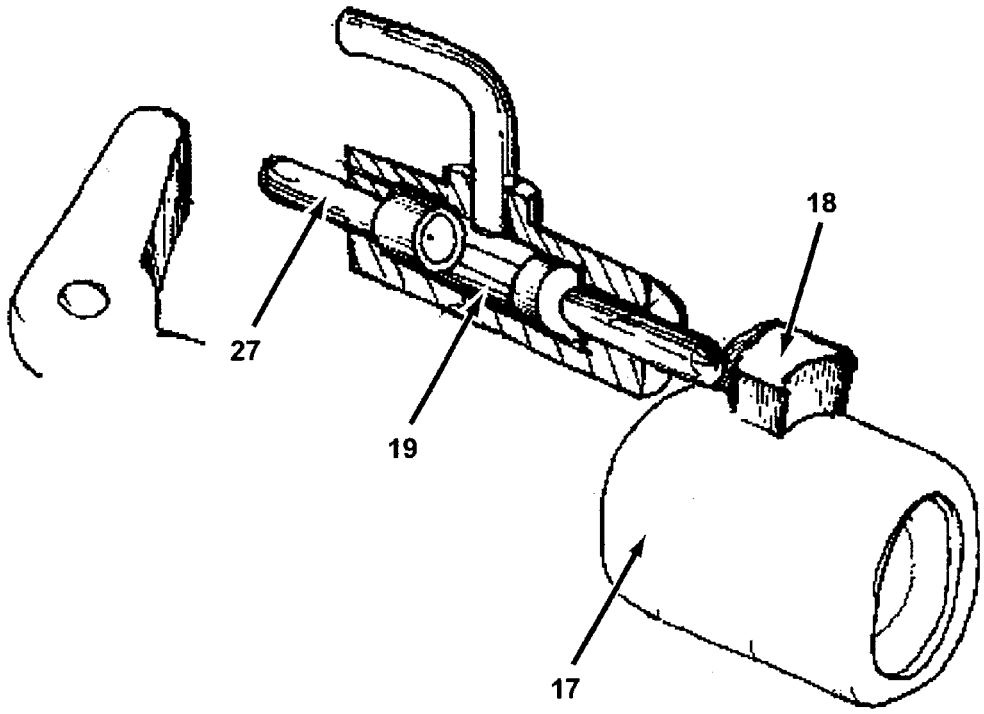
FIG. 20 shows a cutaway view of a gas injection system for use with the single barrel firearm of FIG. 19.

FIG. 20 shows a cutaway view of a gas injection system for use with the single barrel firearm of FIG. 19. The system for this embodiment is similar to that shown and described in conjunction with FIG. 14 except that the gas tube (19) transports the high-pressure gases from firing to two forcing pistons. One forcing piston (20) operates opening cam (18) to rotate the locking spool (17) to the unlocked position. The other forcing piston (27) imparts the momentum impulse to the inertia blocks (2) as described above.

Figure 21:
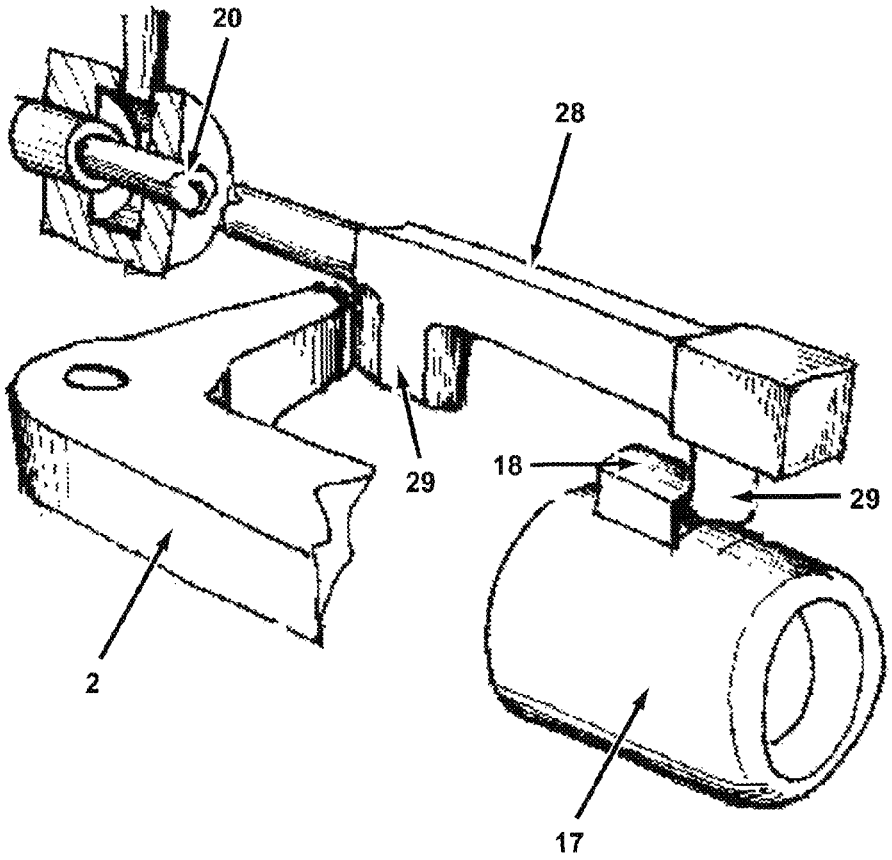
FIG. 21 shows an expanded view of the embodiment of FIG. 19.
Figure 21:
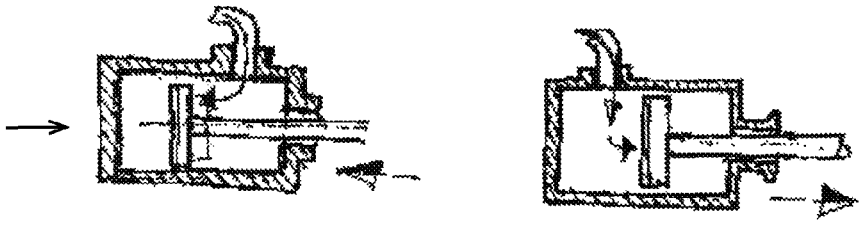

FIG. 21 shows that it is possible to use a single forcing piston (20) to simultaneously actuate the inertia blocks (2) and the locking spool (17) via operating member (28) with operating tenons (29).

Thus, a gas injection system can be used to unlock the locking spool (17) as shown in FIG. 14, with the rotation of the locking spool imparting a momentum impulse to inertia blocks (2) through opening cams (18). Alternately, the gas injection system can be used to impart an impulse to the inertia blocks (2) as shown in FIG. 18 and thereby to unlock the locking spool (17) through the inertia blocks (2) striking an unlocking cam (25). Finally, the gas injection system can be used both to impart a momentum impulse to inertia blocks (2) via forcing piston (27) and to unlock the locking spool (17) via forcing piston (20) and opening cam (18) as shown in FIG. 20 or 21.

Figure 22:
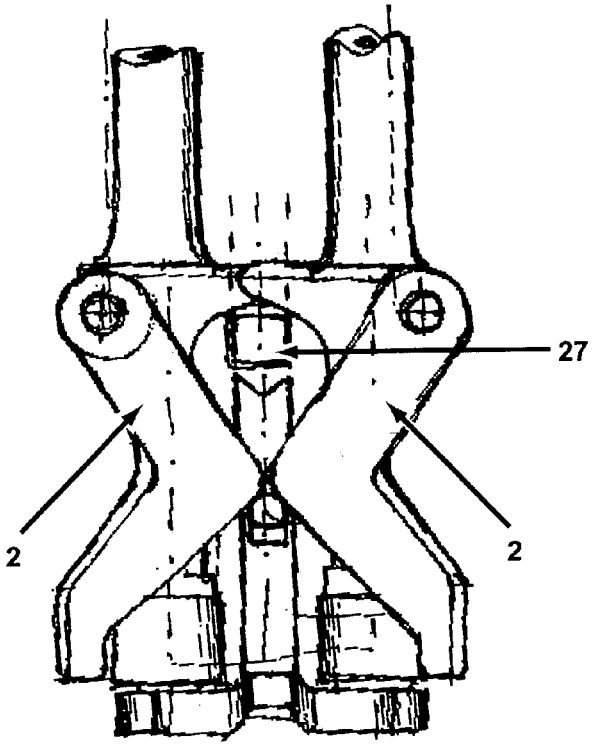
FIG. 22 shows one embodiment of a twin barrel firearm with the recoil device of the present invention with the bolt heads in the forward position.
Figure 23:
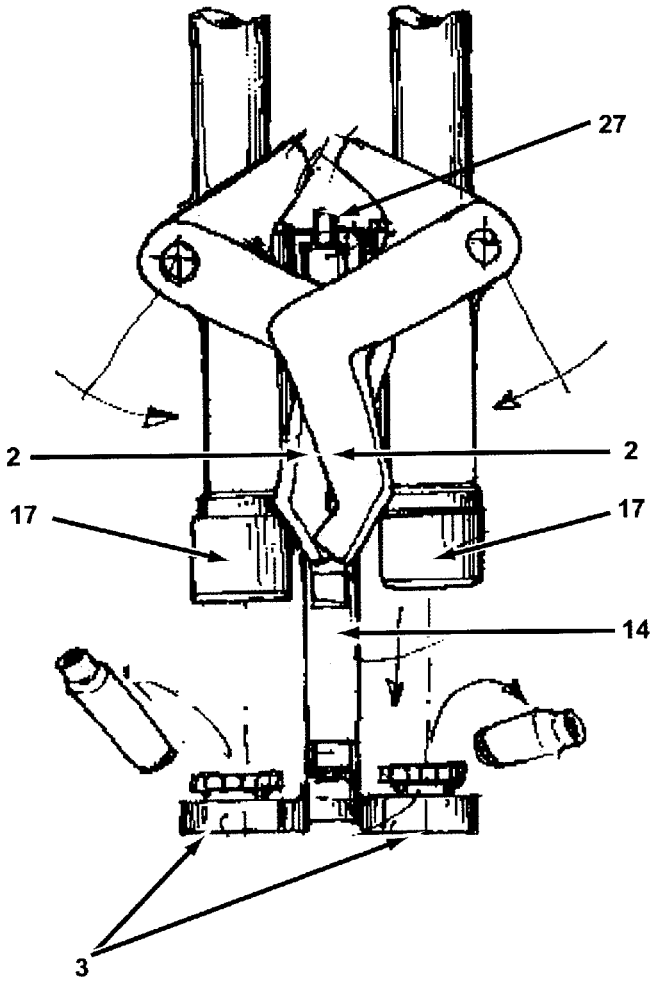
FIG. 23 shows the twin barrel firearm of FIG. 22 with the bolt heads in the rearward position.
Figure 24:
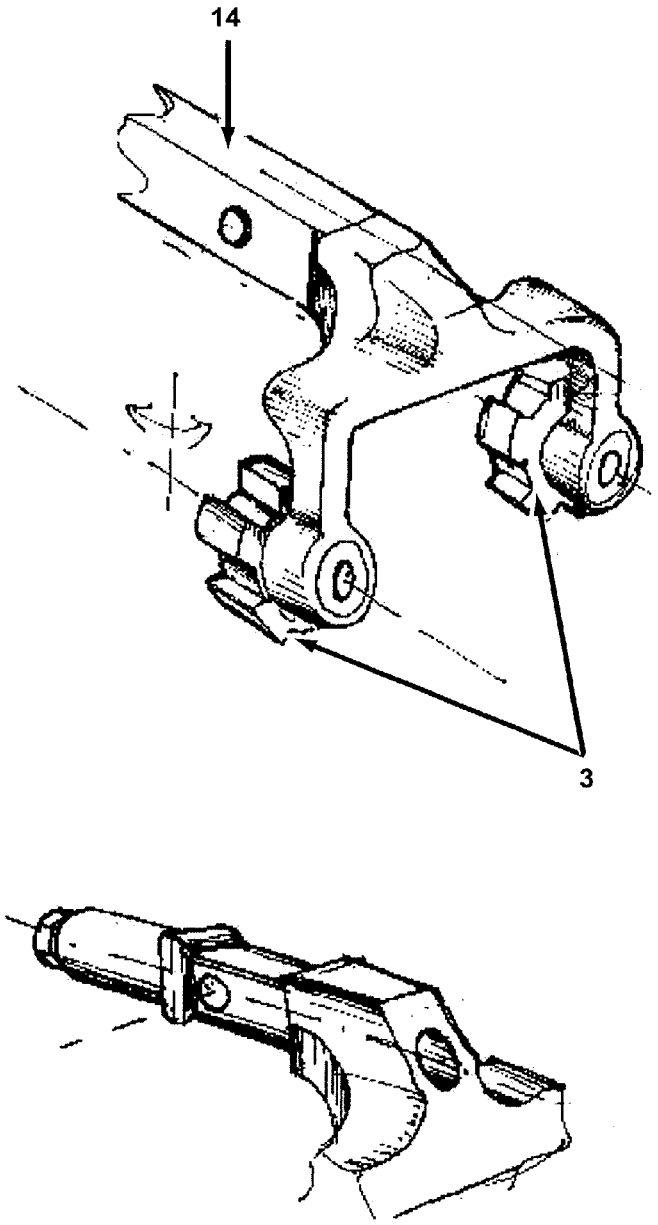
FIG. 24 shows a perspective view of a transporter assembly for use with the twin barrel firearm of FIG. 22.

FIG. 22 shows one embodiment of a twin barrel firearm with a gas injection system, shown with the bolt heads (3) in the forward position. In this embodiment, the recoil control mechanism functions in a similar fashion to the gas injection-equipped single headed firearm of the embodiment of FIG. 9, except that the two bolt heads (3) are preferably connected to a single transporter assembly (14) as shown in FIGS. 23 and 24, permitting the action of the inertia blocks (2) to simultaneously eject both spent cartridges and chamber two new rounds. This has the advantageous effect of permitting a single dud round in either barrel to be automatically ejected and fresh rounds to be chambered in both barrels using the gas pressure generated by the round in the other barrel. Because one barrel generates sufficient gas pressure to cycle the action of both barrels, a single dud in one of the two barrels will not arrest the firing process.

Figure 25:
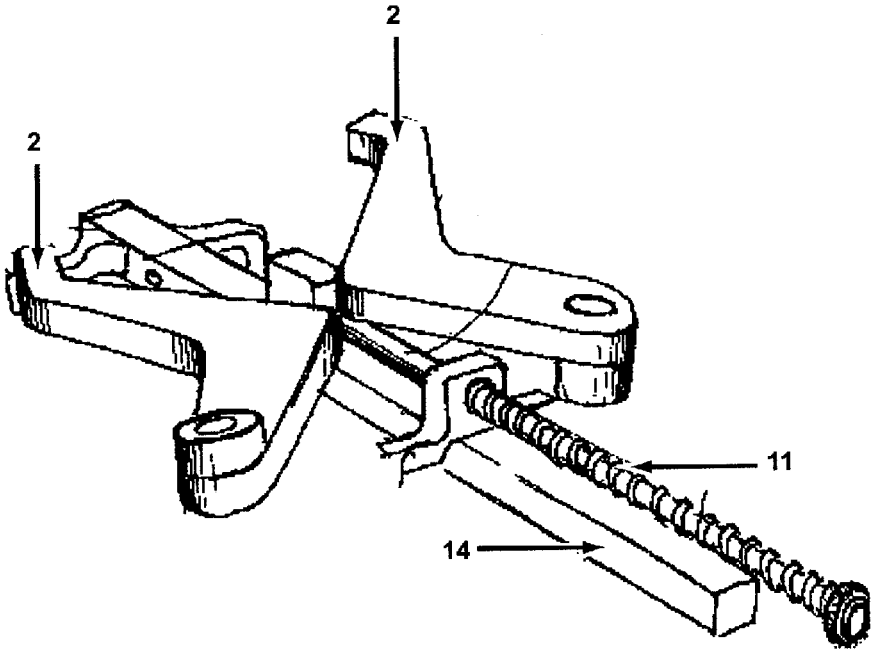
FIG. 25 shows one embodiment for actuating the inertia blocks of the twin barrel firearm of FIG. 22.
Figure 26:
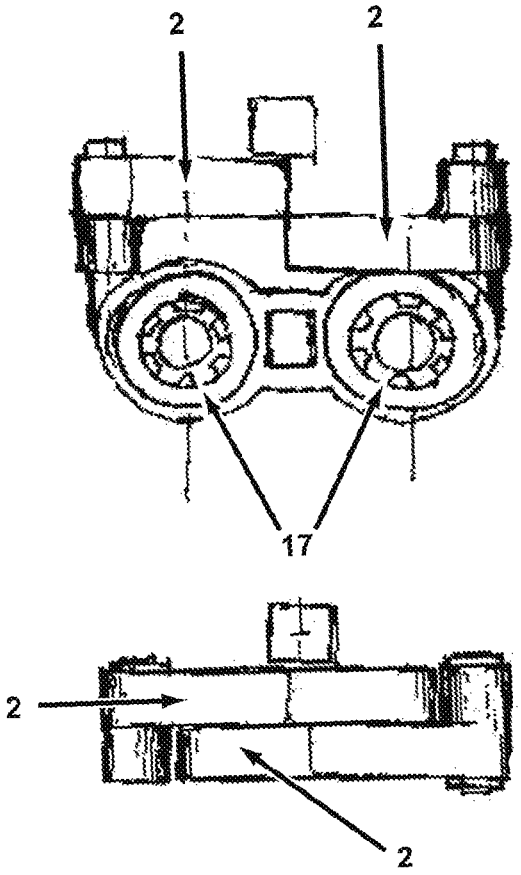
FIG. 26 shows top and side views of the transporter assembly of FIG. 24.
Figure 36:
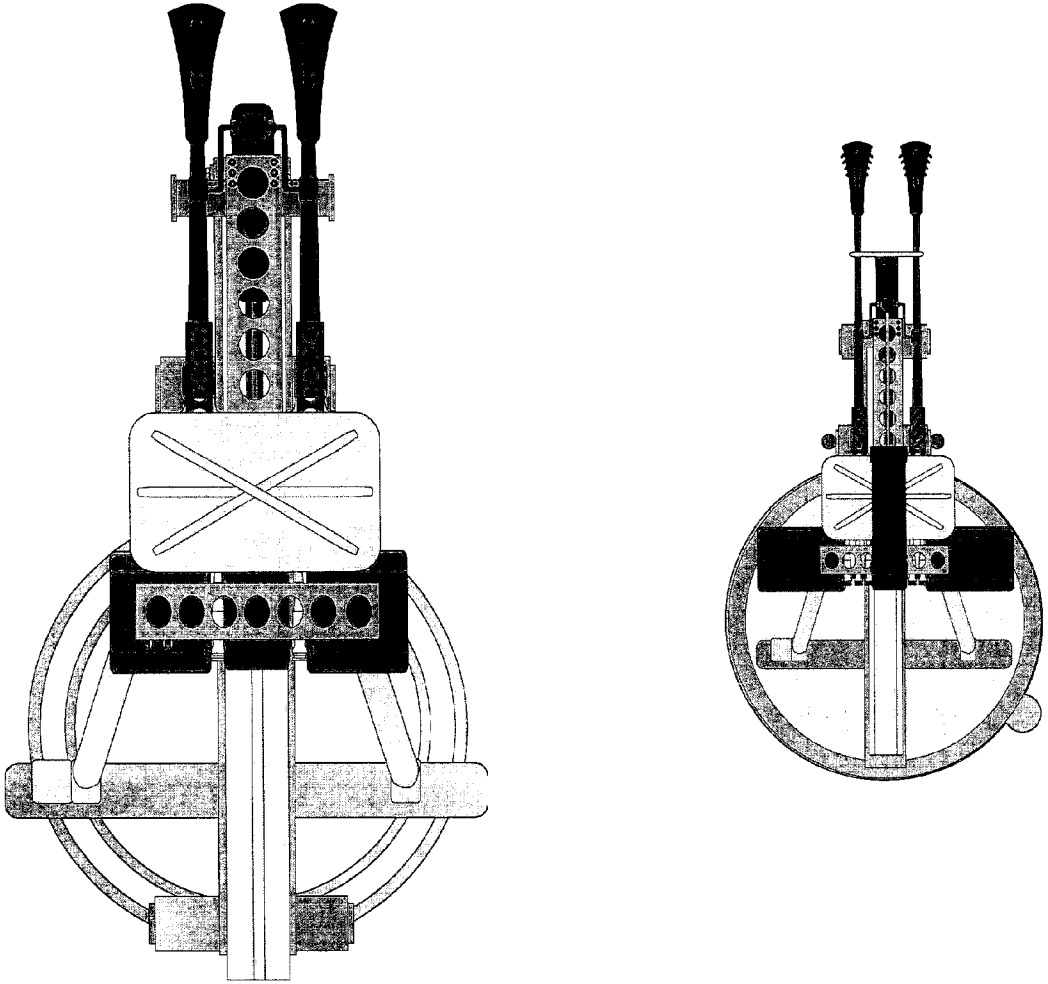
FIG. 36 shows design alternatives for a twin barrel heavy caliber firearm, with inertia blocks positioned above the barrels.

In this embodiment, two inertia blocks may be used to control the recoil of both barrels and may be of the shape as shown in FIGS. 22 and 23 or optionally of the shape shown in FIG. 36. The rotation of the inertia blocks is initially towards each other under the influence of gas pressure from the gas injection system via forcing piston (27), which compresses the return spring (11) as shown in FIG. 25. Because the inertia blocks are of equal mass and move in opposite directions under the influence of substantially similar gas pressure, the forces and moments exerted on the two inertia blocks substantially cancel each other and have no agitating effect on the weapon. As shown in FIG. 26, the inertia blocks (2) may overlap during their rotation and may optionally contact one another or knock together at the conclusion of their displacement.

Figure 27:
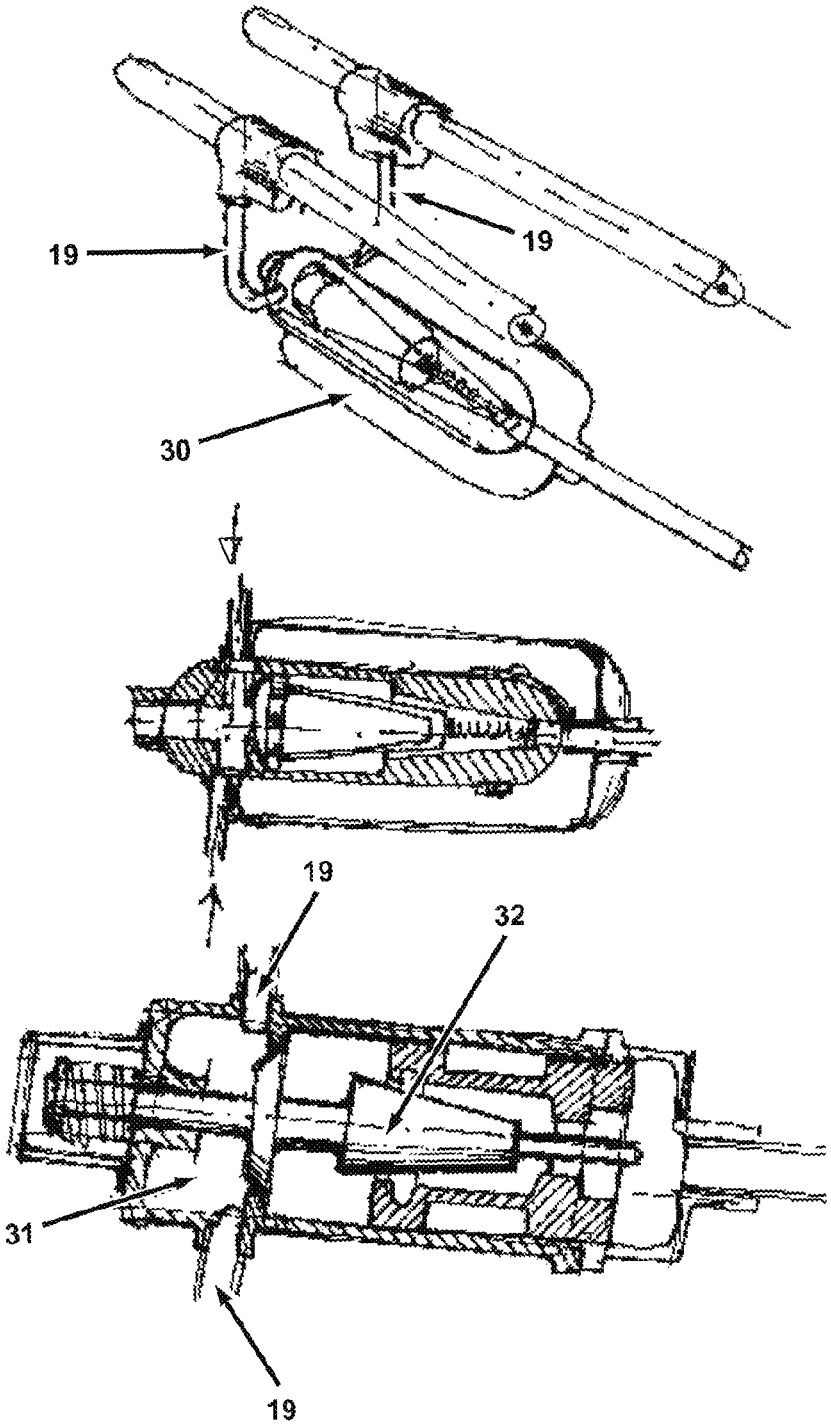
FIG. 27 shows one embodiment of a gas injection system for use with the twin barrel firearm of FIG. 22.
Figure 28:
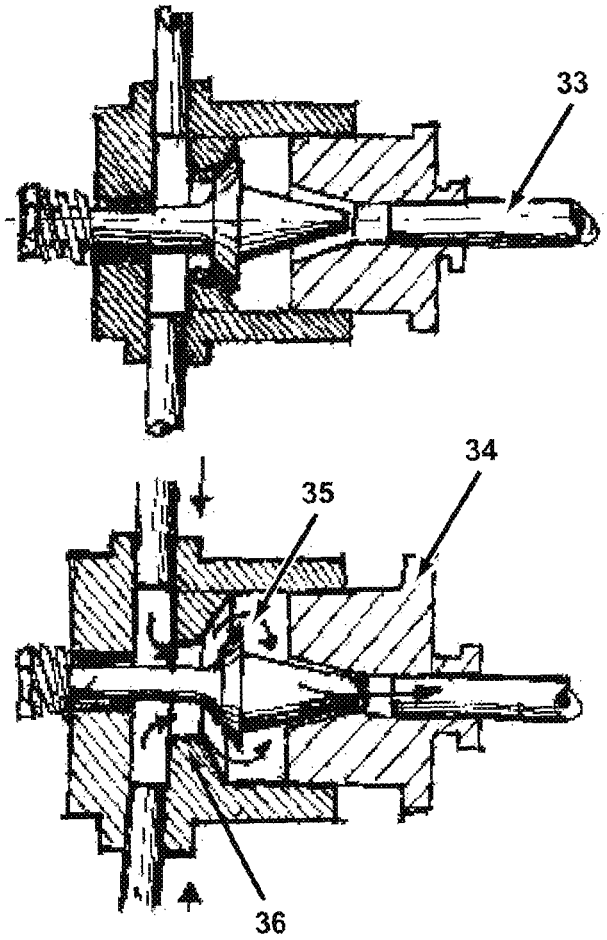
FIG. 28 shows an expanded view of a regulator for use with the gas injection system of FIG. 27.

FIG. 27 shows one embodiment of a gas injection system for use with the twin barrel firearm of FIG. 22. Gas tubes (19) from each of the two barrels will port high-pressure gas from each of the respective barrels to piston regulator (30). Both gas tubes (19) are connected to a common primary chamber (31). This permits pressure from either or both barrels to displace piston (32) and thereby to apply pneumatic pressure to common gas tube (33), as shown in FIG. 28. In this fashion, a dud round in one of the two barrels will not prevent ejection and reloading of fresh rounds in both barrels. The piston regulator (30) can be adjusted by adjustment of adjusting cone (34). The design of piston (32) causes pressure to build up in secondary chamber (35) until pressure in the secondary chamber (35) causes the piston to be pushed against valve seat (36), thereby regulating the pressure in the common gas tube (33) to ensure proper operation of the ejection/reload cycle.

Figure 29:
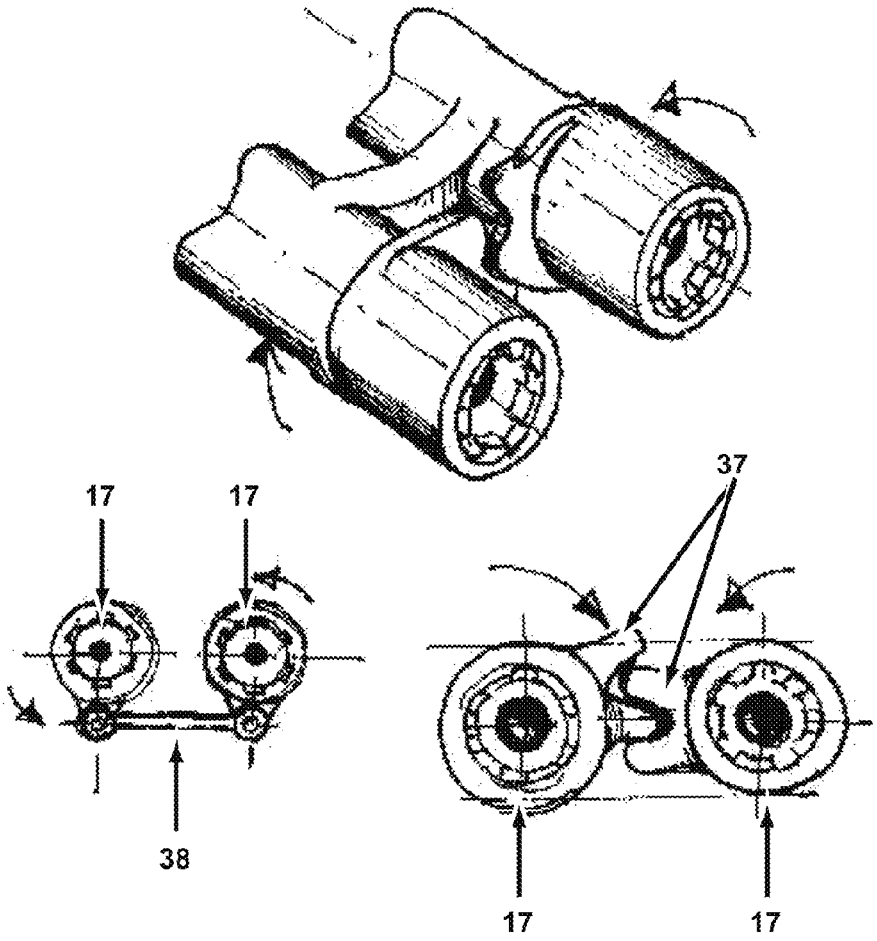
FIG. 29 shows an expanded view of one embodiment of a mechanism for synchronizing the action of the breech locking mechanisms of the twin barrel firearm of FIG. 22.

FIG. 29 shows an expanded view of one embodiment of a mechanism for synchronizing the action of the breech locking mechanisms of the twin barrel firearm of FIG. 22. The breech locking mechanisms for each of the two barrels are mechanically interlocked such that the motion of the inertia blocks causes the two locking spools (17) to lock and unlock substantially in unison. The mechanical interlocks can be accomplished by a variety of mechanical devices. For example, each locking spool (17) can be fitted with a synchronized opener cam (37). The two synchronized opener cams (37) interlock and the two locking spools (17) rotate in opposite directions so that they both lock and unlock substantially in unison. This arrangement is advantageous because it is simple and easy to disassemble. Alternately, the two locking spools (17) may be attached by a drive rod (38), which will also cause the two locking spools to rotate in opposite directions and to lock and unlock substantially in unison.

Figure 30:
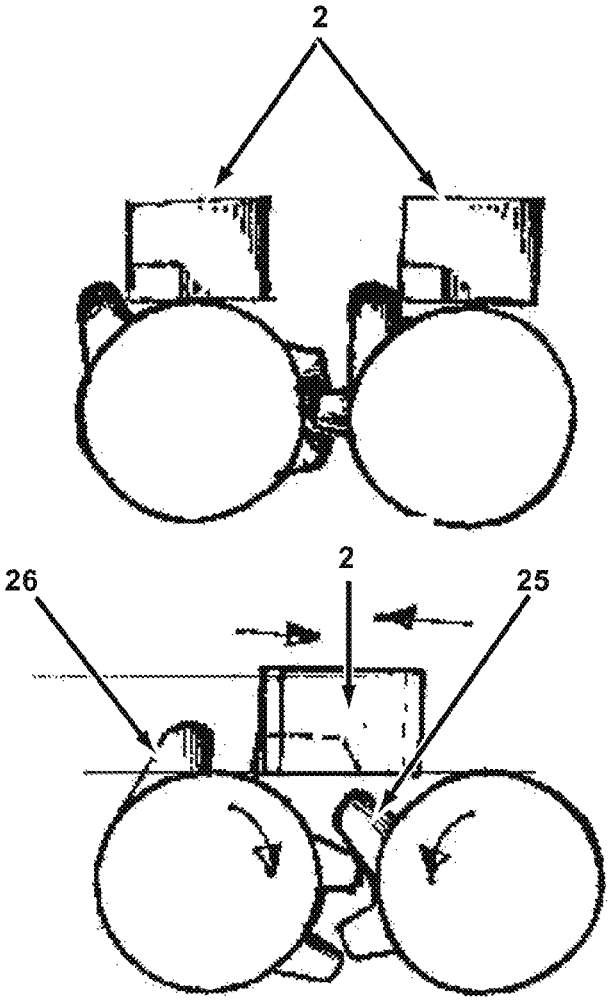
FIG. 30 shows another embodiment of a mechanism for synchronizing the action of the breech locking mechanisms of the twin barrel firearm of FIG. 22.

FIG. 30 shows another embodiment of a mechanism for synchronizing the action of the breech locking mechanisms of the twin barrel firearm of FIG. 22. In this embodiment, the locking and unlocking of the locking spools (17) is driven by the movement of the inertia blocks (2) in similar fashion to the single barrel embodiment of FIG. 18. When the inertia blocks (2) move inward in response to the impulse from forcing piston (27) as described for the embodiment of FIG. 22 above, the right inertia block strikes unlocking cam (25), causing the right locking spool (17) to unlock by rotating counter-clockwise. This rotation causes the synchronized double locking spools (37) to force the left locking spool to rotate clockwise and unlock. Once again the rotation of each of the locking spools (17) preferably is 1/7 of one turn.

In similar fashion, when the recovery mechanism (11) forces inertia blocks (2) outward towards their pre-firing position, the left inertia block in FIG. 30 strikes the locking cam (26) that causes the left locking spool to rotate counterclockwise into the locked position and the right locking spool (17) substantially simultaneously to rotate clockwise into the locked position.

Figure 31:
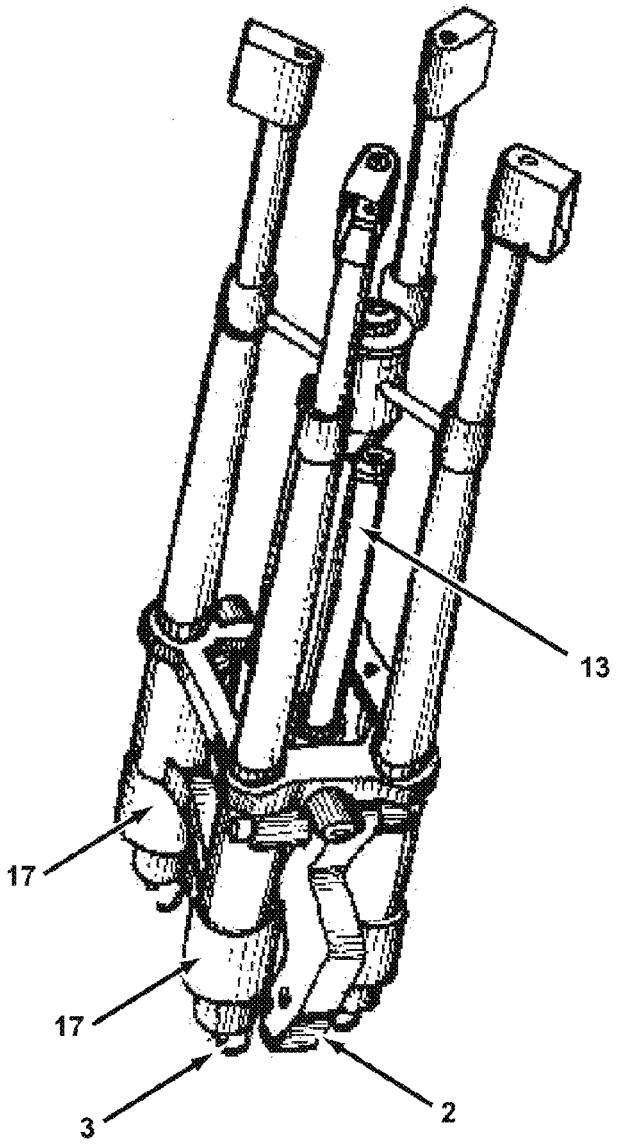
FIG. 31 shows a preferred embodiment of a quad barrel firearm of the present invention.

In yet another preferred embodiment, the foregoing principles can be applied to a quad barrel weapon, as shown in FIG. 31. The quad barrel embodiment is created essentially by combining two twin barrel guns. As with the twin barrel embodiment, the breech locking mechanisms for the four barrels are mechanically interlocked by a series of tenons or other linkages such that the motion of the inertia blocks causes the four mechanisms to lock and unlock substantially in unison. The firing of the four barrels is also synchronized by unified electromagnetic control of the two triggering mechanisms as described for FIG. 7 above. Only two inertia blocks (2) are necessary to manage the recoil forces and moments of the quad barrel system. Similarly, only 10-15% of the gas pressure generated by the nearly simultaneous firing of the four cartridges is necessary to operate the recoil control device, permitting the advantageous ejection of dud rounds in one or more of the four barrels using the gas pressure generated by the firing of at least one good round. As with the twin barrel embodiment, four new cartridges are chambered nearly simultaneously even if one or more of the cartridges in the prior cycle proves defective.

Figure 32:
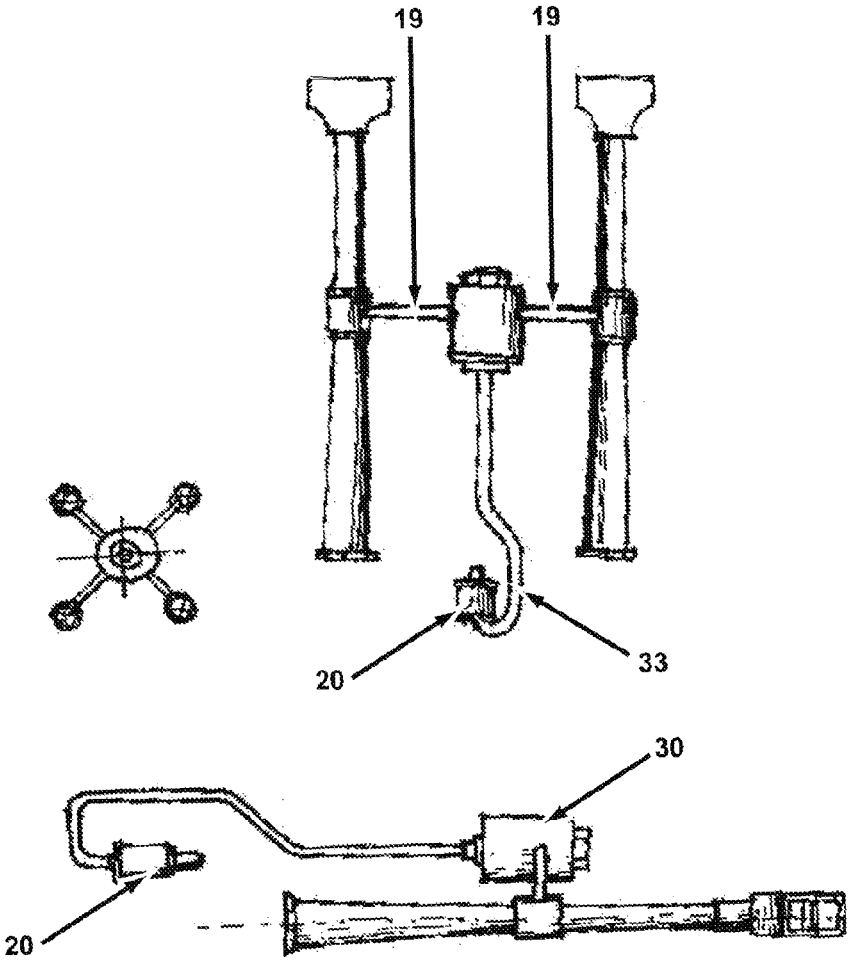
FIG. 32 shows a gas injection system for use with the quad barrel firearm of FIG. 31.

FIG. 32 shows a gas injection system for use with the quad barrel firearm of FIG. 31, wherein a single regulator is used to apply gas pressure from at least one of the four barrels via gas tubes (19) connecting each of the four barrels to a common gas tube (33) via a regulator (30). Regulator (30) can be of a similar design to the embodiment of FIG. 27 or any other suitable design for regulating the pressure supplied to forcing piston (20).

Figure 33:
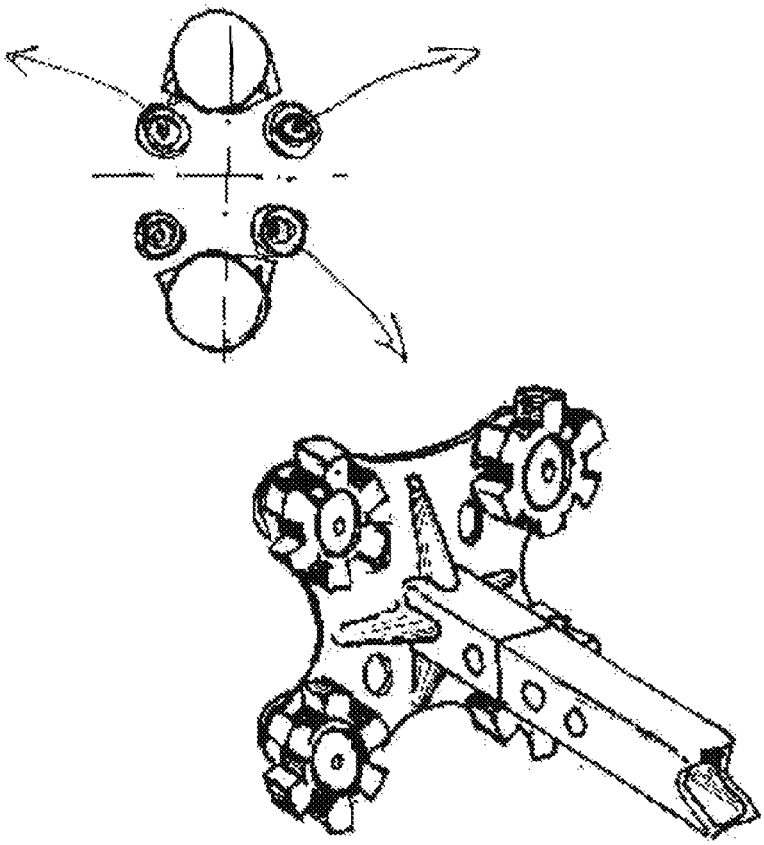
FIG. 33 shows a bolt head assembly for use with the quad barrel firearm of FIG. 31.

FIG. 33 shows a bolt head assembly for use with the quad barrel firearm of FIG. 31. Each of the four bolt heads (3) is connected to a common transporter assembly (14) that permits simultaneous ejection and reloading of all four barrels using the gas pressure from at least one cartridge fired in at least one of the four barrels. This permits dud rounds in one or more of the barrels to be ejected and fresh rounds to be loaded in each of the four barrels as long as at least one round fires in one of the four barrels.

Figure 34:
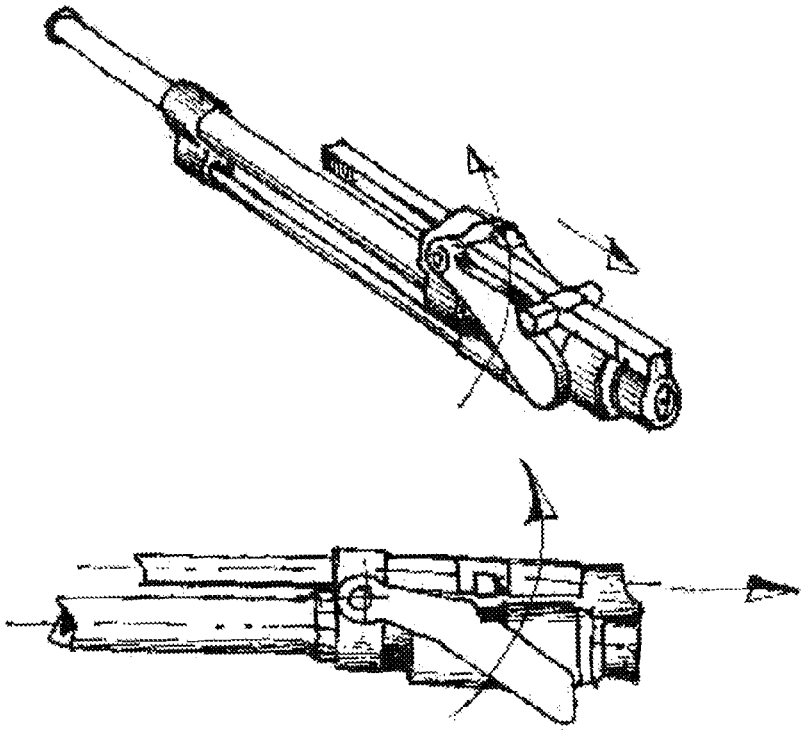
FIG. 34 shows an embodiment where the inertia block rotates upward.

FIG. 34 shows an embodiment where the inertia block rotates upward.

Figure 35:
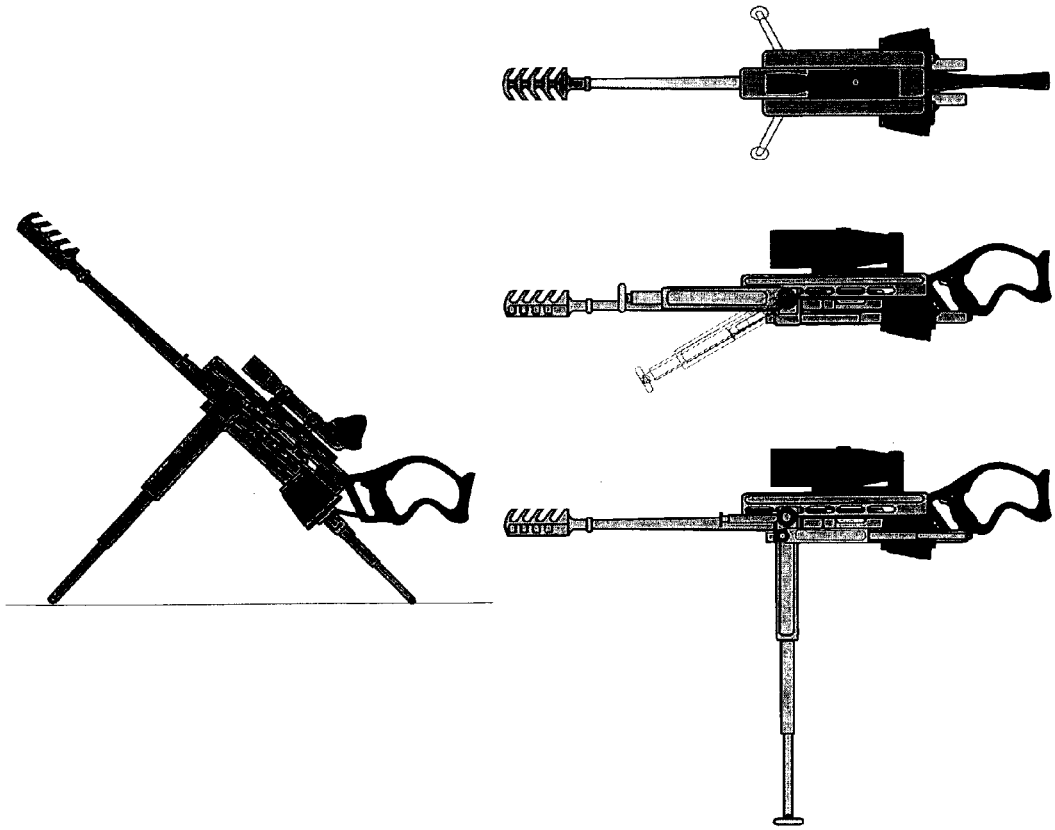
FIG. 35 shows a number of design alternatives in the configuration of a heavy caliber firearm incorporating the invention.

FIG. 35 shows a number of design alternatives in the configuration of a twin barrel heavy caliber firearm, with inertia blocks positioned above the barrels.

FIG. 36 shows an alternative embodiment of a twin barrel firearm of the present invention. In this embodiment, the inertia blocks are preferably of the shape as shown in FIG. 36 and their motion under the influence of the gas pressure from the gas injection system is one of translation with a component perpendicular to the axis of the gun barrel. The direction of translation is constrained by channels, which are preferably oriented at an angle of 45 degrees relative to the axis of the gun barrel, and a spindle. The translation of the inertia blocks is initially towards each other under the influence of gas pressure from the gas injection system, which compresses the return spring. Because the inertia blocks are of equal mass and move in opposite directions under the influence of substantially similar gas pressure, the forces and moments exerted on the two inertia blocks substantially cancel each other and have no agitating effect on the weapon.

Figure 37:
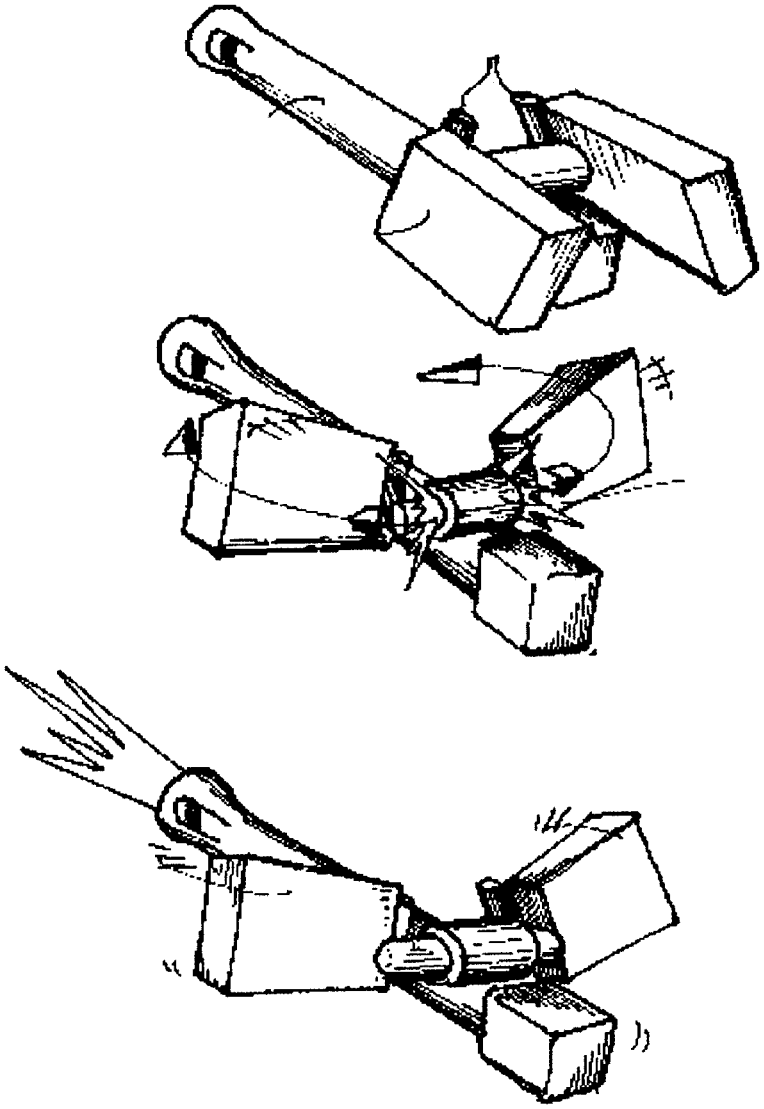
FIG. 37 shows an embodiment where the inertia blocks rotate in response to the firing of a priming charge.

FIG. 37 shows an embodiment where the inertia blocks rotate in response to the firing of a priming charge.

Figure 38:
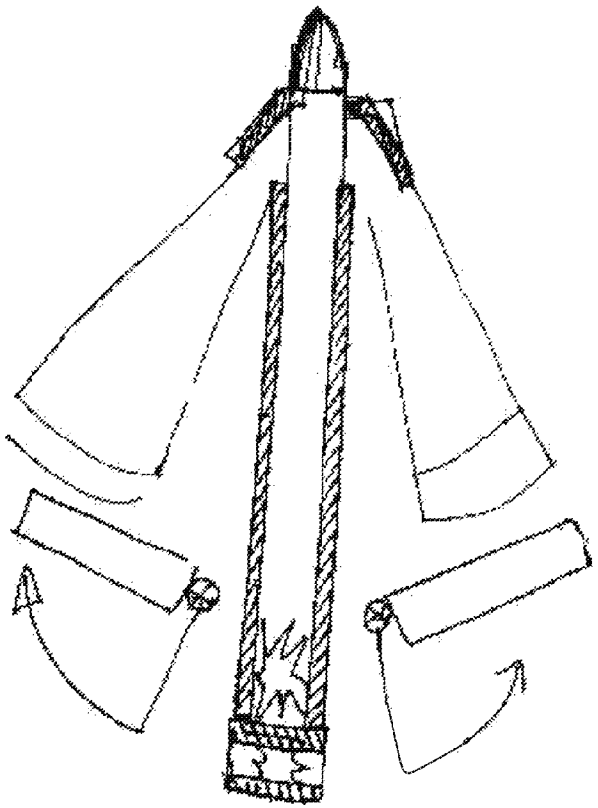
FIG. 38 schematically shows the use of a muzzle brake to deploy the inertia blocks.

FIG. 38 schematically shows the use of a muzzle brake to deploy the inertia blocks.

Figure 39:
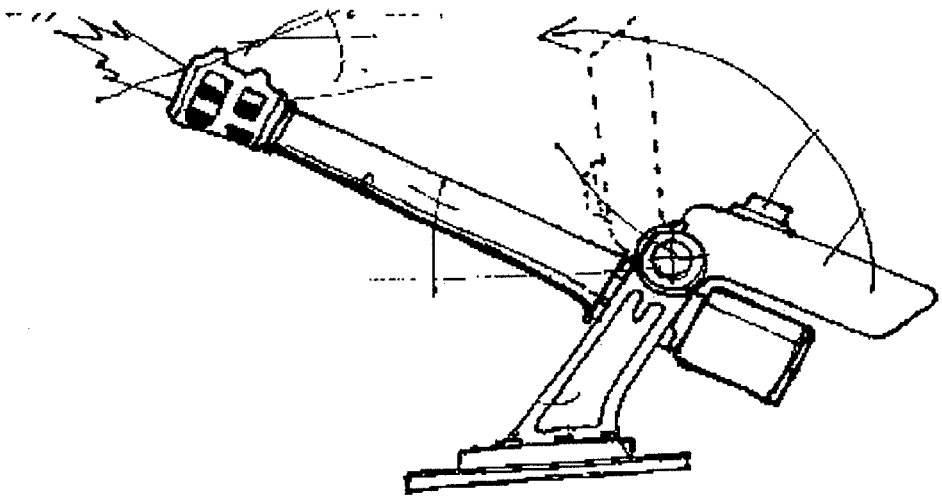
FIG. 39 shows an alternative embodiment and alternative movement of an inertia block.

FIG. 39 shows an alternative embodiment and alternative movement of an inertia block.

Figure 40:
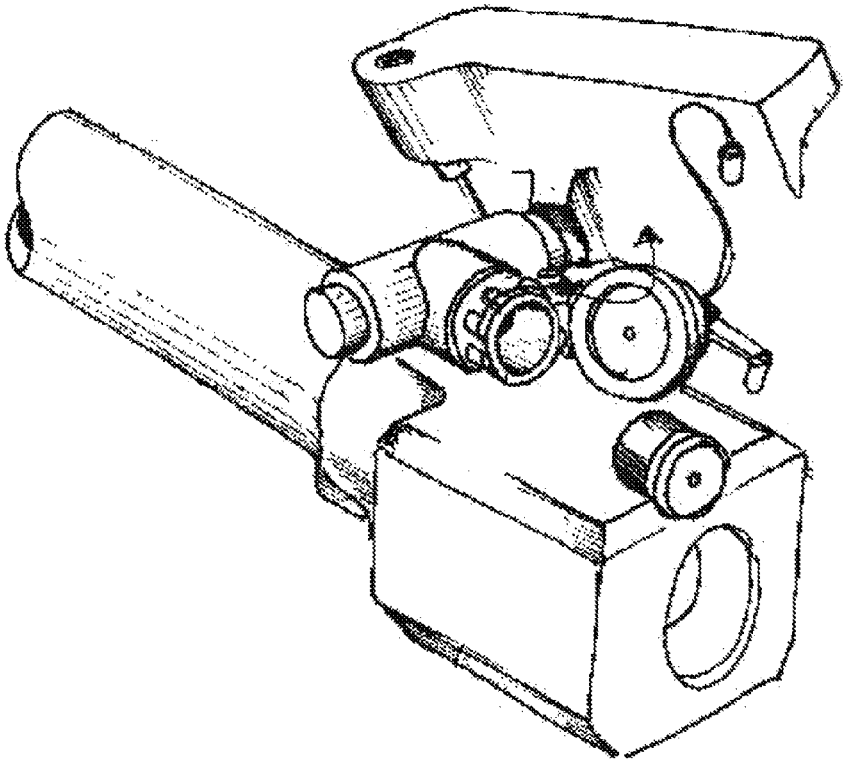
FIG. 40 shows one embodiment of an artillery cannon that uses a primary charge to initiate motion of an inertia block.

FIG. 40 shows one embodiment of an artillery cannon that uses a primary charge to initiate motion of an inertia block.

Figure 44:
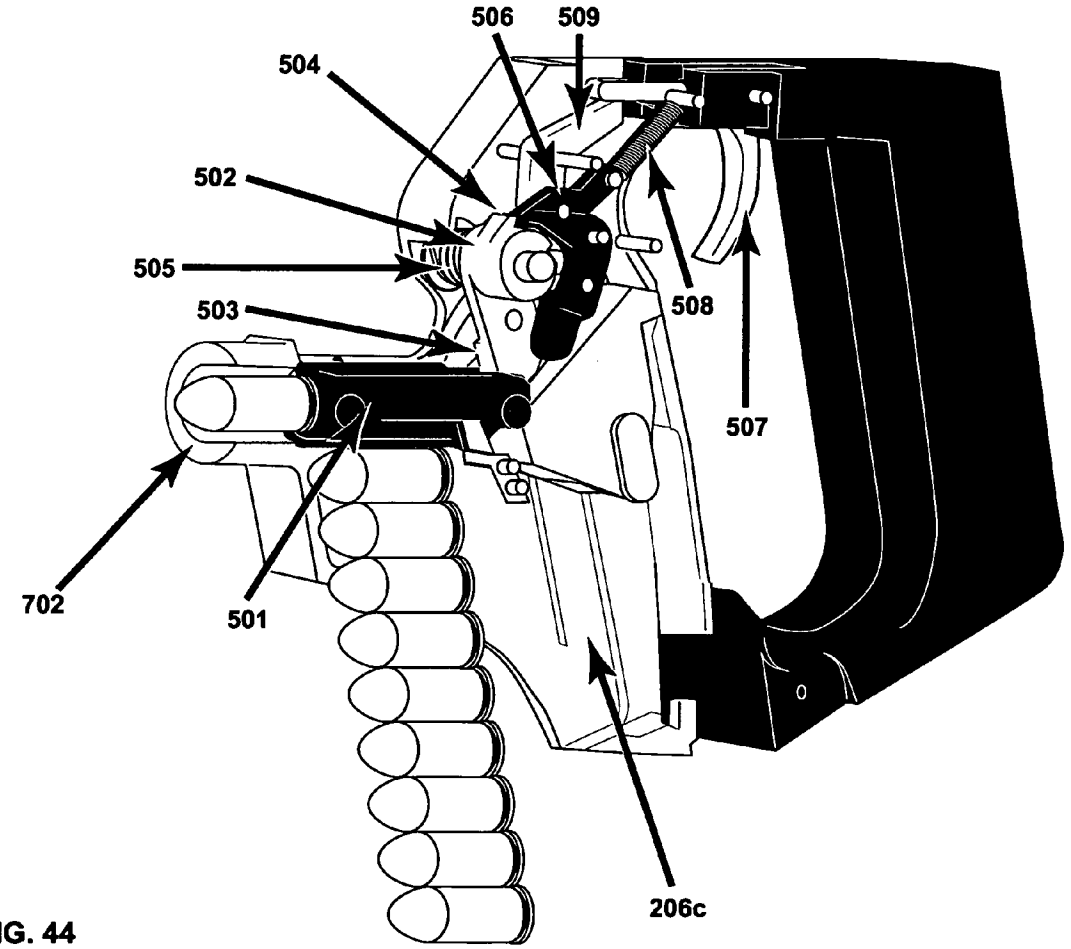
FIGS. 44-46 show a series of cutaway views of the operation of the mobile breech and slider in a handgun or rifle embodiment.
Figure 45:
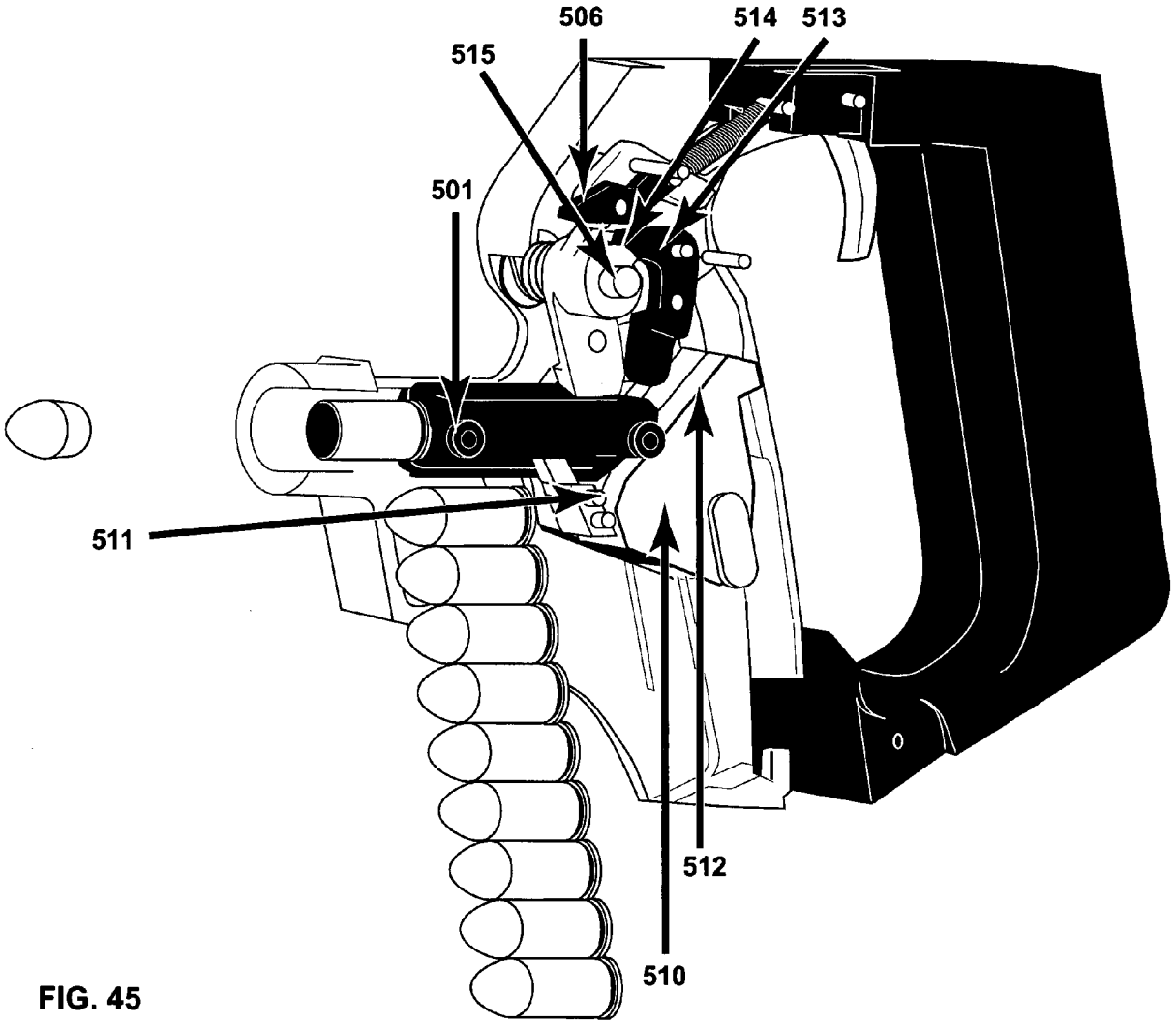
Figure 46:
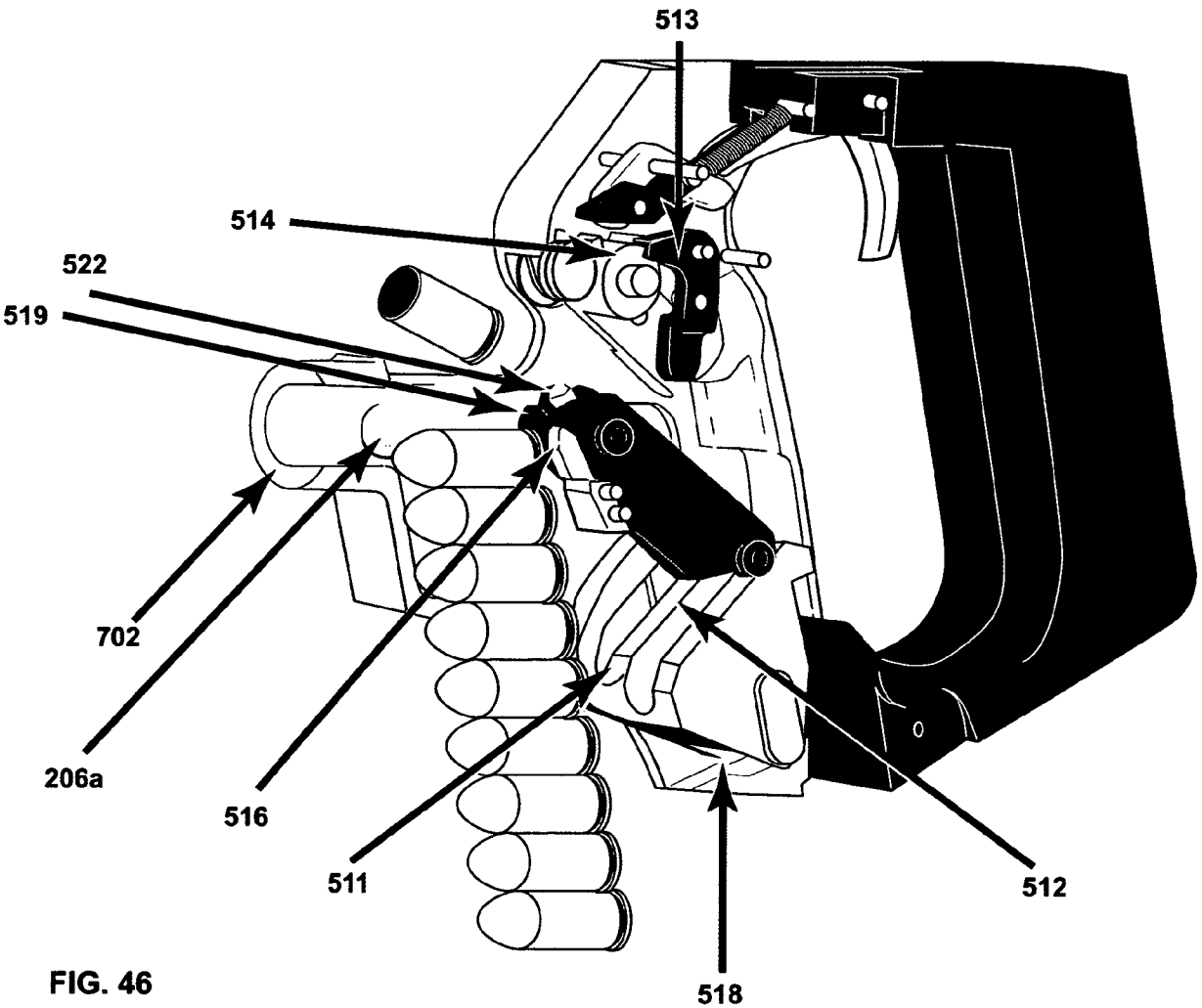

FIGS. 44-46 show a cut-away view of the internal parts and the operation of the system in an exemplary embodiment. In FIG. 44, a cartridge is loaded and chambered in the barrel, with bolt (501) holding the cartridge securely. The bolt is designed to allow the hammer assembly (502) and more particularly the striking surface of the hammer (503) to rotate through a slot to cause the cartridge to fire. At the point shown in FIG. 44, however, the hammer assembly (502) is in a cocked position so that a notch (504) on the axial portion of the hammer assembly is engaged by the cocking lever (506). The hammer spring (505) provides forces to rotate the hammer. Trigger (507), which is held in tension through trigger spring (508), can be pulled to initiate operation of trigger mechanism and firing of cartridge. Pulling trigger (507) forces rocking lever (509) to move, which rotates hammer so that striking surface of hammer (503) is moved further away from cartridge. The cocking lever then rotates and disengages from notch (504) on axial surface of hammer assembly (502). The hammer assembly rotates on axis around its pin (515) allowing striking surface (503) to move.through slot on top of bolt to fire chambered round.

FIG. 45 shows the configuration just after firing. The bolt (501), with cartridge case held in place and in contact with bolt, begins movement backward. Initial sloped surface (511) of slider (510) can be seen as bolt moves into contact with second sloped surface (512) of slider. Bolt contacts hammer and causes hammer to rotate around pin (515), now rotating in the opposite direction compared to the firing configuration just described. As end section of bolt in contact with slider moves toward backward-most end of slider, slider moves downward along a guide or path (206*c*). The guide or path can be integrally formed as part of frame of the firearm, or optionally, guide or path can be an internal part of firearm. The hammer contacts separator (513) and separator rotates to engaged position on a second notch (514) on axial surface of hammer. If the trigger remains in pulled position, cocking lever (506) remains up so that it does not engage notch (504). The bolt tilts as it moves back (FIG. 46) so that ejector (516) and extractor (522) displace cartridge case from bolt and the projections on bolt (519). Slider moves downward to redirect recoil forces and counteract upward jerk of barrel. FIG. 46 shows bolt and slider at end of movement (518). Bolt and slider can be formed with one or more projections or tenons that are designed to move along or in paths defining a range of motion, as shown in slider or inertia block guide (206*c*) and bolt head guide (206*a*). A recoil spring or return device, not shown, forces slider up guide or path. Slider, in connection with bolt, pushes bolt upward and forward to engage next round from magazine. Bolt with engaged cartridge moves into chambered position for firing. Slider surface (512) contacts separator (513) to disengage separator from second notch (514) on axial part of hammer assembly, freeing hammer to again rotate on axis around its pin (515), allowing striking surface (503) to move through slot on top of bolt to fire chambered round.

The operation just described is for automatic action. Semi-automatic, burst firing, and single round action can also be designed using available devices and technology. For semi-automatic action, a second cocking lever, with cocking lever spring, can engage a separate or existing notch on axial surface of hammer to catch hammer before it rotates down to fire cartridge. Thus, after each cycle of the slider and bolt, the second cocking lever for semi-automatic will prevent automatic firing and allow only one round to fire per trigger pull. One of skill in the art can adapt the cocking lever or add an additional cocking lever so that it engages a notch on the axial surface of the hammer after each time the hammer moves backward after firing. The cocking lever used for the semi-automatic action can be connected to a switch on the frame or a switch extending through the frame so that the operator can select between semi-automatic or automatic action. The switch effectively places the appropriate cocking lever in connective position with the notch on the hammer, or allows repeated firing through the movement of the separator. A burst firing mechanism can also be adapted, as known in the art, so that a certain number of rounds are fired automatically.

Additional safety options can also be implemented, as known in the art. For example, the handgrip and trigger, or handgrip and part of the trigger mechanism, can be designed to separate from the frame in order to prevent firing of the firearm. The handgrip and trigger components can further be equipped with personal security devices so that only designated users can assemble or operate the firearm.

Figure 43:
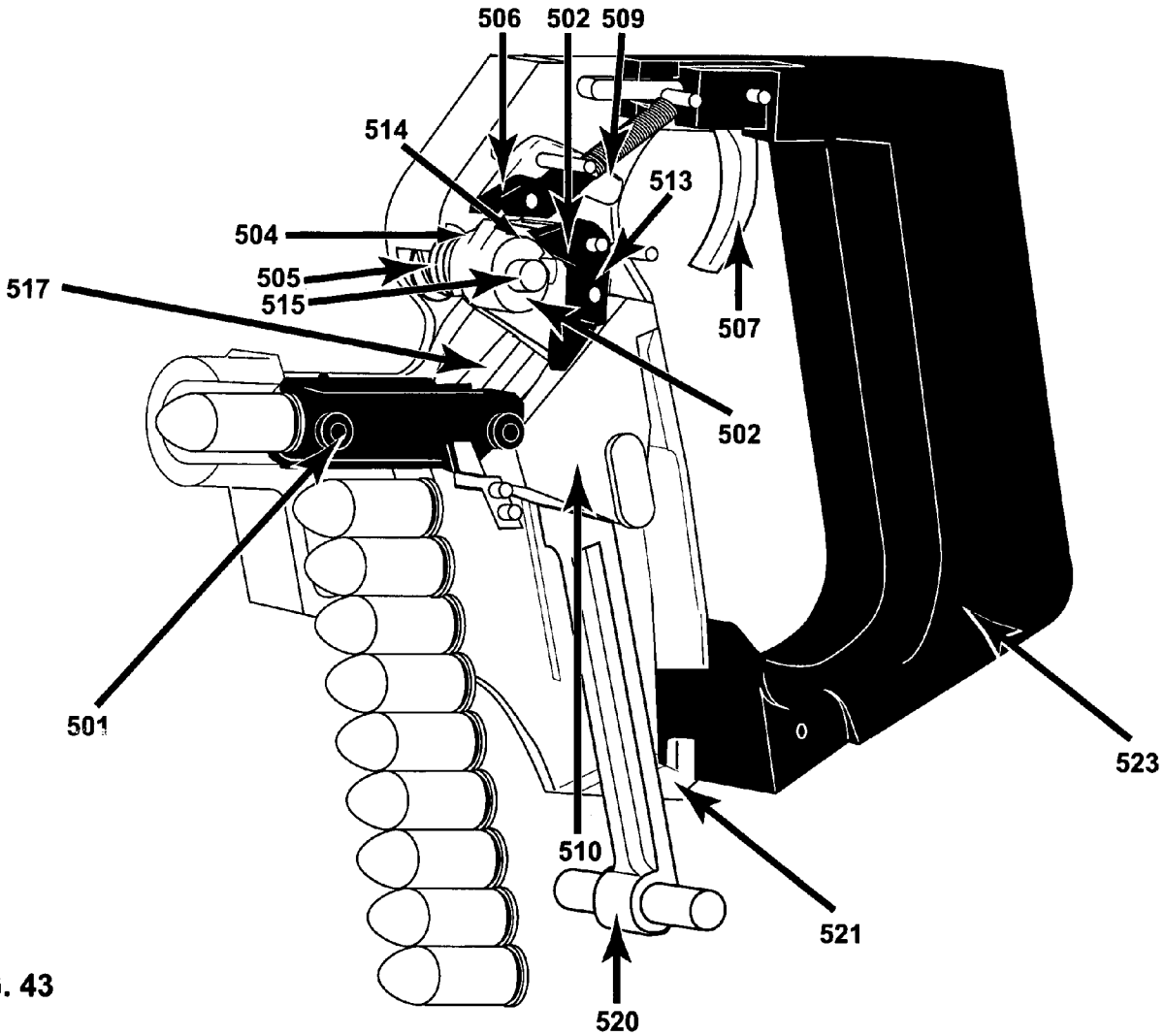
FIG. 43 shows a cutaway view of a semi-automatic or automatic handgun equipped with a slider similar to that shown in the embodiment of FIG. 41.

FIG. 43 shows a cutaway view of the same embodiment of FIGS. 44-46, except that an optional manual cocking lever (520) extends through the bottom of the frame. In the position shown in FIG. 43, the separator (513) is engaged in the second notch on axial surface of hammer (512), and the slider (510) is in position to contact separator from below to disengage it from notch (514) and release hammer (502) so that striking surface of hammer can fire cartridge. At top of handgrip (523) optional pins for connecting and quickly removing handgrip and part of trigger mechanism can be seen. Here, slider is linked to bolt (501) through pin (not shown) extending through slot (517) in slider.

Figure 41:
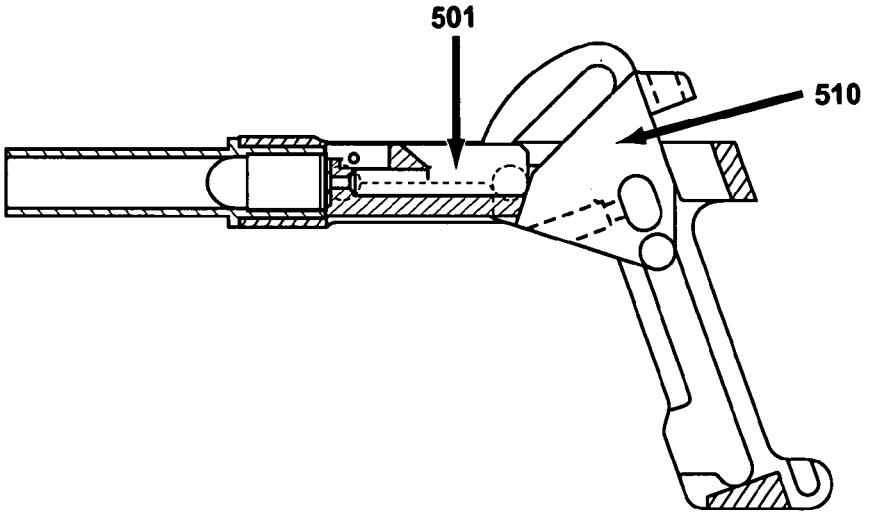
FIG. 41 is a schematic of the mobile breech and the reciprocating operation of a preferred double-angled slider embodiment of the recoil control device according to the invention. The slider (510) and bolt (501) are shown at the chambered or loaded position in FIG. 41.
Figure 42:
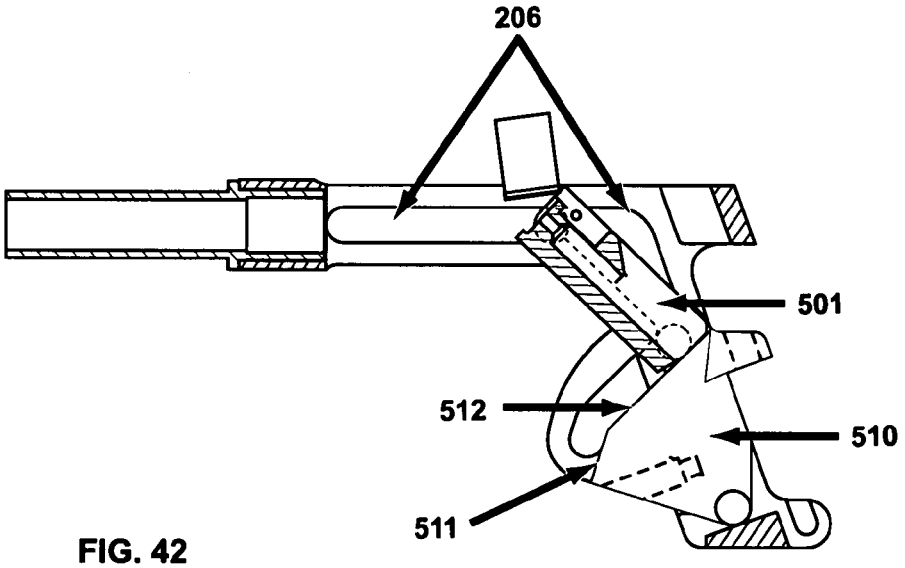
FIG. 42 shows a schematic as in FIG. 41, after the cartridge has fired and the bolt (501) and slider (510) have moved backward and downward. The cartridge case can be seen being ejected from the bolt head. The initial angle (511) or first sloped surface of the slider can be seen in this double-angled slider configuration, where sloped surface (512) makes up the remaining part of the slider surface in contact with bolt (501) or bolt linkage device. The bolt or an integral part of the bolt may contact the slider surfaces, or a linkage part or combination of linkage parts, such as rods and pins, may contact the slider surface.

FIGS. 41-42 show schematically a double-angled slider (510) and its movement in a receiver with guide (206). Bolt (501) is linked to slider and initial surface of slider (511) and second sloped surface of slider (512) are visible. In FIG. 42, the spent cartridge case is being ejected from bolt head.

Figure 47:
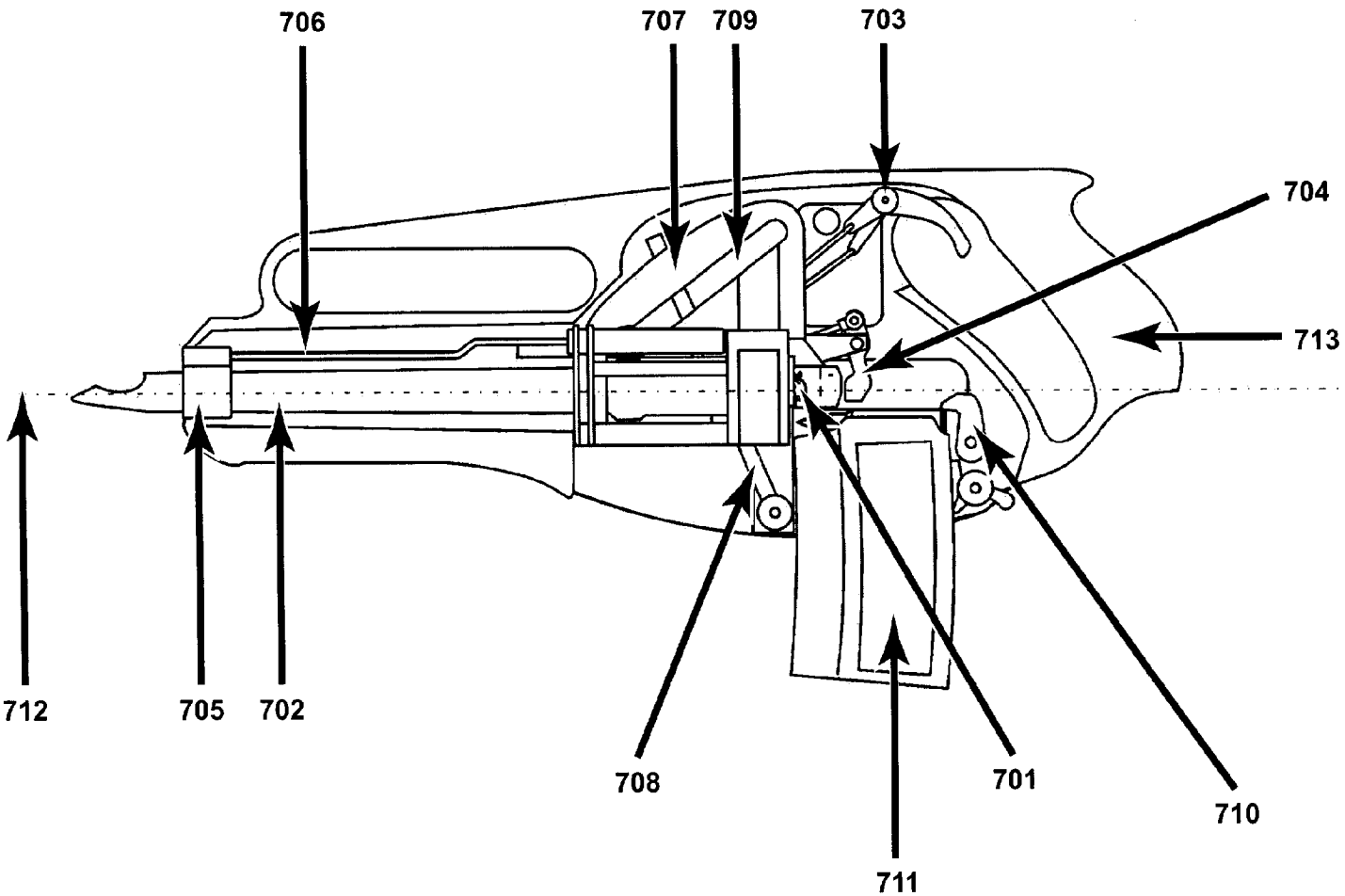
FIGS. 47-48 show a cutaway view of an alternative embodiment, where a slider is placed above the barrel and slides downward from a position in front of and to the side of the breech.
Figure 48:
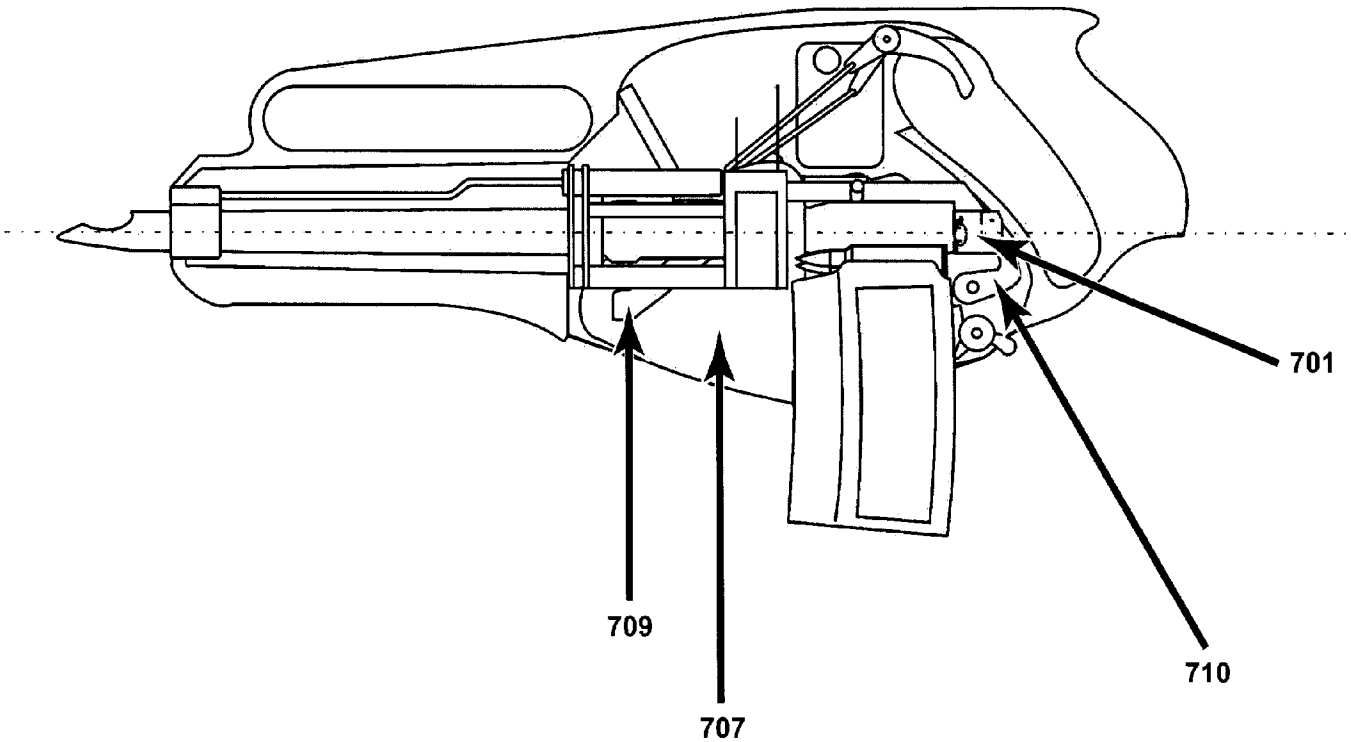

While the embodiment of FIGS. 41-45 can be used for a handgun, the same mechanisms can be adapted for a rifle. Additional options can be incorporated to either the handgun or rifle. In one example, which can be suitable for 0.308 caliber ammunition, a gas injection system can be incorporated. Further, as shown in FIGS. 47-48, the slider can be positioned in other areas of the firearm. FIGS. 47-48 show a slider positioned above the barrel and in front of the bolt. In FIG. 47, bolt (701) is in loaded position at chambering end of barrel (702). A trigger mechanism (703) causes hammer (704) to fire cartridge. The gas injection system (705) forces pressurized air through tube (706), which initiates movement of bolt (701) back and slider (707) down path defined by return device (708). Typically, a spring is used as the return device. Movement of the slider down its path redirects recoil forces and virtually eliminates upward jerking of the barrel upon firing. Slot (709) in slider connects with initial gas impulse transferring mechanism (not shown). Either a single-angled or double-angled slider can be selected, or indeed, a multiple-angled slider or slider with multiple shapes on its surface. Here, a single-angled slider is shown in FIG. 48 and the lower end of slot (709). In FIG. 48, the slider (707) has moved to its downward-most position. Feeding lock (710) releases next round from magazine (711), which can be chambered by bolt (701). As in FIGS. 41-45, the firing action can be single-shot, semi-automatic, burst firing, or fully automatic. In addition, with this and other embodiments herein, an electronic or other non-mechanical firing mechanism can be used.

Figure 72:
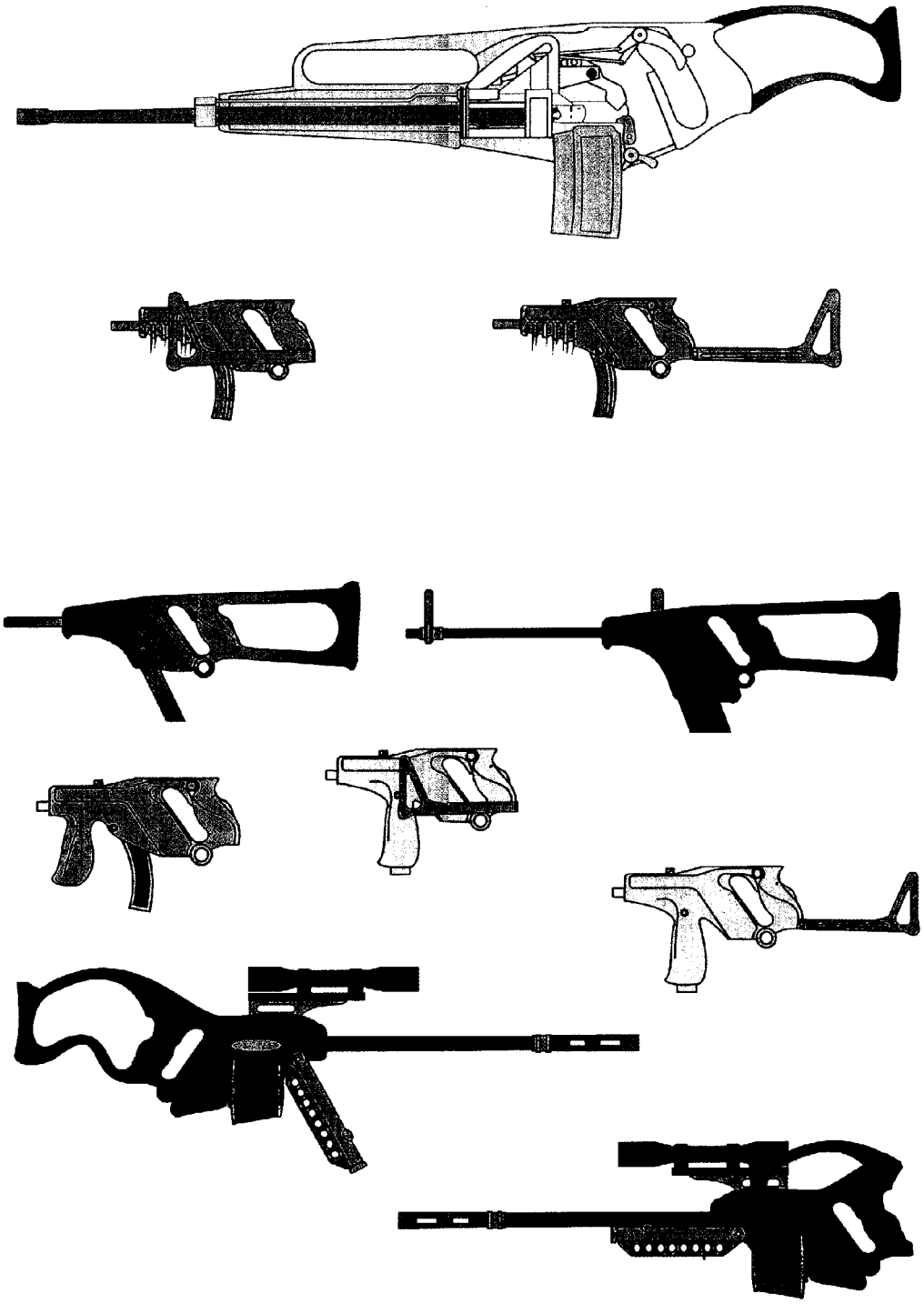
FIG. 72 shows a number of design alternatives in the configuration of a small caliber firearm incorporating the invention. These variations show, inter alia, the options in placing the handgrip relative to the middle of the axis of the barrel and the design freedoms allowed by the compact and reliable operation of a firearm of the invention. In one embodiment, the inertia block, with slot for connecting to the bolt head, is seen above the barrel of the firearm.

As shown in FIGS. 47-48, the placement of the handgrip (713) relative to the middle of the axis of the gun barrel (712) can take advantage of reduced interior clutter the new recoil devices allow. For handguns in particular, the handgrip is positioned below the middle of the axis of the barrel. This exacerbates recoil effects and adds to the reactive upward jerking upon firing. In firearms of the invention, as shown for example in FIGS. 47 and 48, the handgrip can be positioned at a point where the middle of the axis of the barrel intersects a line at approximately 70% of the height of the handgrip relative to the top of the handgrip. In the embodiment of FIGS. 43-46, the middle of the axis of the barrel intersects the handgrip at approximately 50% of the height of the handgrip. The range of possible positions for the handgrip relative to the middle of the axis of the barrel can vary by design factors or by the desired recoil control characteristics. In a preferred embodiment, the handgrip is positioned so that the axis of the gun barrel is in line with the middle of the wrist, or positioned at a line formed by the middle of the arm through the middle of the wrist of the operator holding the handgrip. Alternatively, the middle of the axis of the barrel can intersect the handgrip at a range of positions, for example, from about 10 to about 30% of the height relative to the top, from about 30 to about 50% of the height, from about 50 to about 70% of the height, from about 70 to about 90% of the height, or about 5 to about 95% of the height. In fact, the middle of the axis of the barrel can even be below or above the handgrip. In addition, other parts of the frame can be modified to allow both hands to grip the firearm. FIG. 72 shows a number of examples.

FIG. 41 is a schematic of the mobile breech and the reciprocating operation of a preferred double-angled slider embodiment of the recoil control device according to the invention. In FIG. 42 the slider is at the lowest end of its cycle and the bolt head is at the back-most end of its cycle. FIG. 41 shows the same slider embodiment at its closed position, where the slider is at the upper end of its cycle and the bolt head is furthest forward.

In FIGS. 41-69, the mobile breech comprises bolt head and inertia block. As noted above, in a handgun or other embodiment of the invention, the inertia block can be referred to as a sliding mechanism or a "slider" and these terms are used interchangeably. The slider can take various forms, for example a trapezoid, but many other forms and shapes are possible. The slider is articulated with the bolt head close to its rear extremity, optionally by a transverse spindle, which can take the form of a machined tenon or pin on the bolt head projecting on either side. The bolt head can have a second tenon or pin, also projecting on both sides, in its foremost section that engages a guidance ramp to guide the cyclic path of bolt head. In this preferred embodiment, the performance of a semi-automatic or automatic firearm can be improved by using a double-angled slider, characterized by an oblique slot (517 in FIG. 43), comprising two sloped surfaces (511 and 512 of FIG. 46 or FIG. 42). The length of each sloped surface can vary. The forward-most sloped surface engages the bolt head or bolt head articulation mechanism when the round is chambered and/or when the bolt head is locked, so that the bolt head is prevented from moving backward (the configuration of FIG. 41 and 44, for example). While not required, the double-angled slider can perform more reliably in preventing the bolt head from moving than a slider having a single sloped surface. Also shown in FIGS. 43-48 is a trigger mechanism in operating linkage to the hammer, which strikes the cartridge on the bolt or the cartridge contacting the bolt. Conventional mechanisms can be adapted for use with the invention or in designing a firearm.

As shown in the figures, it is preferred to use large parts and integrated pins and receiving slots so that assembly, cleaning, and maintenance characteristics are improved. However, other operating or triggering mechanisms can be used with a firearm of the invention. One of ordinary skill in the art is familiar with the selection and use of a variety of triggering mechanisms for a variety of ammunition sizes and types, including those that can accommodate multiple sizes of ammunition.

The action of the mobile breech and bolt head can be controlled within its movement to appropriately chamber and eject successive rounds. As shown in the FIGS. 44-46 and 51-58, for example, the bolt head tilts relative to the barrel. At a point near or at the end of its backward and downward movement, the spent round is ejected using a conventional ejector and extractor device. As the magazine pushes the next round toward the barrel, here the magazine pushes upward but other directions can be selected depending on the placement of the magazine with respect to the barrel, the forward moving bolt head catches the end of the cartridge and inserts the round into the chamber.

In FIGS. 47-48, a configuration designed preferably for a 0.308 caliber or 7.62 NATO round is shown. The slider (707) here is positioned above and forward of the bolt head (701), and the cycle action takes the slider through a downward and upward trajectory. The slider and bolt head articulating mechanisms are located above the bolt head to conserve space for a magazine below the barrel. However, optional design configurations can also include slider and bolt head articulating mechanisms below the bolt head, to allow for magazines on the top of the barrel or above or to the side of the barrel. In the embodiment of FIGS. 47-48, a safety clip or feeding lock (710) is optionally included to prevent loading or firing of rounds at other than the desired time. The safety clip (710) moves in response to the cartridge and clips the top edge of each cartridge. These Figures also show a triggering mechanism. As before, the layout and design of the triggering mechanism can be selected from many available options and one of ordinary skill can devise an appropriate or preferred triggering mechanism. FIG. 47 shows the round chambered and locked, with the slider (707) at its utmost position. After firing, the slider moves to its fully displaced position (FIG. 8), partially or largely below the barrel. The slot (709) for connecting the slider to the bolt head can be seen in both Figures. In FIG. 48, the optional double-angled surface of the slider is visible.

Figure 59:
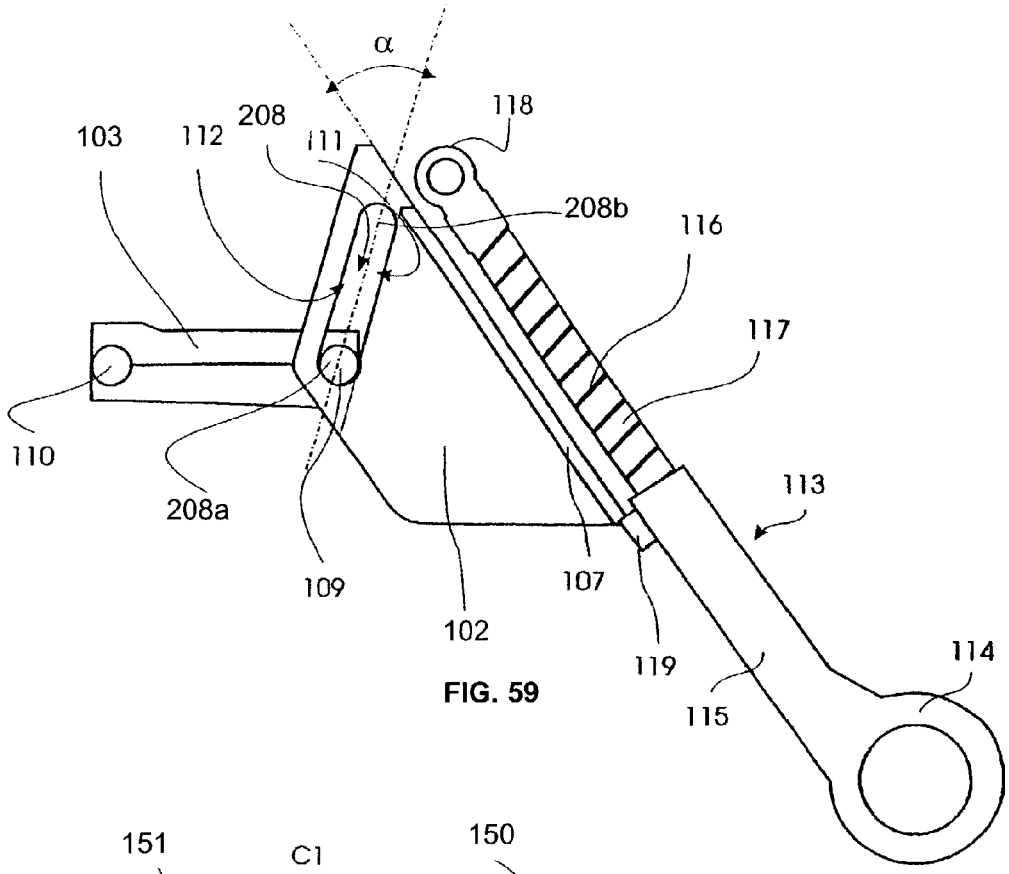
FIG. 59 is a schematic of the mobile breech and the reciprocating operation of a preferred single-angled slider embodiment of the recoil control device according to the invention.

In a preferred embodiment, the performance of a semi-automatic or automatic firearm can be improved by using a double-angled slider. As shown in FIGS. 43-46, the rear edge of slider (510) has a pair of lateral flanges extending from either side of the slider and positioned to slide in the guidance grooves of the guide or receiver. The guidance grooves have a slope relative to the axis of the barrel, which presents an angle ($\beta$), shown in FIG. 60, and preferably set between 30 and 36. In FIG. 59, the slope of the parts shown presents an angle ($\alpha$), the variance of which changes the firing rate of the firearm. The angle ($\alpha$) preferably is between 24 and 36 degrees. For a 0.45 caliber embodiment, an angle ($\alpha$) of about 36 to about 37 degrees allows a firing rate of approximately 900 rounds per minute. An angle ($\alpha$) of approximately 32.5 degrees can correspond to a firing rate of approximately 2000 rounds per minute. There is a practical minimum value for angle ($\alpha$) below which mechanical blockage occurs and little or no articulation is possible. This minimum angle is a function of the power of the ammunition used, and is approximately 6 degrees for the standard 0.45 ACP ammunition of the Examples below. The use of two slopes in the slot or surface of the slider allows the designer to vary the rate of fire, to reduce or alter the mass of the slider, or reduce or alter the mass of the bolt for a given caliber ammunition.

Figure 49:
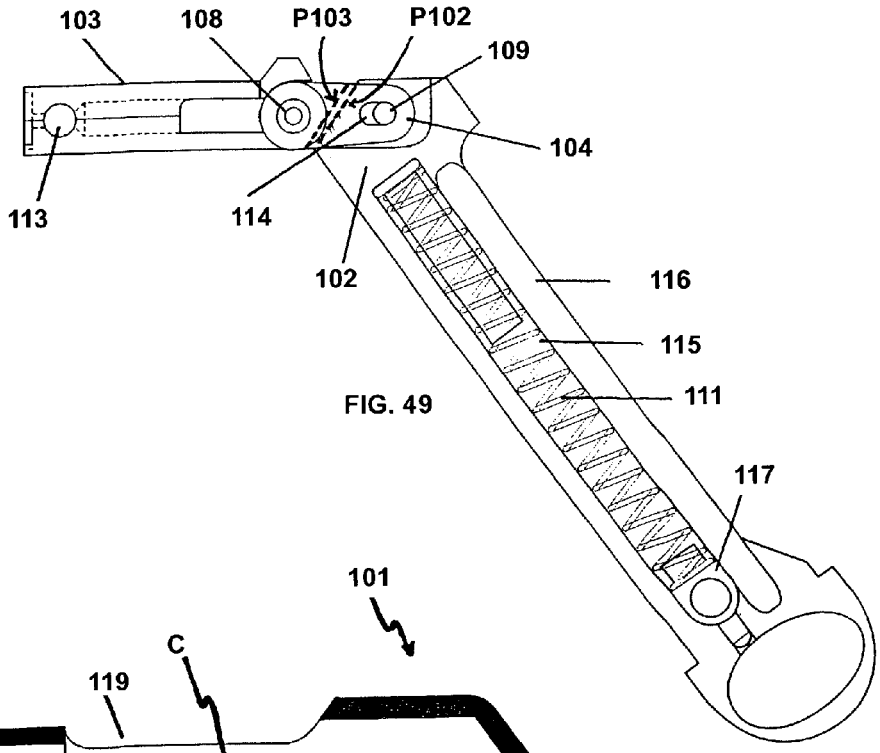
FIG. 49 shows the mobile breech for another preferred embodiment of the recoil control device, with an alternative type of action.

FIG. 49 shows the mobile breech, which consists of bolt head (103), pin rod (104) and inertia block (102). The pin rod (104) preferably is joined to the bolt head (103) close to its rear extremity by means of a transverse spindle (108) projecting on both sides of bolt head (103). The front of the bolt head preferably has a transverse stud or linking-pin (113) also projecting on both sides of bolt head (103). The pin rod (104) preferably is articulated in proximity to its second end by a transverse stud or spindle (109) with the forward part of the inertia block (102). The transverse stud (109) engages a longitudinal groove (114) in the pin rod (104). FIG. 49 shows the mobile breech in extension, with transverse stud (109) in the back of groove (114). The bolt head (103) and the inertia block (102) may or may not be in contact. Inertia block (102) and bolt head (103) present complementary sloping contact surfaces (P102 and P103, respectively), which preferably are separated somewhat by some minor play engendered by groove (114). When stud (109) slides in groove (114), the surfaces of the bolt head and the inertia block make contact at their sloped ridges, (P102 and P103), which are parallel.

The inertia block (102) is generally cylindrical and oblong in form. In the back is a recess (115) in which is fitted a reset spring (111). The tip of the spring bears a part (117), which slides at compression and links with the bolt housing. The inertia block has longitudinal flanges (116) on either side designed to fit the housing's guidance slots.

Figure 50:
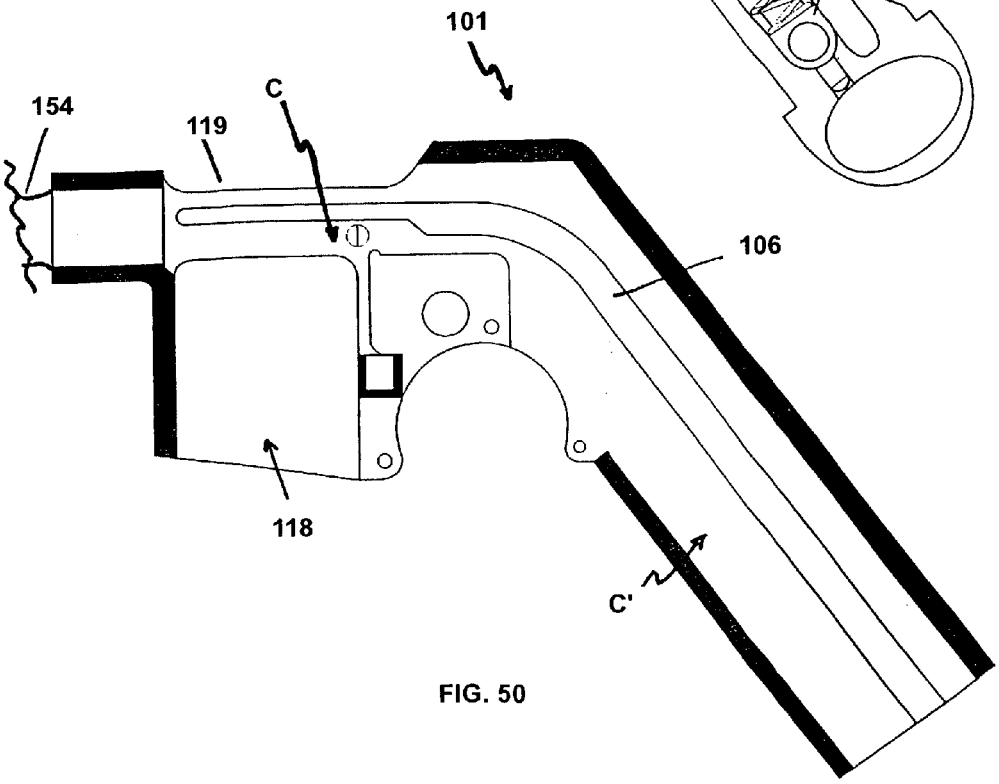
FIG. 50 shows a longitudinal cutaway of the housing for the embodiment of FIG. 49.

This mechanism fits within the breech housing (120) shown in cutaway in FIG. 50, the general "V" form of which creates a cavity also in "V" shape, with two arms, C and $C_1$. The breech housing at its forward extremity supports the gun barrel (154) and receptacles for a magazine underneath (118). It has an ejection slot (119) situated in the top of this embodiment. Alternately, the slot could be located laterally without prejudice to the performance of the mechanism.

As illustrated in FIG. 50, each side of the casing preferably has a guidance ramp (106) in "V" shape in the form of a groove accommodating the respective projections of the spindles (108 and 109) articulating the bolt head (103), with the pin rod (104) and with the inertia block (102), as well as the extremities of stud (113) and flange (116). The head of the V of the ramp is rounded.

FIGS. 51 to 58 show the movement of a pistol equipped with a moment control mechanism similar to that shown in FIGS. 49 and 50. The trigger, percussion and ejection mechanisms are not shown to simplify the drawing. To the extent not described herein, triggering, percussion, and ejection may be accomplished by conventional methods well known to those skilled in the art.

Figure 51:
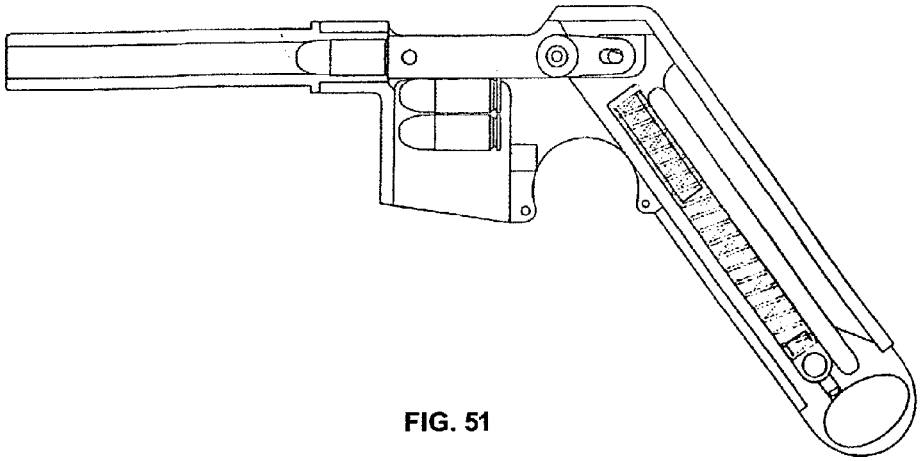
FIGS. 51-58 show the functioning of the embodiment of FIG. 49.

FIG. 51 shows the embodiment of FIG. 49 with bolt closed. A round is chambered. The bolt head (103) is in its position preceding percussion. The trigger has been pressed and the cartridge is on the point of being struck. Note that the mobile breech is extended with the transverse spindle (109) linking inertia block (102) and pin rod (104) in the back of the oblong slot that houses it. However, in this angular configuration, the bolt head (103) and the inertia block (102) are separated only by a very slight play.

Figure 52:
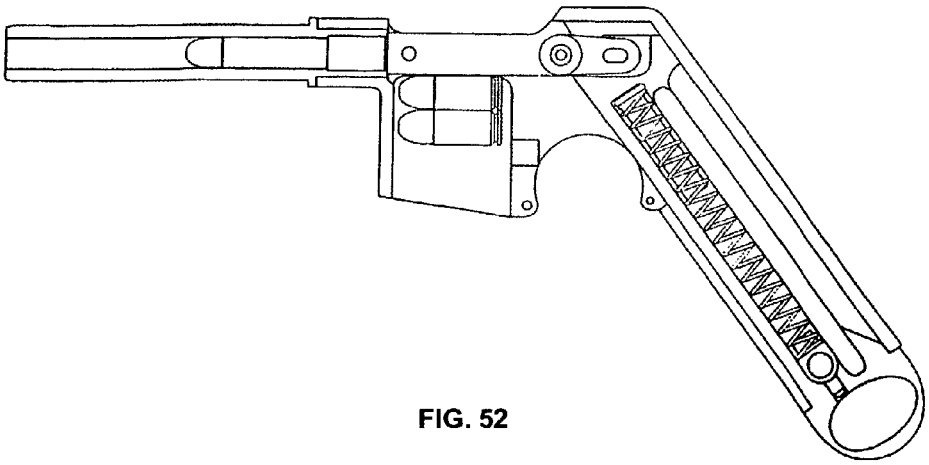
Figure 53:
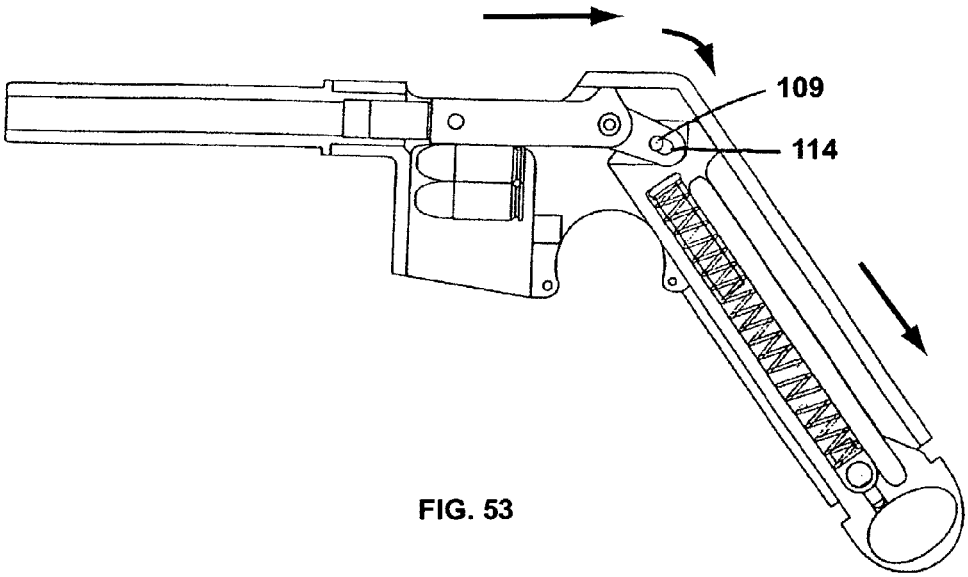

In FIG. 52, the cartridge has been struck, the round has left the gun and the spent case moves back and pushes against the bolt head (103). In turn, the bolt head (103) moves backward along the axis of the barrel and strikes the inertia block (102), which rapidly translates from its initial forward position to its aft most position in the butt of the gun as shown in FIGS. 50-52. In FIG. 53, the first movement of the bolt head (103) is a translation backwards and the movement of the inertia block (102) is a slanted translation towards the lower sector of the gun, while the trajectory of the pin rod (104), guided by the top of the "V" of the ramp, is deflected around the curve of the V. At this stage, the spindle (109) slides in groove (114). The pin rod (104) exerts no force on the inertia block (102) and does not pull on the bolt head (103). The extensions of transverse spindles (108 and 109) constrain the movement of the spindles to follow the curved path of guidance ramp (106).

The slopes P102 and P103 initially slide against each other, imparting an impulse from pin rod (104) to inertia block (102), then separate.

Figure 54:
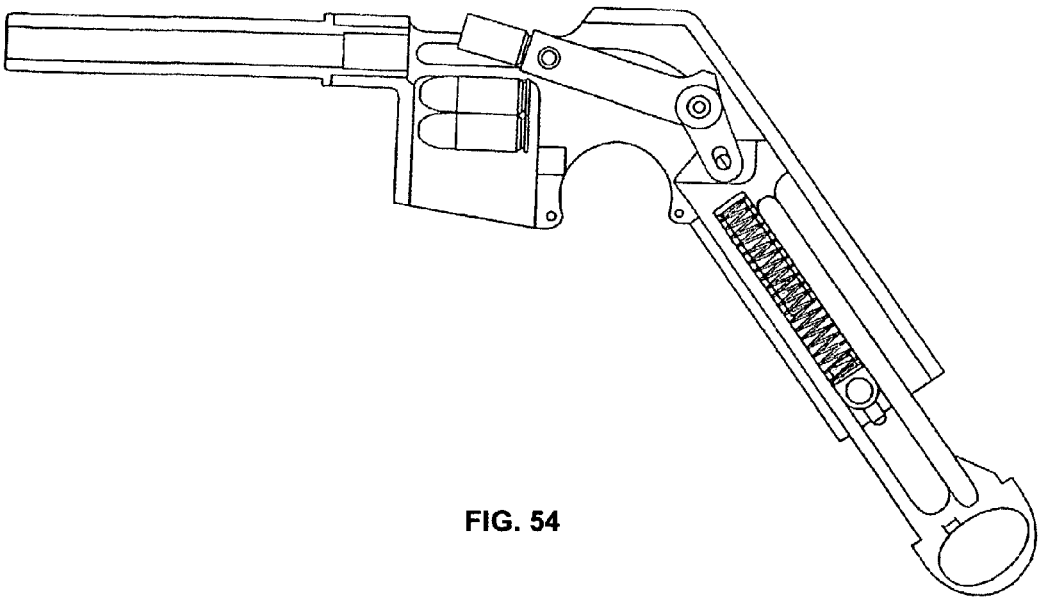

In FIG. 54, the inertia block (102) is continuing its translation downward. It pulls on the pin rod (104) and the bolt head (103). The mobile breech is extended. The spent case is forced backward by the ejection mechanism in familiar technique.

As the mobile breech continues its displacement in extension, the spindles (108) and (109) go over the rounded "V" of the guidance ramp (106) and the trajectory of the bolt head (103) is deflected downward.

Figure 55:
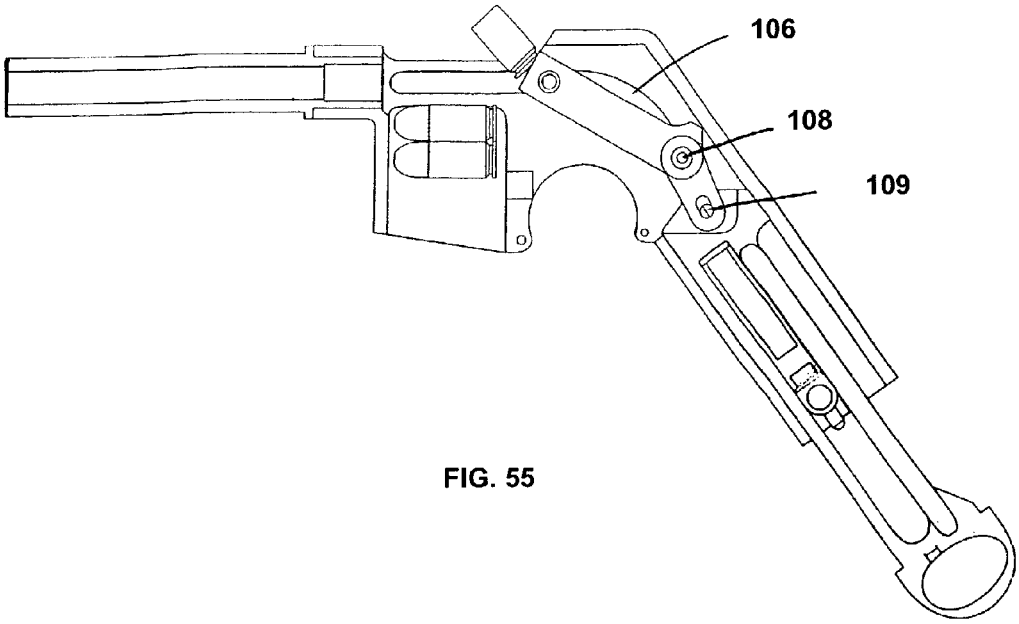

In FIG. 55, the mobile breech is back as far as it can go. The recovery mechanism (111), shown here as a return spring, has absorbed the maximum of recoil energy. The spent case is being ejected conventionally.

Figure 56:
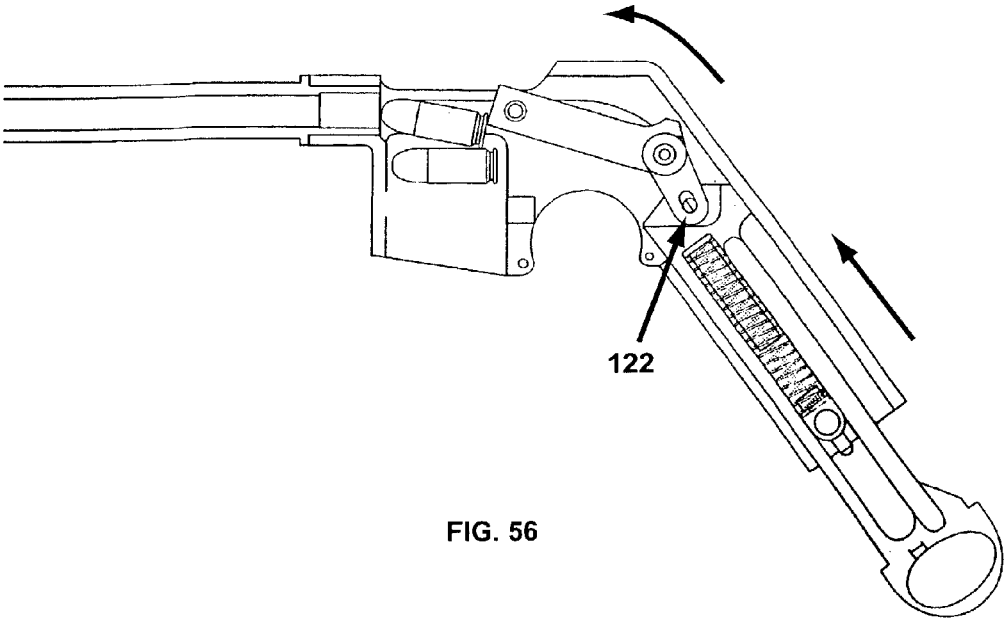

In FIG. 56, the case has been ejected and the mobile breech is returned forward by the return spring. Due to its shape and orientation, the pin rod (104) is thrust up against an edge (122) of the inertia block (102) and holds the mobile breech in extended position during this phase of its return. The bolt head (103) extracts a new round from the magazine in a manner familiar to those skilled in firearms technique.

Figure 57:
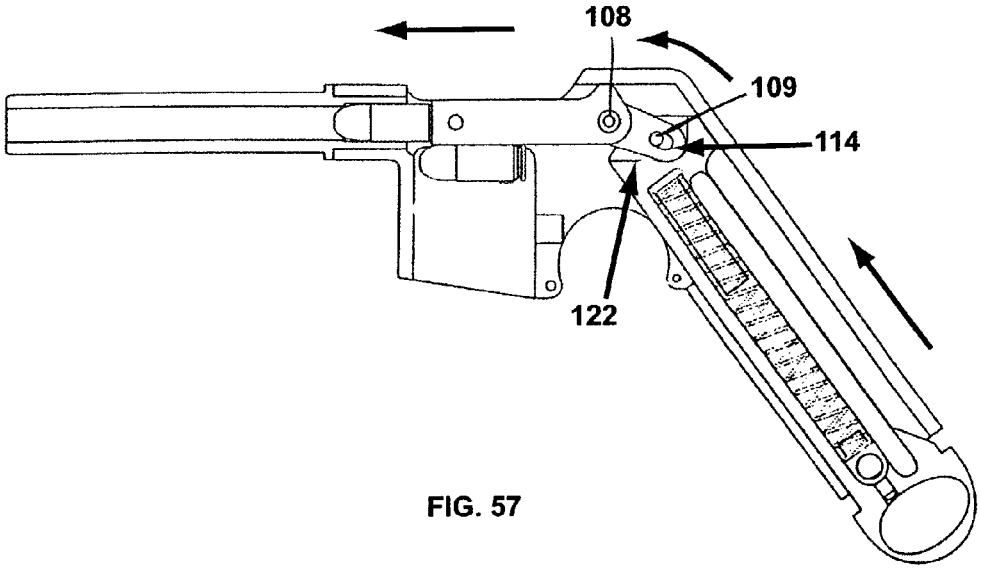

The mobile breech's movement forward continues as illustrated in FIG. 57. When the spindle (108) goes over the rounded top of the guidance ramp, the orientation of the pin rod (104) changes, so that it is freed from the edge (122) of the inertia block. The spindle (109) slides forward in the slot (114) and the mobile breech recovers its compact configuration while bringing another round in line with the barrel.

Figure 58:
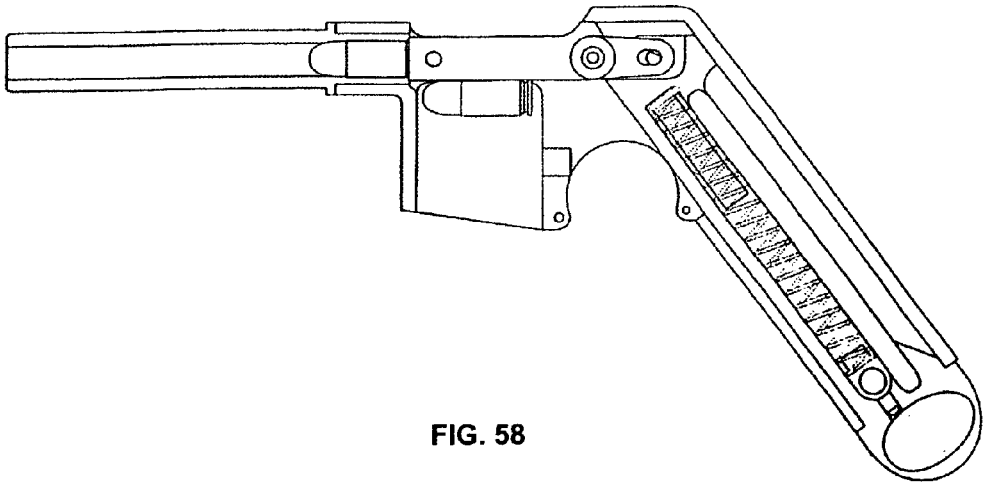

In passing from the stage shown in FIG. 57 to the phase shown in FIG. 58, the cartridge is chambered under pressure by the bolt head (103). It is in direct contact with the inertia block via sloped surfaces (P102 and P103), which slide over each other as the spindle (109) slides in the slot (114). The parts of the mobile breech have regained the configuration of FIG. 51.

In FIGS. 51 to 58, the moving parts act within a closed casing. The user is not in contact with critical moving parts, cocking lever or other components of the mechanism. This approach allows use of space normally neglected in pistols or in machine pistols having the magazine placed in front of the bridge, namely, the butt. The mechanism here described also enables reduction of the length of the bolt housing.

In yet another preferred embodiment, FIG. 59 shows the mobile breech, which comprises bolt head (103) and inertia block (102). The inertia block (102) is articulated with the bolt head (103) close to its rear extremity, preferably by a transverse spindle (109), which can take the form of a machined tenon on the bolt head projecting on either side. The bolt head has a second tenon (110), also projecting on both sides, in its foremost section that engages guide ramp (106) to guide the cyclic path of bolt head (103). The spindle (109) can slide within the oblique slot (208) housed in the anterior section of the inertia block (102). FIG. 59 displays the mobile breech in a position corresponding to the one at percussion: the spindle (109) is in the forward-down extremity of the slot (208). The slot (208) of the inertia block (102) has, one turned toward the other, two parallel lateral slopes (111 and 112) of the same pitch (P1), separated in order that the spindle (109) lodges with slight play in the direction of the gun barrel's axis. When the spindle slides in the slot (208), the bolt head (103) alternately makes contact with either the backward lateral slope (111) or the forward lateral slope (112) of the slot (208).

The inertia block (102) preferably has the form of a trapezoid. In a handgun or small caliber embodiment, the inertia block can be referred to as a sliding mechanism or a slider and these terms are used interchangeably herein. As shown in FIG. 59, the full length of the rear edge of inertia block (102) has a pair of lateral flanges (107) extending laterally from either side of the inertia block (102) and positioned to slide in the guidance grooves (105) of the breechblock, as shown in FIG. 59. Guidance grooves (105) have a slope (P2), which presents an angle ($\beta$), shown in FIG. 60 and preferably set between 30 and 36 degrees in relation to the axis of the barrel. In the configuration shown in FIG. 62, the flange (107) also has a slope (P2) in relation to the axis of the barrel, which itself is horizontal. The flange (107) of the slope (P2) and the longitudinal axis of the slot (208), with slope (P1), present an angle ($\alpha$), which is preferably between 24 and 36 degrees.

The recoil energy recuperation mechanism is shown in FIG. 59 to the right of the inertia block (102). The recuperation mechanism includes a cocking lever (115) with a ring (114) to enable manipulation. The cocking lever (115) is hollow and forms a sleeve for the return spring (116). The spring (116) is turned around a rod (117). The cocking lever (115) slides over it in compressing or extending the return spring (116). The rod (117) is linked with the upper end of the breech block via ring (118) at fitting (150). A lug (119) on the cocking lever (115) manipulates the inertia block (102) conventionally. At the forward extremity of the Y (C1), a stud (151) is provided to anchor the trigger mechanism.

Figure 60:
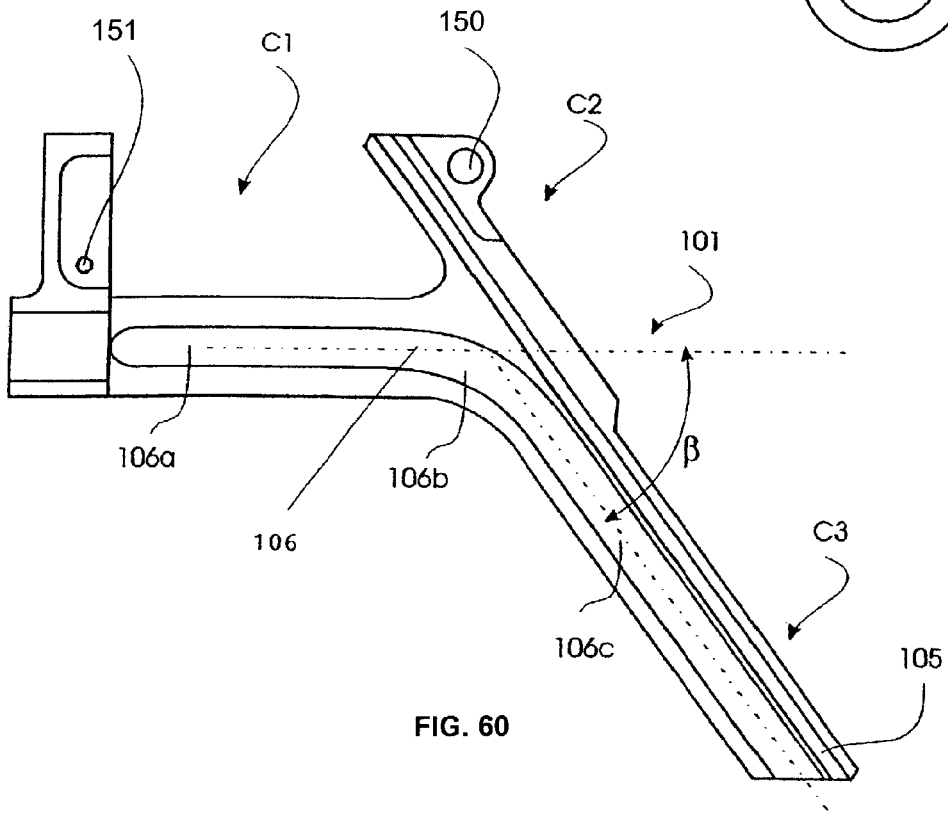
FIG. 60 is a longitudinal cutaway view of the housing or guide for the mobile breech showing the path of movement for the mobile breech shown in FIG. 59.

This mobile breech and recuperation mechanism operate within the breech block (101) as shown in cutaway in FIG. 60, its form preferably roughly that of the letter Y, having three arms, C1, C2, C3, and creating a guidance ramp (106) in roughly the form of the letter V.

FIG. 60 shows, on each side of the breech casing, a guidance ramp in the form of a "V" in a groove (106), which accommodates, respectively, the extremities of the spindle (109) which articulate the bolt head (103) with the inertia block (102), as well as the extremities of a tenon (110), which guides the forward end of bolt head (103). The head of the V of the guidance ramp (106) is rounded. The front arm C1 of the breech casing bears the forward section (106*a*) of the groove (106), which is arranged in the extension of the axis of the gun barrel, and the rear arm, C3, of the breech casing bears the rear section (106*c*) of the groove (106). Rear section (106*c*) features a slope (P2) in relation to the barrel's axis, which presents an angle (β) between the axis of the rear section (106*c*) and the axis of the barrel, preferably between 30 and 36 degrees. Each side of the breech block also features a groove (105), which is substantially parallel to the section at (106*c*) of the groove (106), and set to accommodate a flange (107) of the inertia block (102), which extends from section (C3) into the upper Y (C2) of the breech block.

In FIGS. 61 to 66 illustrate the functioning of a semiautomatic or automatic handgun equipped with the recoil control device shown in FIGS. 59 and 60. Sighting, percussion and ejection functions, are not shown in order to ease understanding of the recoil control device.

Figure 61:
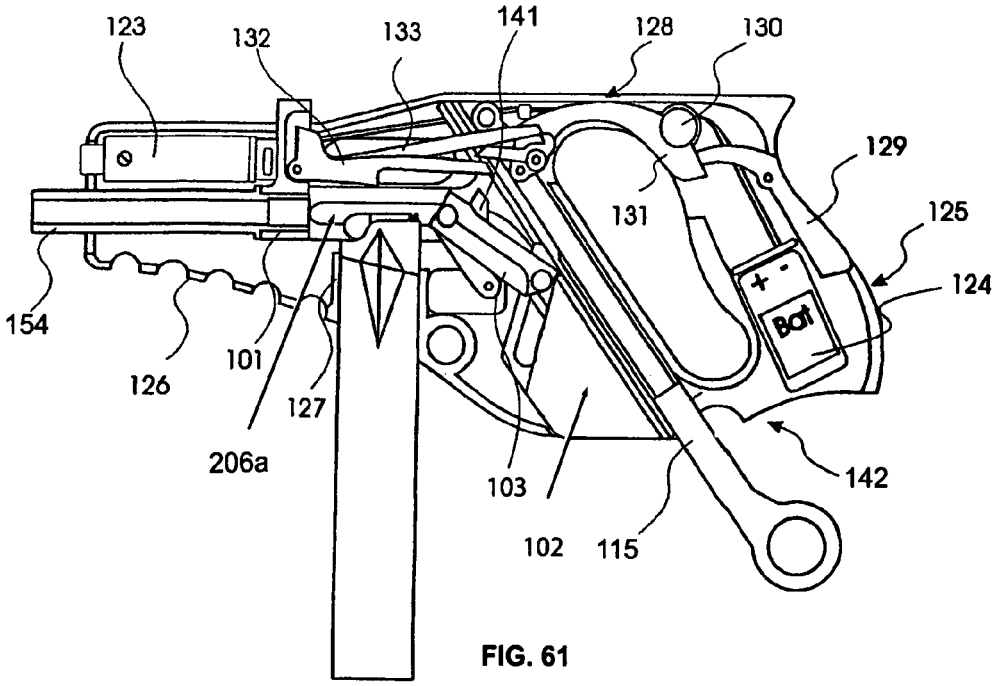
FIGS. 61-66 illustrate the action of a single-angled slider similar to the embodiment shown in FIGS. 59 and 60. Here, the firing mechanism is electronically powered.

The bolt head (103) preferably contains the percussion device. FIGS. 61 and 66 show the top of the hammer lug (141) projecting over the head of the bolt head (103). The technique governing the action of the hammer and its integration with the internal release are conventional. FIGS. 61 to 66 also show an optional infrared sighting device (123) mounted on the barrel and a battery (124) housed in the handgrip (125) to service it. The gun barrel (154) and the infrared sight (123) are contained within a sleeve for protection.

At its forward extremity, the breech block (101) supports the barrel (154). An ejection slot preferably is laterally placed and fitted with receptacles for a magazine below.

As shown in FIGS. 61 to 66, the breech block and the mobile breech are integrated into an exterior housing offering a minimum of exposed moving parts. The recoil energy recuperator is housed at the back of arms C2 and C3 of the breech block. A grip is located behind the recuperator that preferably is linked with the housing enclosing the breech block, both by lower arm (142), and upper arm (128). The grip (125) contains a safety lever (129) and the automatic or semi-automatic switch (130). The firing device (131) is preferably located in the part of the housing (128) that links the upper portion of the grip with the breech lock. The principal internal trigger (135) and the automatic internal firing release (132) are located in front of firing device (131) and are articulated at the upper extremity of the C1 arm of the breech block at stud (121). The functioning of these parts is conventional. Their placement in the overhead portion of the housing is specific to the embodiment of FIGS. 59-66.

In FIG. 61, the cocking lever (115) has been pulled. The inertia block (102) has been forced downward by the intervention of lug (119) as shown in FIG. 59, causing the bolt head (103) to move backwards. The spindle (109) and the tenon (110) in FIG. 59 have moved into position respectively on either side of the round corner (106*b*) of the V groove of guide (106) shown in FIG. 60. When the cocking lever (113) is pushed back, it forces the mobile breech forward by the lug (119). The bolt head (103) loads a round in the chamber in the usual way.

Figure 62:
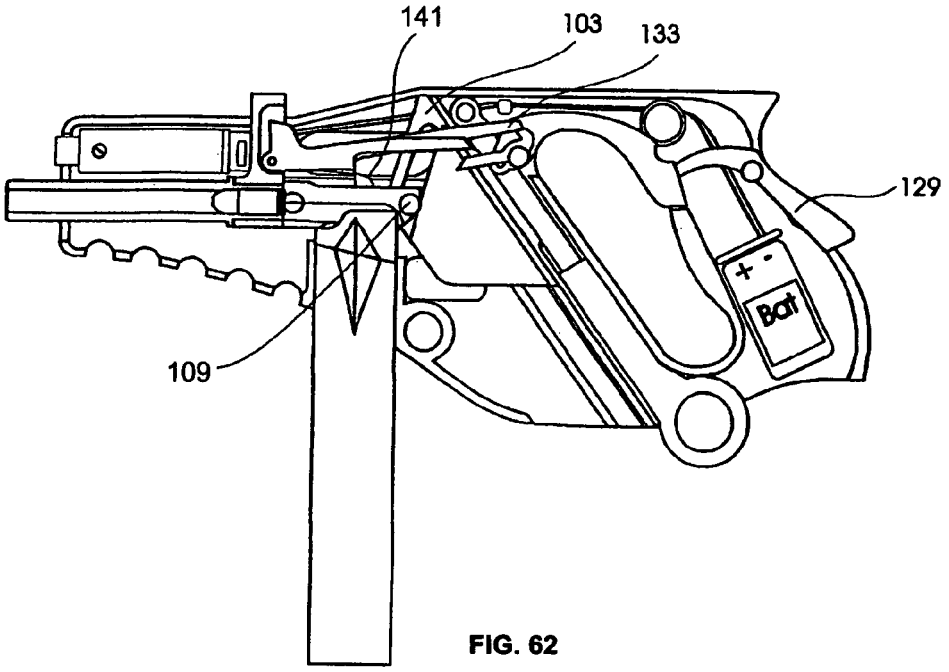

FIG. 62 shows the embodiment of FIG. 61 with the breech in closed position. A round is chambered. The bolt head (103) is in the pre-percussion position. Hammer lug (141) of the hammer is socketed in an indentation of the principal tumbler (133). The trigger can be actuated and the cartridge struck when the gun has been taken up and the safety catch is released. The inertia block (102) of the mobile breech is in a forward-up position, with at least an upper portion of the inertia block in position above the axis of the gun barrel. The transverse spindle (109) linking inertia block (102) and bolt head (103) is positioned in the forward-down (208*a*) portion of the oblong slot (208) of the inertia block (102), which houses it. In this configuration, the rear extremities of the bolt head (103) and the inertia block (102) are separated only by a slight margin of play.

Figure 63:
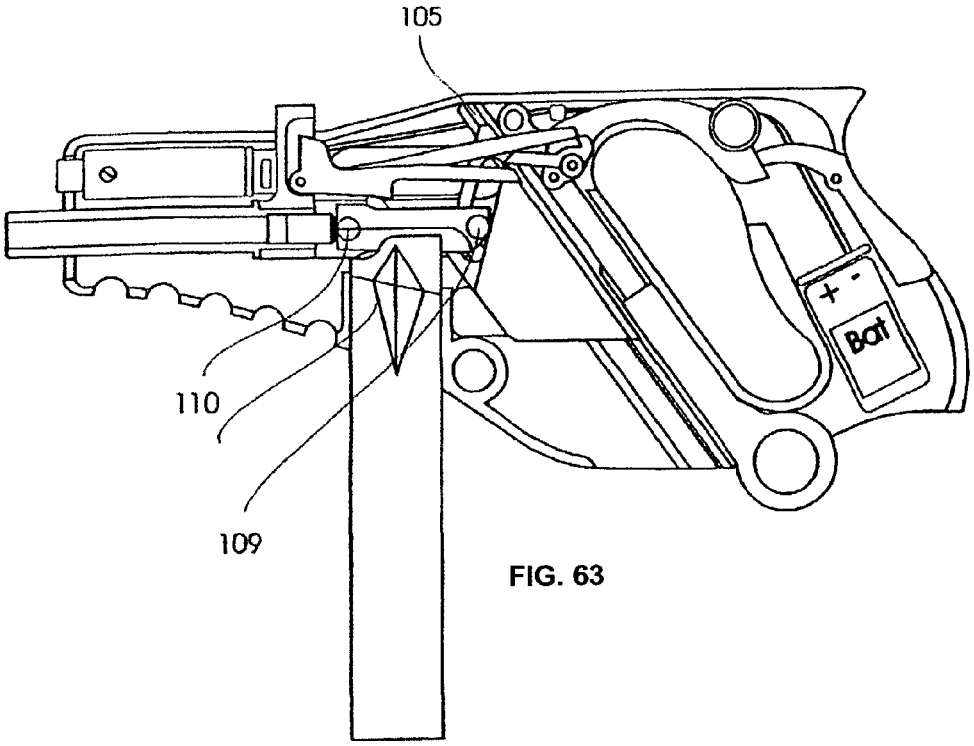

In FIG. 63, the cartridge has been struck, the bullet has exited the barrel (154) and the spent case starts backwards and forces back the bolt head (103). At the instant of its recoil, it strikes the inertia block (102), causing it to descend at high speed to the rear zone of the breech block cavity guided by grooves (105). The initial movement of the bolt head (103) is a translation backwards, tenons (109 and 1O) being guided in the forward arm (106*a*) of the V of guidance ramp (106), while the movement of the inertia block (102) is a sloped translation (P2) towards the lower part of the gun, guided by rails (105). During the displacement, the spindle (109) slides in the slot (208) toward the rear-up extremity (208*b*) of slot (208).

The surface (111) of slot (208) and spindle (109) make contact momentarily, impulsively transferring the recoil forces and momentum from spindle (109) to inertia block (102) and then separate. The bolt head (103) is then pulled toward the back of the gun by the inertia block, to which it has transmitted the recoil energy, with spindle (109) sliding to side (112) of slot (208). The spent case is pulled backward in conventional ejection technique.

As the mobile breech pursues its displacement towards the back of the gun, the spindle (109) goes over the rounded top (106*b*) of the V of the ramp. The trajectory of the bolt head (103) curves toward the bottom of the gun.

Figure 64:
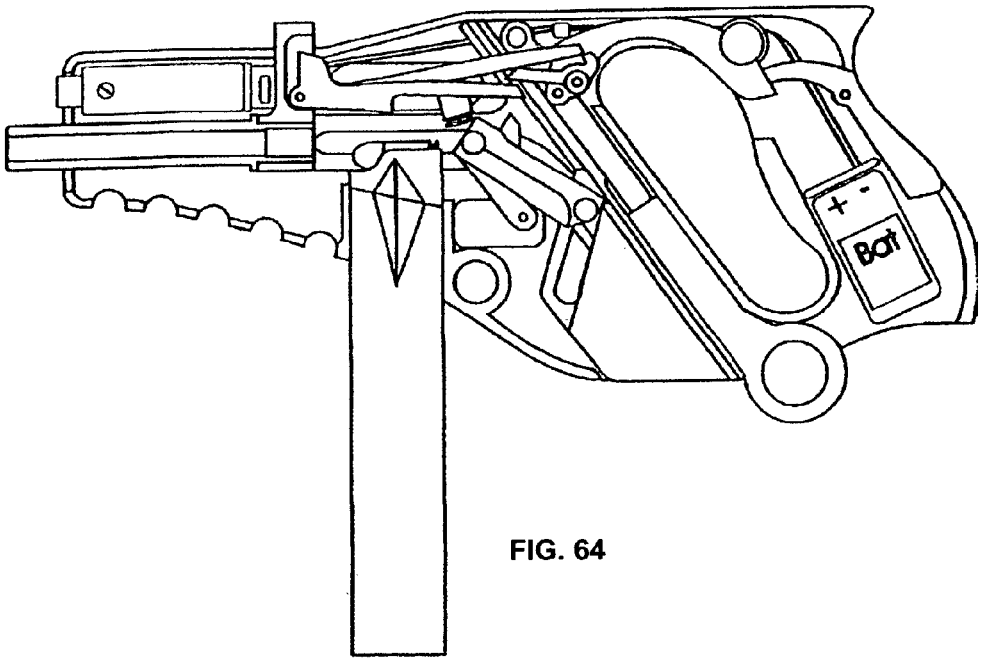

In FIG. 64, the mobile breech has reached its final position at the back of the weapon. The return spring (116) has absorbed the maximum energy generated as recoil. The spent case is being ejected in conventional action.

Figure 65:
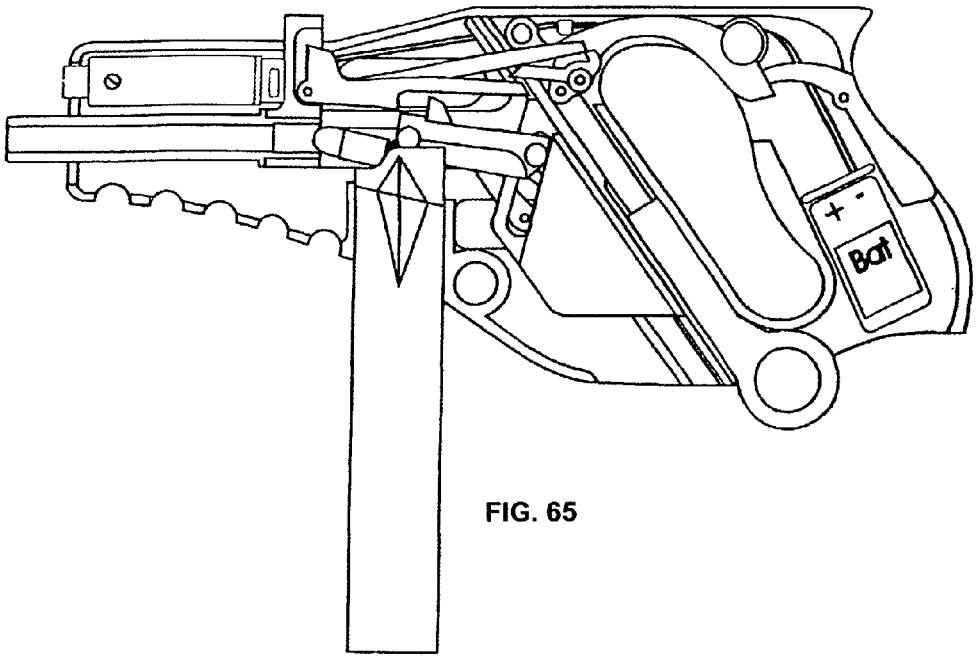
Figure 66:
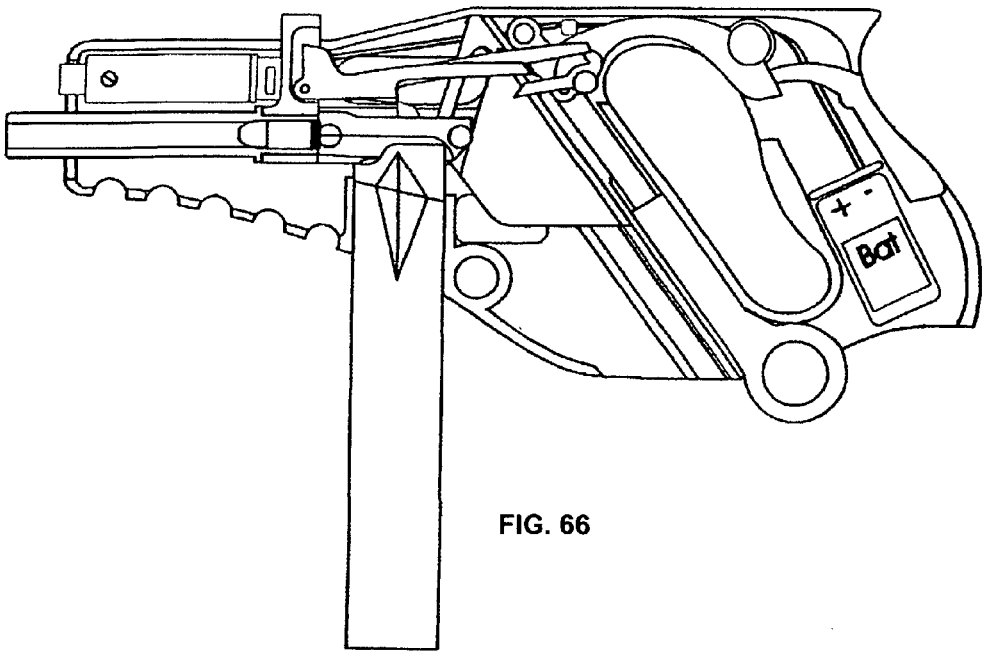

In FIG. 65, the spent case having been ejected, the inertia block (102) moves upward along groove (105) under the influence of the force of the return spring (116), ultimately returning the bolt to its initial pre-percussion position. When the spindle (109) reaches the rounded summit (106*b*) of the guide ramp, in the V, the orientation of the bolt head (103) alters to the horizontal. The bolt head (103) extracts a new cartridge from the magazine to feed the chamber in a conventional movement. During its displacement toward the front of the mobile breech, the spindle (109) slides in the slot (208) towards its forward-down limit (208*a*), pushed by the side of the slot (111).

Between the phase depicted in FIG. 65 and that shown in FIG. 66, the hammer is cocked and the new round is chambered under pressure exerted by the bolt head. The recoil control device regains the same configuration as that shown in FIG. 61. However, if the safety catch and the trigger are released, and the gun is set to fire in bursts, the following bullet fires automatically.

FIGS. 61 to 66 show that the assembly of moving parts is confined in closed housing. The user thus is not in contact with projecting, moving parts.

Figure 67:
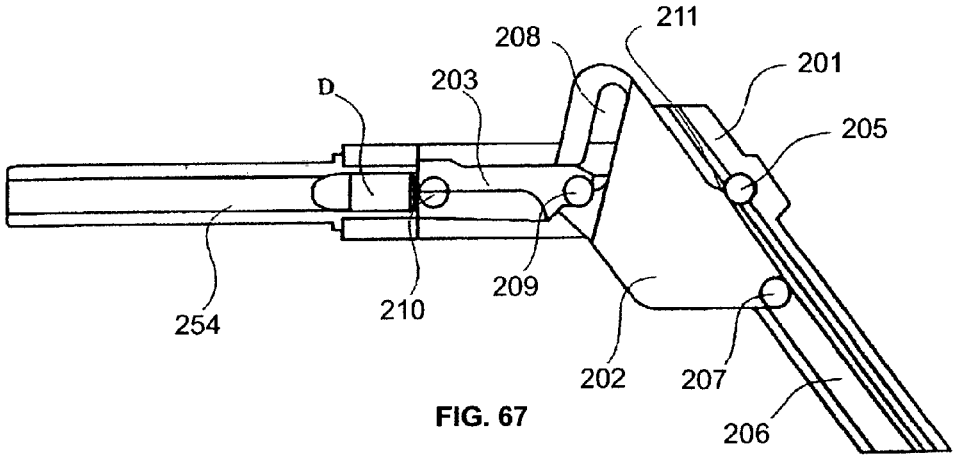
FIGS. 67-69 schematically show the mechanism of action of a recoil control device of the invention.
Figure 68:
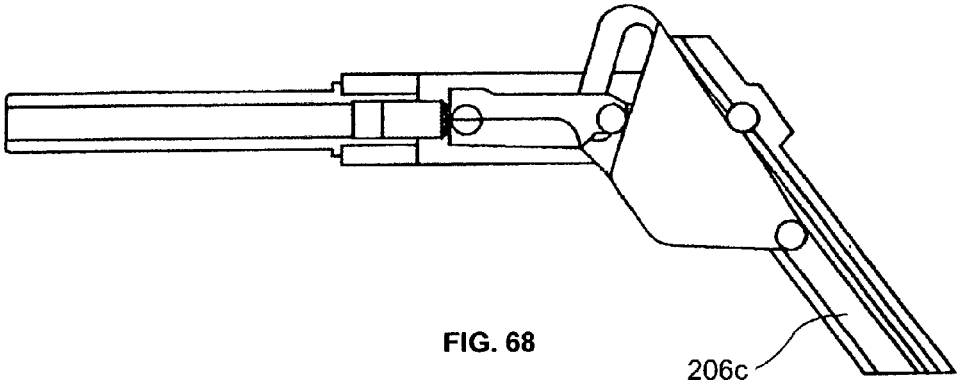
Figure 69:
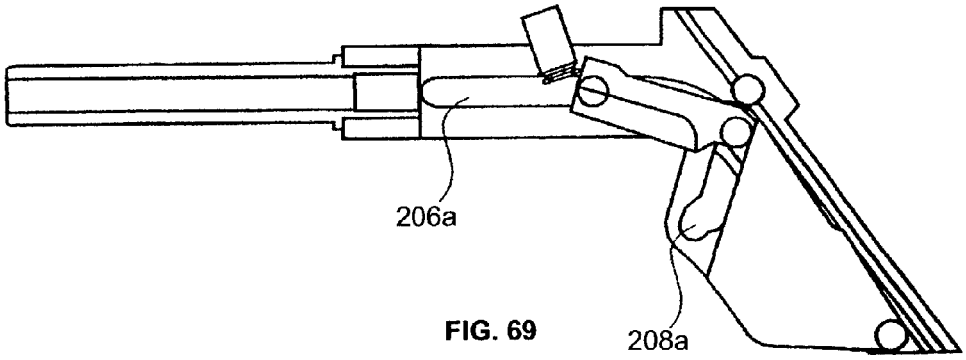
Figure 70:
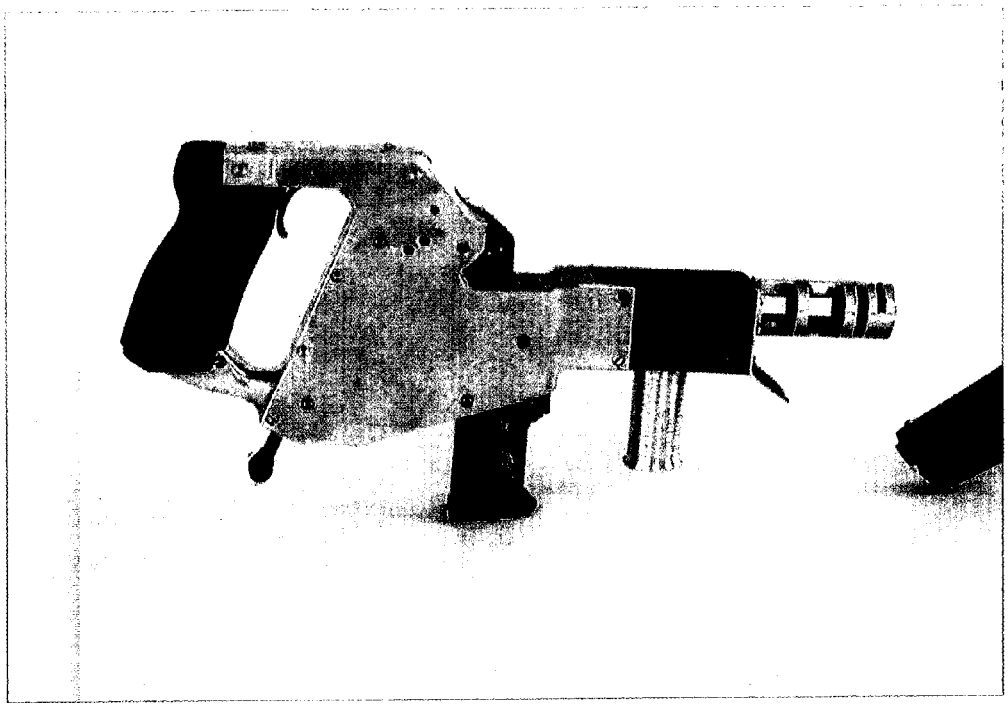
FIG. 70 is a photograph of an embodiment of the invention enclosed in a metal case.
Figure 71:
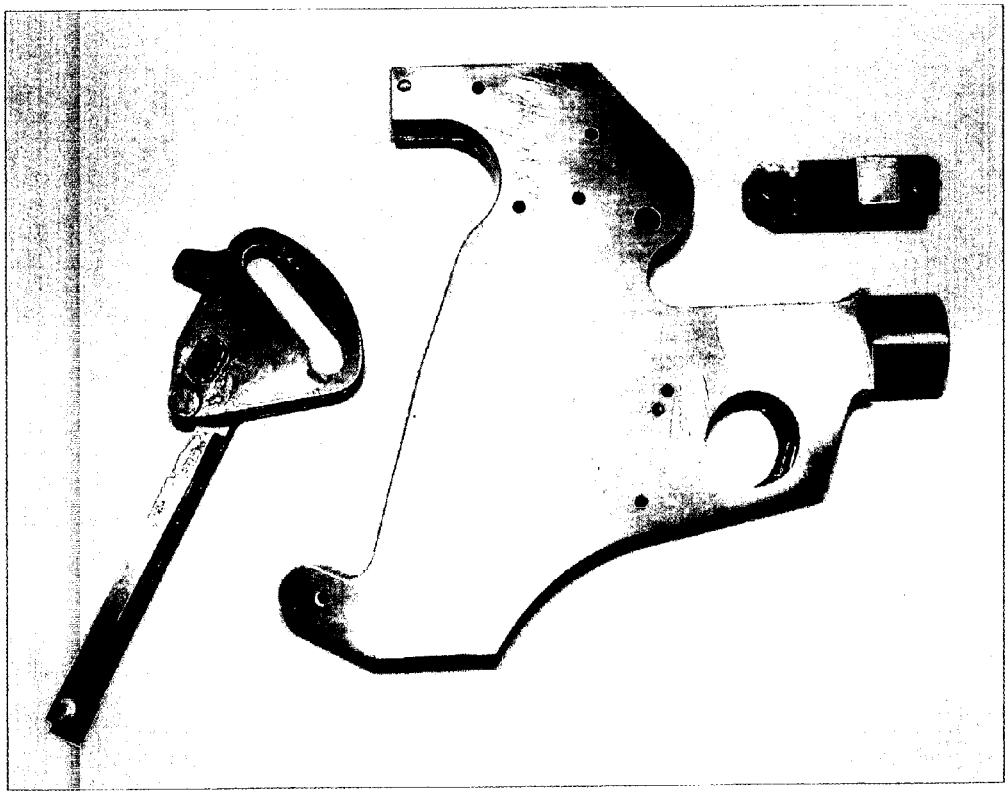
FIG. 71 is a photograph of a preferred embodiment of the invention comprising a slider with manual cocking lever (at left), a frame with integral guide or path for slider and bolt head (center), and bolt head (right). The protruding tenons or elements on slider and bolt head fit within the integral bolt head receiver element and slider guide element of the frame (not visible). The slot in slider also shows double-angle surface of slider that contacts bolt head. Tenon or element at end of bolt head fits within slot in slider. As noted in the description, the novel aspects of the invention allow easily manufactured parts such as these. Furthermore, the large size and robust character of the moving parts shown here allow for more reliable use, easier cleaning and maintenance of a firearm.

FIGS. 67, 68 and 69 illustrate a preferred embodiment of the moment control mechanism in which the movement of the slider is no longer one of pure translation but of translation to which is added an oscillation at the instant of recoil. With this treatment, the slider's movement exploits the same guide groove as the bolt head and a pressure roller located behind the slider.

As shown in FIG. 67, the gun has a breech block, (201), in inverted V form, which has a guide (206), also in V form in the mass of the side of the breech head. The bolt head (203) slides in the groove of guide (206) by means of tenons (209) and (210), as in the embodiment of FIGS. 59-66. The bolt head (203) is articulated with slider (202) by tenon (209), which engages oblong slot (208) in the forward edge of the slider (203). The forward-down extremity of slot (208) has a skewed extension (208*a*) with a recess as shown in FIG. 69. In addition, a recess (211) is situated in the rear of the slider, which slides on a pressure roller (205). The recess (211) and the skewed extension (208*a*) of the slot are arranged to cooperate at the start and the finish of the firing cycle. The slider has a tenon (207), which slides in the lower portion or intertia block guide region (206*c*) of the guidance ramp or guide (206). The guide or guidance ramp (206) also accommodates tenons (209 and 210) of the bolt head in its horizontal portion (206*a*), at which point it forms the bolt head guide.

The functioning of this preferred embodiment for the recoil control device is by and large the same as that portrayed in FIGS. 59-66. This embodiment differs from the embodiment of FIGS. 59-66 in that at percussion the bolt head (203) presses the slider (202) between tenon (209) at the rear extremity of bolt head (203), and the pressure roller (205). The slider (202) is then expelled downward towards the bottom of the gun at a rate of displacement that is a function of the decoupling angles presented by the slopes of skewed extension (208*a*) and recess (211) on either side of the slider. Once the full rate of displacement of the slider (202) is achieved, it becomes the motor of the system and carries the bolt head to the rear with tenon (209) traveling in slot (208), the bolt head sliding in the segment (206*a*) of groove (206). At the start of its displacement towards the rear, the slider (202) tilts on its lug (207) in its lower section. On the other hand, an inverse oscillation by the slider at the end of its return has a dampening effect as the bolt head regains a closed configuration, its cartridge chambered.

The addition of the oscillation of the slider (202) to the overall movement of translation of the embodiment of FIGS. 59-66 enables greater adjustment of the resistance to the moment by means of an appropriate modification of the slider's decoupling angles, which present slopes that differ from the slope of groove (206).

The following Examples, and forgoing description, are intended to show merely optional configurations for the devices of the invention. Variations, modifications, and additional attachments can be made by one of skill in the art. Thus, the scope of the invention is not limited to any specific Example or any specific embodiment described herein. Furthermore, the claims are not limited to any particular embodiment shown or described here.

Exemplary prototypes incorporating one or more elements of the invention are presented in the following characteristics:

A heavy caliber firearm is produced with an overall length of 1360 mm, and overall width of 120 mm (with extended or open inertia blocks approx. 360 mm), and a barrel length of 878 mm (without muzzle break). The total weight is approximately 25 kg and it is outfitted with a feeding device for 20 round magazines. The expected cycle rate is up to 1500 rpm.

A heavy caliber firearm is produced with an overall length of 1269 mm, and overall width of 160 mm (with extended or open inertia blocks approx. 360 mm), and a barrel length of 878 mm (without muzzle break). The total weight is approximately 25 kg and it is outfitted with a feeding device for 20 round magazines. The expected cycle rate is up to 1500 rpm.

A series of exemplary 0.45 caliber machine pistols or handguns is produced, wherein the slider has a weight of between about 150 grams to about 175 grams, the bolt head has a weight of between about 50 grams to about 70 grams. The return device or recoil spring used has a 8.5 kg tare to about 11 kg tare.

One example employs a double-angle slider, similar to the embodiments of FIGS. 43-46 and incorporating one or more elements of the invention, and is presented with the following characteristics: length of barrel: approx 3-4 inches; initial angle of sloped surface of slider relative to barrel axis: 36 degrees or 44.5 degrees; weight of bolt head 52 g; weight of inertia block 152 g; tare, recoil spring 8.4 kg. The operational characteristics give a theoretical firing rate: 950-1000 rounds/min.

Firing tests gave subjective impression of very smooth working part movement, with a noticeable reduction or quasi-total absence of the phenomenon of recoil. Additional testing with single rounds and eight round bursts (automatic action) also showed remarkable reduction of recoil with 0.45 caliber rounds and an elimination of upward jerking forces compared to a conventional 0.45 caliber handgun.

Another example incorporates the embodiments of FIGS. 47-48 and one or more elements of the invention and is presented by the following characteristics:

(i) Length of barrel: 603 mm
(ii) Total length: 978 mm
(iii) Weight (without magazine): 3.5 kg
(iv) System: gas and locked bolt
(v) Caliber: 7.62 NATO
(vi) Theoretical firing rate: up to 950 rounds/min A 0.45 caliber automatic machine gun is produced using a double-angled slider having a downward slider path similar to those shown in FIGS. 43-46. The weight of the bolt head is 56 g and the weight of the inertia block is 172 g.

The firearm was discharged in 5 round bursts and compared to the M3-3A1 automatic submachine gun ("grease gun") and a handheld Colt M1911 0.45 caliber pistol. The upward jerking forces produce a noticeable and pronounced upward movement of the end of the barrel for the grease gun and pistol. In contrast, the firearm employing the device of the invention shows relatively little or no upward movement when handled and fired in similar circumstances.

One skilled in the art can devise and create numerous other examples according to this invention. Examples may also incorporate additional firearm elements known in the art, including muzzle brake, multiple barrels, blow sensor, barrel temperature probe, electronic firing control, mechanical firing control, electromagnetic firing control, and targeting system, for example. One skilled in the art is familiar with techniques and devices for incorporating the invention into a variety of firearm examples, with or without additional firearm elements know in the art, and designing firearms that take advantage of the improved force distribution and recoil reduction characteristics of the invention.

What is claimed is:

1. A recoil control device in combination with a firearm having a barrel, the device comprising:

a bolt head configured to alternate between a forward position within the axis of the barrel and a rearward position tilting out of the axis of the barrel, the alternating positions in response to the firing of one or more cartridges; and an inertia block positioned at the rearward end of the bolt head such that said bolt head imparts an impulse to the inertia block as the bolt head alternates between the forward position and the rearward position, the movement of the inertia block having a component lateral to or perpendicular to the firing axis of the barrel of the firearm, the inertia block having a first surface for receiving an impulse from the bolt head when the bolt head is at a forward position and the bolt head within the axis of the barrel, and the inertia block having a second surface for receiving an impulse from the bolt head as the bolt head moves to a rearward position and the inertia block advances to the end of its movement, wherein the first and second surfaces have different angles relative to the axis of the barrel.

2. The recoil control device of claim 1, wherein the bolt head is connected to the inertia block by a linkage.

3. The recoil control device of claim 1, wherein the linkage comprises a pin rod with a first end connected to the bolt head by a first spindle with a longitudinal axis perpendicular to the axis of the gun barrel, and a second end, opposite said first end, said second end connected to the inertia block by a second spindle with a longitudinal axis perpendicular to the axis of the gun barrel such that the impulse can be transmitted from the bolt head to the inertia block via the pin rod.

4. The recoil control device of claim 1, wherein the bolt head comprises a first leading surface sloped to make contact with a sloped surface on the inertia block in order to transmit said impulse.

5. The recoil control device of claim 1, further comprising a triggering mechanism for selectively imparting a return impulse to the bolt head to cause it to return to the forward position, thereby enabling precise, efficient control of the firing rate.

6. The recoil control device of claim 5, wherein the return impulse is selected from an electromechanical impulse and an electropneumatic impulse.

7. The recoil control device of claim 5, wherein the triggering mechanism prevents the bolt head from traveling past the rearward position.

8. The recoil control device of claim 1, further comprising a recovery mechanism for countering the movement of the inertia block.

9. The recoil control device of claim 8, wherein the recovery mechanism comprises a spring.

10. The recoil control device of claim 8, further comprising a triggering mechanism for selectively imparting a return impulse to the bolt head that permits the recovery mechanism to return the bolt head to the forward position, thereby enabling precise, efficient control of the firing rate.

11. The recoil control device of claim 10, wherein the triggering mechanism prevents the bolt head from traveling past the rearward position.

12. A recoil control device in combination with a semiautomatic or automatic firearm having a barrel, said device comprising:

a mobile breech comprising a bolt head and an inertia block;

the bolt head configured to alternate between a forward position and a rearward position in response to the percussion of one or more cartridges, the bolt head comprising a first leading surface sloped to make contact with a first sloped surface on the inertia block in order to transmit an impulse to the inertia block as it alternates between the forward position and the rearward position, the inertia block having both a first sloped surface and a second sloped surface to make contact the bolt head, and the movement of the bolt head at the rearward position tilts out of the axis of the barrel of the firearm.

13. The recoil control device of claim 12, further comprising a triggering mechanism for selectively imparting a return impulse to the bolt head to cause it to return to the forward position, thereby enabling precise, efficient control of the firing rate.

14. The recoil control device of claim 12, wherein the triggering mechanism prevents the bolt head from traveling past the rearward position.

15. The recoil control device of claim 12, wherein the bolt head is connected to the inertia block by a linkage.

16. The recoil control device of claim 15, wherein the linkage comprises a pin rod with a first end connected to the bolt head by a first spindle with a longitudinal axis perpendicular to the axis of the gun barrel, and a second end, opposite said first end, said second end connected to the inertia block by a second spindle with a longitudinal axis perpendicular to the axis of the gun barrel.

17. The recoil control device of claim 16, wherein the spindle linking the pin rod and the inertia block is housed between them, the pin rod having play in the longitudinal direction, said play enabling said mobile breech to be in extended configuration or in compact configuration, said play being sufficient to bring said first leading sloped surface on the bolt head in abutment with said second sloped surface on the inertia block whereby the mobile breech is placed in compact configuration.

18. The recoil control device of claim 17, wherein the pin rod presents a barrier corresponding to a ridge of the inertia block to maintain the mobile breech in extended configuration.

19. The recoil control device of claim 12, further comprising a bolt head guide, fixed in relation to the axis of the gun barrel and arranged such that the initial displacement of the bolt head from the forward position to the rearward position is executed in line with the axis of the gun barrel; and further comprising an inertia block guide fixed in relation to the axis of the gun barrel and arranged to guide the inertia block such that the movement of the inertia block responsive to the impulse comprises a component perpendicular to the axis of the gun barrel.

20. The recoil control device of claim 19, wherein the inertia block guide comprises a ramp sloped relative to the axis of the gun barrel.

21. The recoil control device of claim 12, further comprising a recovery mechanism for countering the movement of the inertia block.

22. The recoil control device of claim 21, wherein the recovery mechanism comprises a spring.

23. The recoil control device of claim 21, wherein movement of the inertia block is guided by a ramp arranged at a slope in relation to the gun barrel.

* * * * *

UNITED STATES PATENT AND TRADEMARK OFFICE

CERTIFICATE OF CORRECTION

PATENT NO. : 9,038,524 B2
APPLICATION NO. : 10/454778
DATED : May 26, 2015
INVENTOR(S) : Jebsen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 790 days.

Signed and Sealed this
Fifteenth Day of September, 2015

Michelle K. Lee

Michelle K. Lee
*Director of the United States Patent and Trademark Office*